US010916373B2

(12) United States Patent
Nozawa et al.

(10) Patent No.: US 10,916,373 B2
(45) Date of Patent: Feb. 9, 2021

(54) R-T-B SINTERED MAGNET AND PRODUCTION METHOD THEREFOR

(71) Applicant: HITACHI METALS, LTD., Tokyo (JP)

(72) Inventors: Noriyuki Nozawa, Minato-ku (JP); Yasutaka Shigemoto, Minato-ku (JP); Takeshi Nishiuchi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/465,585

(22) PCT Filed: Nov. 30, 2017

(86) PCT No.: PCT/JP2017/043058
§ 371 (c)(1),
(2) Date: May 31, 2019

(87) PCT Pub. No.: WO2018/101402
PCT Pub. Date: Jun. 7, 2018

(65) Prior Publication Data

US 2019/0326053 A1 Oct. 24, 2019

(30) Foreign Application Priority Data

Dec. 1, 2016 (JP) ..... 2016-233929
Dec. 1, 2016 (JP) ..... 2016-233930
Dec. 26, 2016 (JP) ..... 2016-251306

(51) Int. Cl.
*H01F 41/02* (2006.01)
*B22F 3/24* (2006.01)
*B22F 3/10* (2006.01)

(52) U.S. Cl.
CPC ..... *H01F 41/0253* (2013.01); *B22F 3/1003* (2013.01); *B22F 3/24* (2013.01); *B22F 2003/248* (2013.01); *B22F 2301/355* (2013.01)

(58) Field of Classification Search
None
See application file for complete search history.

(56) References Cited

U.S. PATENT DOCUMENTS

2008/0286595 A1 11/2008 Yoshimura et al.
2010/0231338 A1* 9/2010 Morimoto ..... C22C 1/0475 335/302

(Continued)

FOREIGN PATENT DOCUMENTS

JP 2014-225623 A 12/2014
WO 2007/102391 A1 9/2007

(Continued)

OTHER PUBLICATIONS

Official Communication issued in International Patent Application No. PCT/JP2017/043058, dated Feb. 27, 2018.

*Primary Examiner* — Xiaowei Su
(74) *Attorney, Agent, or Firm* — Keating & Bennett, LLP

(57) ABSTRACT

A sintered R-T-B based magnet composition includes: R: not less than 27 mass % and not more than 37 mass % (R is at least one rare-earth element which always includes at least one of Nd and Pr), B: not less than 0.75 mass % and not more than 0.97 mass %, Ga: not less than 0.1 mass % and not more than 1.0 mass %, Cu: not less than 0 mass % and not more than 1.0 mass %, and T: 61.03 mass % or more (where T is at least one selected from Fe, Co, Al, Mn and Si and always includes Fe, such that the Fe content is 80 mass % or more in the entire T). [T]/[B] is greater than 14.0. An R amount is greater in the surface than in the center, and a (Continued)

Ga amount is greater in the surface than in the center. [T]/[B] in the surface is higher than [T]/[B] in the center.

3 Claims, 5 Drawing Sheets

(56) References Cited

U.S. PATENT DOCUMENTS

| | | | | |
|---|---|---|---|---|
| 2012/0280775 | A1* | 11/2012 | Nagata | B22F 3/24 335/302 |
| 2014/0132377 | A1* | 5/2014 | Nakajima | B22F 3/24 335/302 |
| 2014/0314612 | A1 | 10/2014 | Nakajima et al. | |
| 2015/0170810 | A1* | 6/2015 | Miwa | B22F 3/10 75/246 |
| 2016/0042847 | A1* | 2/2016 | Nishiuchi | C22C 38/001 335/302 |
| 2018/0025819 | A1* | 1/2018 | Shigemoto | B22F 3/24 419/23 |
| 2018/0047504 | A1 | 2/2018 | Nishiuchi et al. | |

FOREIGN PATENT DOCUMENTS

| | | | | |
|---|---|---|---|---|
| WO | 2013/008756 | A1 | 1/2013 | |
| WO | WO-2014157448 | A1 * | 10/2014 | C22C 38/001 |
| WO | 2016/133071 | A1 | 8/2016 | |
| WO | 2016/133080 | A1 | 8/2016 | |

* cited by examiner

R-T-B SINTERED MAGNET AND PRODUCTION METHOD THEREFOR

TECHNICAL FIELD

The present invention relates to a sintered R-T-B based magnet and a method for producing the same.

BACKGROUND ART

Sintered R-T-B based magnets (where R is at least one rare-earth element which always includes Nd; T is at least one transition metal element which always includes Fe; and B is boron) are known as permanent magnets with the highest performance, and are used in voice coil motors (VCM) of hard disk drives, various types of motors such as motors for electric vehicles (EV, HV, PHV, etc.) and motors for industrial equipment, home appliance products, and the like.

A sintered R-T-B based magnet is composed of a main phase which mainly consists of an $R_2T_{14}B$ compound and a grain boundary phase (which hereinafter may be simply referred to as the "grain boundaries") that is at the grain boundaries of the main phase. The $R_2T_{14}B$ compound is a ferromagnetic phase having high magnetization, and provides a basis for the properties of a sintered R-T-B based magnet.

There exists a problem in that coercivity $H_{cJ}$ (which hereinafter may be simply referred to as "coercivity" or as "$H_{cJ}$") of sintered R-T-B based magnets decreases at high temperatures, thus causing an irreversible thermal demagnetization. For this reason, sintered R-T-B based magnets for use in motors for electric vehicles, in particular, are required to have high $H_{cJ}$ at high temperatures, i.e., to have higher $H_{cJ}$ at room temperature.

CITATION LIST

Patent Literature

[Patent Document 1] International Publication No. 2007/102391

[Patent Document 2] International Publication No. 2013/008756

[Patent Document 3] International Publication No. 2016/133071

SUMMARY OF INVENTION

Technical Problem

It is known that $H_{cJ}$ is improved if Nd, as a light rare-earth element RL in an $R_2T_{14}B$-based compound phase, is replaced with a heavy rare-earth element RH (mainly Dy, Tb). However, in a sintered R-T-B based magnet, replacing the light rare-earth element RL (Nd, Pr) with a heavy rare-earth element RH may improve $H_{cJ}$, but decrease its remanence $B_r$ (which hereinafter may be simply referred to as "remanence" or "$B_r$") because of decreasing the saturation magnetization of the $R_2T_{14}B$-based compound phase.

Patent Document 1 describes, while supplying a heavy rare-earth element RH such as Dy onto the surface of a sintered magnet of an R-T-B based alloy, allowing the heavy rare-earth element RH to diffuse into the interior of the sintered magnet. According to the method described in Patent Document 1, Dy is diffused from the surface of the sintered R-T-B based magnet into the interior, thus allowing Dy to thicken only in the outer crust of a main phase crystal grain that is effective for $H_{cJ}$ improvement, whereby high $H_{cJ}$ can be obtained with a suppressed decrease in $B_r$.

However, heavy rare-earth elements, in particular Dy and the like, are a scarce resource, and they yield only in limited regions. For this and other reasons, they have problems of instable supply, significantly fluctuating prices, and so on. Therefore, it has been desired in the recent years to improve $H_{cJ}$ without using a heavy rare-earth element RH.

Patent Document 2 discloses a sintered R-T-B based rare-earth magnet in which coercivity is enhanced while the Dy content is reduced. The composition of this sintered magnet is limited to a specific range characterized by relatively small B amounts as compared to any R-T-B type alloys which have been commonly used, and contains one or more metallic elements M selected from among Al, Ga and Cu. As a result, an $R_2T_{17}$ phase is formed at the grain boundaries, and, from this $R_2T_{17}$ phase, a transition metal-rich phase ($R_6T_{13}M$) is formed at the grain boundaries with an increased volumetric proportion, whereby $H_{cJ}$ is improved.

Patent Document 3 describes allowing an R—Ga—Cu alloy of a specific composition to be in contact with the surface of an R-T-B based sintered compact whose B amount is lower than usual (i.e., lower than is defined by the stoichiometric ratio of the $R_2T_{14}B$ compound) and performing a heat treatment, thus to control the composition and thickness of a grain boundary phase in the sintered R-T-B based magnet and improve $H_{cJ}$.

According to the method described in Patent Document 2 or Patent Document 3, it is possible to obtain high $H_{cJ}$ without using a heavy rare-earth element RH such as Dy; however, there is a problem of lowered $B_r$.

Various embodiments of the present disclosure provide sintered R-T-B based magnets which have high $B_r$ and high $H_{cJ}$ while reducing the content of the heavy rare-earth element RH, and methods for producing the same.

Solution to Problem

In an illustrative embodiment, a sintered R-T-B based magnet according to the present disclosure is a sintered R-T-B based magnet comprising:

R: not less than 28 mass % and not more than 36 mass % (where R is at least one rare-earth element which always includes at least one of Nd and Pr), B: not less than 0.73 mass % and not more than 0.96 mass %, Ga: not less than 0.1 mass % and not more than 1.0 mass %, Cu: not less than 0.1 mass % and not more than 1.0 mass %, and T: not less than 60 mass % (where T is at least one selected from the group consisting of Fe, Co, Al, Mn and Si and always includes Fe, such that the Fe content accounts for 80 mass % or more in the entire T), wherein, a molar ratio of T to B ([T]/[B]) is greater than 14.0;

an R amount in a magnet surface portion at a cross section perpendicular to an alignment direction is greater than an R amount in a magnet central portion;

a Ga amount in the magnet surface portion at the cross section perpendicular to the alignment direction is greater than a Ga amount in the magnet central portion; and a molar ratio of T to B ([T]/[B]) in the magnet surface portion at the cross section perpendicular to the alignment direction is higher than a molar ratio of T to B ([T]/[B]) in the magnet central portion.

In a preferred embodiment, a Cu amount in the magnet surface portion at the cross section perpendicular to the alignment direction is greater than a Cu amount in the magnet central portion.

In a preferred embodiment, the molar ratio of T to B ([T]/[B]) of the sintered R-T-B based magnet is greater than 14.0 but not greater than 16.4.

In another illustrative embodiment, a method for producing a sintered R-T-B based magnet according to the present disclosure comprises: a step of providing an R1-T1-B based sintered compact; a step of providing an R2-Cu—Ga—Fe based alloy; a step of, while keeping at least a portion of the R2-Cu—Ga—Fe based alloy in contact with at least a portion of a surface of the R1-T1-B based sintered compact, performing a first heat treatment at a temperature of not lower than 700° C. and not higher than 1100° C. in a vacuum or an inert gas ambient; and a step of subjecting the R1-T1-B based sintered compact having undergone the first heat treatment to a second heat treatment at a temperature of not lower than 450° C. and not higher than 600° C. in a vacuum or an inert gas ambient. In the R1-T1-B based sintered compact, R1 is at least one rare-earth element which always includes at least one of Nd and Pr, the R1 content accounting for not less than 27 mass % and not more than 35 mass % of the entire R1-T1-B based sintered compact, T1 is at least one selected from the group consisting of Fe, Co, Al, Mn and Si, where T1 always includes Fe, the Fe content in the entire T1 accounting for 80 mass % or more, and a molar ratio [T1]/[B] is greater than 14.0 but not greater than 15.0. In the R2-Cu—Ga—Fe based alloy, R2 is at least one rare-earth element which always includes at least one of Nd and Pr, the R2 content accounting for not less than 35 mass % and not more than 85 mass % of the entire R2-Cu—Ga—Fe based alloy, the Cu content accounts for not less than 2.5 mass % and not more than 40 mass % of the entire R2-Cu—Ga—Fe based alloy, the Ga content accounts for not less than 2.5 mass % and not more than 40 mass % of the entire R2-Cu—Ga—Fe based alloy, and the Fe content accounts for not less than 10 mass % and not more than 45 mass % of the entire R2-Cu—Ga—Fe based alloy.

In one embodiment, the molar ratio [T1]/[B] is not smaller than 14.3 and not greater than 15.0.

In one embodiment, the Fe content in the R2-Cu—Ga—Fe based alloy accounts for not less than 15 mass % and not more than 40 mass % of the entire R2-Cu—Ga—Fe based alloy.

In one embodiment, 50 mass % or more of the R2 in the R2-Cu—Ga—Fe based alloy is Pr.

In one embodiment, 70 mass % or more of the R2 in the R2-Cu—Ga—Fe based alloy is Pr.

In one embodiment, a total content of R2, Cu, Ga and Fe in the R2-Cu—Ga—Fe based alloy accounts for 80 mass % or more.

In one embodiment, the temperature of the first heat treatment is not lower than 800° C. and not higher than 1000° C.

In one embodiment, the temperature of the second heat treatment is not lower than 480° C. and not higher than 560° C.

In one embodiment, the step of providing the R1-T1-B based sintered compact comprises pulverizing a raw material alloy so as to result in a particle size D50 of not less than 3 μm and not more than 10 μm, and thereafter performing sintering while aligning the R1-T1-B based sintered compact in a magnetic field.

In another illustrative embodiment, a method for producing a sintered R-T-B based magnet according to the present disclosure comprises: a step of providing an R1-T1-Cu—B based sintered compact; a step of providing an R2-Ga—Fe based alloy; a step of, while keeping at least a portion of the R2-Ga—Fe based alloy in contact with at least a portion of a surface of the R1-T1-Cu—B based sintered compact, performing a first heat treatment at a temperature of not lower than 700° C. and not higher than 1100° C. in a vacuum or an inert gas ambient; and a step of subjecting the R1-T1-Cu—B based sintered compact having undergone the first heat treatment to a second heat treatment at a temperature of not lower than 450° C. and not higher than 600° C. in a vacuum or an inert gas ambient. In the R1-T1-Cu—B based sintered compact, R1 is at least one rare-earth element which always includes at least one of Nd and Pr, the R1 content accounting for not less than 27 mass % and not more than 35 mass % of the entire R1-T1-Cu—B based sintered compact, T1 is at least one selected from the group consisting of Fe, Co, Al, Mn and Si, where T1 always includes Fe, the Fe content in the entire T1 accounting for 80 mass % or more, a molar ratio [T1]/[B] is greater than 14.0 but not greater than 15.0, and the Cu content accounts for not less than 0.1 mass % and not more than 1.5 mass % of the entire R1-T1-Cu—B based sintered compact. In the R2-Ga—Fe based alloy, R2 is at least one rare-earth element which always includes at least one of Nd and Pr, the R2 content accounting for not less than 35 mass % and not more than 85 mass % of the entire R2-Ga—Fe based alloy, the Ga content accounts for not less than 2.5 mass % and not more than 40 mass % of the entire R2-Ga—Fe based alloy, and the Fe content accounts for not less than 10 mass % and not more than 45 mass % of the entire R2-Ga—Fe based alloy.

In one embodiment, the molar ratio [T1]/[B] is not smaller than 14.3 and not greater than 15.0.

In one embodiment, the Fe content in the R2-Ga—Fe based alloy accounts for not less than 15 mass % and not more than 40 mass % of the entire R2-Ga—Fe based alloy.

In one embodiment, 50 mass % or more of the R2 in the R2-Ga—Fe based alloy is Pr.

In one embodiment, 70 mass % or more of the R2 in the R2-Ga—Fe based alloy is Pr.

In one embodiment, a total content of R2, Ga and Fe in the R2-Ga—Fe based alloy accounts for 80 mass % or more.

In one embodiment, the temperature of the first heat treatment is not lower than 800° C. and not higher than 1000° C.

In one embodiment, the temperature of the second heat treatment is not lower than 480° C. and not higher than 560° C.

In one embodiment, the step of providing the R1-T1-Cu—B based sintered compact comprises pulverizing a raw material alloy so as to result in a particle size D50 of not less than 3 μm and not more than 10 μm, and thereafter performing sintering while aligning the R1-T1-B based sintered compact in a magnetic field.

Advantageous Effects of Invention

According to an embodiment of the present disclosure, while reducing the content of a heavy rare-earth element RH, a sintered R-T-B based magnet having high $B_r$ and high $H_{cJ}$ is provided.

DESCRIPTION OF EMBODIMENTS

Figure 1A:
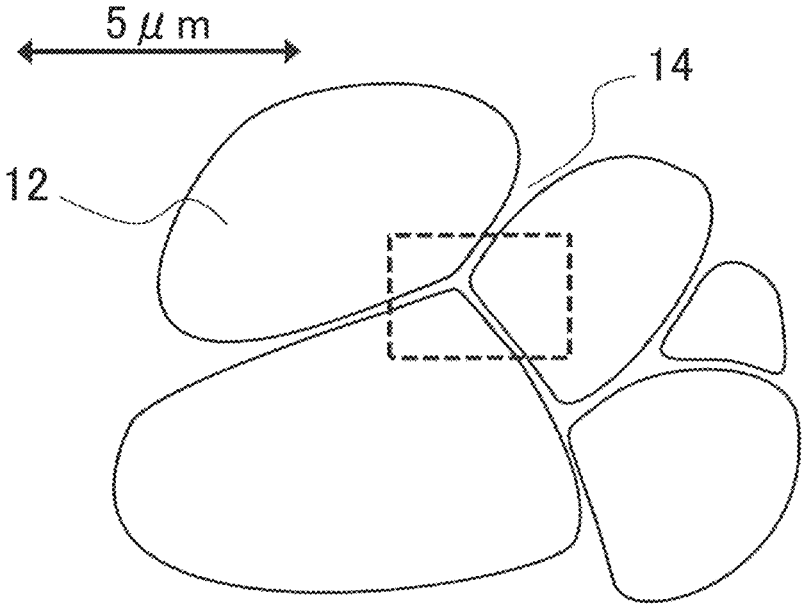
FIG. 1A A schematic diagram showing a main phase and a grain boundary phase of a sintered R-T-B based magnet.

A sintered R-T-B based magnet according to the present disclosure is produced by performing a heat treatment while an alloy containing R, Ga and Fe as its component elements is kept in contact with at least a portion of the surface of an R-T-B based sintered compact, and has a specific composition whose B amount is lower than usual (i.e., lower than is defined by the stoichiometric ratio of the $R_2T_{14}B$ compound). Without containing any Dy and Tb, which are heavy rare-earth elements, a sintered R-T-B based magnet according to the present disclosure has $B_r$ and $H_{cJ}$ which are as high as or higher than those in the case where Dy is contained (i.e., Dy being added to the raw material alloy), and is further able to exhibit high $B_r$ and high $H_{cJ}$ similar to those of the $B_r$ and $H_{cJ}$ of a sintered R-T-B based magnet that is produced by a method which diffuses Dy from the surface into the interior so that Dy is thickened in the outer crust of the main phase crystal grain.

<Mechanism>

As mentioned earlier, the method which is described in Patent Document 3 involves allowing an R—Ga—Cu alloy of a specific composition to be in contact with the surface of an R-T-B based sintered compact whose B amount is lower than usual (i.e., lower than is defined by the stoichiometric ratio of the $R_2T_{14}B$ compound) and performing a heat treatment, thus to control the composition and thickness of a grain boundary phase in the sintered R-T-B based magnet and improve $H_{cJ}$. With this method, saturation magnetization of the main phase is hardly deteriorated because no heavy rare-earth element is used. However, since a grain boundary phase is formed which is thicker than usual, the proportion of the main phase is inevitably reduced, and lowering of $B_r$ is unavoidable.

Through their studies, the inventors have found that, by using an R—Ga—Fe alloy containing Fe as an alloy to be kept in contact with the surface of the R-T-B based sintered compact, instead of the R—Ga—Cu alloy described in Patent Document 3, and by ensuring that the B amount in the finally-obtained sintered R-T-B based magnet is smaller than is defined by the stoichiometric ratio of the $R_2T_{14}B$ compound, not only higher $B_r$ is obtained than is attained by the sintered R-T-B based magnet of Patent Document 3, but also that high $B_r$ and high $H_{cJ}$ similar to those of the sintered R-T-B based magnet described in Patent Document 1 are obtained without using a heavy rare-earth element. This is presumably because, in the sintered R-T-B based magnet which is obtained by the method described in Patent Document 3, not only the grain boundary phase near the magnet surface but also the grain boundary phase near the magnet center increases in thickness, so that the proportion of the main phase decreases and $B_r$ lowers; on the other hand, in a sintered R-T-B based magnet according to the present disclosure, due to the presence of Fe contained in the R—Ga—Fe alloy, the grain boundary phase near the magnet surface becomes larger in thickness as in the magnet according to Patent Document 3, and conversely the grain boundary phase near the magnet center becomes smaller in thickness than in the magnet according to Patent Document 3 (given that the magnet according to the present disclosure and the magnet according to Patent Document 3 (i.e., the sintered R-T-B based magnet after diffusion) are identical in composition). This is believed to suppress a decrease in the main phase proportion near the magnet center. Furthermore, through a detailed study it has also been found that, in a sintered R-T-B based magnet according to the present disclosure, a molar ratio of T to B ([T]/[B]) in a magnet surface portion at a cross section perpendicular to the alignment direction (which hereinafter may be referred to as a "molar ratio [T]/[B]") is higher than a molar ratio [T]/[B] in the magnet central portion (i.e., the molar ratio [T]/[B] is lower in the magnet central portion than in the magnet surface portion (i.e., the magnet central portion is relatively high in B)). In a sintered R-T-B based magnet having such a distributed composition, a decrease in the main phase proportion near the magnet center can be minimized, whereby a decrease in $B_r$ can be suppressed.

<Explanation of T/B Ratio>

An R—Ga—Fe alloy is used in producing a sintered R-T-B based magnet according to the present disclosure. The R, Ga and Fe elements which are contained in the R—Ga—Fe alloy are introduced from the sintered compact surface into the interior, mainly through grain boundaries of the R-T-B based sintered compact. When the R, Ga and Fe elements are introduced from the sintered compact surface into the interior, an R amount in the magnet surface portion will be greater than an R amount in the magnet central portion, along the alignment direction. As the R amount in the magnet surface portion increases, amounts (proportions) of the other elements (e.g., B and Fe) will become increasingly smaller than in the magnet central portion. For example, in a sintered R-T-B based magnet in which Fe is not diffused from the magnet surface into the interior, as exemplified by a sintered R-T-B based magnet which is obtained by the method described in Patent Document 3, amounts of change in Fe and B between the magnet surface portion and the magnet central portion that are caused by R diffusion are similar, in a cross section perpendicular to the alignment direction. Specifically, since the amount of R introduced differs between the magnet surface portion and the magnet central portion, the abundance of R increases in the magnet surface portion, whereby the abundances of Fe and B become relative small. On the other hand, the abundance of R does not increase much in the magnet central portion, and therefore the abundances of Fe and B do not become much smaller. Thus, between the magnet surface portion and the magnet central portion, the relative abundances of Fe and B may be greater or smaller depending on the amount of R introduced, but the ratio between Fe and B does not change (because neither Fe no B is introduced from the sintered compact surface). Therefore, in a sintered R-T-B based magnet in which Fe is not diffused from the surface into the interior, the molar ratio [T]/[B] in a cross section perpendicular to the alignment direction is substantially equal between the magnet surface portion and the magnet central portion. Note that T is at least one selected from the group consisting of Fe, Co, Al, Mn and Si and always includes Fe, such that the Fe content accounts for 80 mass % or more in the entire T. In other words, Fe is the main component of T.

On the other hand, in a sintered R-T-B based magnet according to the present disclosure, not only R and Ga but also Fe is introduced from the sintered compact surface into the interior. Thus it has been found that, along the alignment direction, the amount of Fe introduced differs between the magnet surface portion and the magnet central portion (i.e., a larger amount of Fe is introduced in the magnet surface portion), and that the change in the relative abundance of Fe that is caused in the magnet surface portion by diffusion is smaller than the change in the relative abundance of B (which is not introduced from the sintered compact surface).

With such a characteristic distributed composition, it is possible to obtain high $B_r$ and high $H_{cJ}$ similar to those of the $B_r$ and $H_{cJ}$ of a sintered R-T-B based magnet in which Dy is thickened in the outer crust of a main phase crystal grain.

Hereinafter, embodiments concerning the structure and methods for producing of a sintered R-T-B based magnet according to the present disclosure will be described in more detail.

<Structure of Sintered R-T-B Based Magnet>

First, the fundamental structure of a sintered R-T-B based magnet according to the present disclosure will be described.

The sintered R-T-B based magnet has a structure such that powder particles of a raw material alloy have bound together through sintering, and is composed of a main phase which mainly consists of an $R_2T_{14}B$ compound and a grain boundary phase which is at the grain boundaries of the main phase.

Figure 1B:
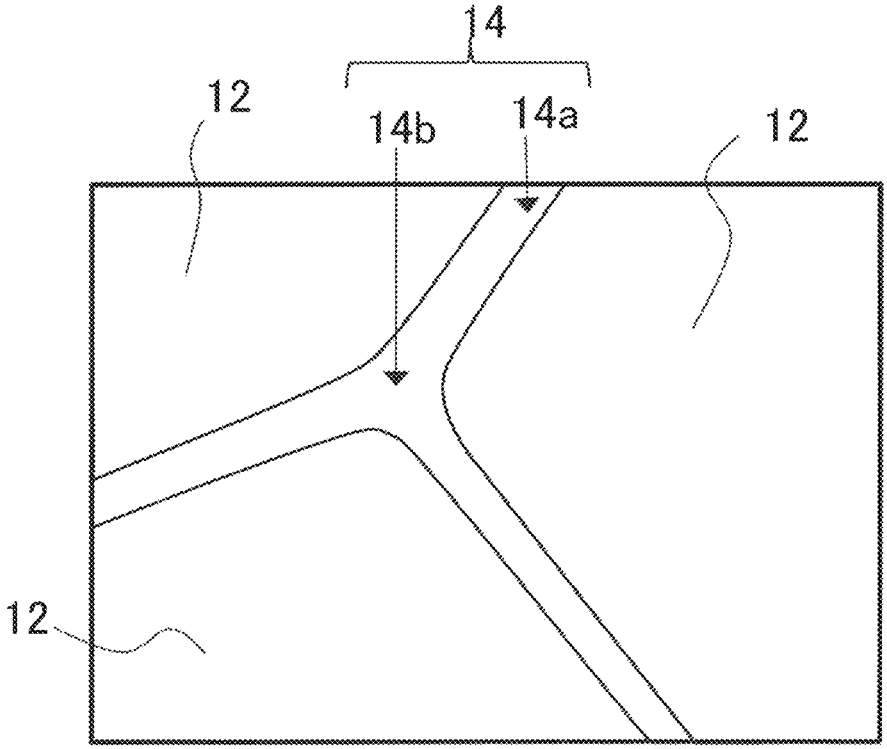
FIG. 1B A further enlarged schematic diagram of the interior of a broken-lined rectangular region in FIG. 1A.

FIG. 1A is a schematic diagram showing a main phase and a grain boundary phase of a sintered R-T-B based magnet. FIG. 1B is a further enlarged schematic diagram of the interior of a broken-lined rectangular region in FIG. 1A. In FIG. 1A, arrowheads indicating a length of 5 μm are shown as an example of reference length to represent size. As shown in FIG. 1A and FIG. 1B, the sintered R-T-B based magnet is composed of a main phase which mainly consists of an $R_2T_{14}B$ compound 12 and a grain boundary phase 14 which is at the grain boundaries of the main phase 12. Moreover, as shown in FIG. 1B, the grain boundary phase 14 includes an intergranular grain boundary phase 14*a* in which two $R_2T_{14}B$ compound grains adjoin each other, and grain boundary triple junctions 14*b* at which three or more $R_2T_{14}B$ compound grains adjoin one another. A typical main phase crystal grain size is not less than 3 μm and not more than 15 μm, this being an average value of the diameter of an approximating circle in the magnet cross section.

The main phase 12, i.e., the $R_2T_{14}B$ compound, is a ferromagnetic phase having high saturation magnetization and an anisotropy field. Therefore, in a sintered R-T-B based magnet, it is possible to improve $B_r$ by increasing the abundance ratio of the $R_2T_{14}B$ compound which is the main phase 12. In order to increase the abundance ratio of the $R_2T_{14}B$ compound, the R amount, the T amount, and the B amount in the raw material alloy may be brought closer to the stoichiometric ratio of the $R_2T_{14}B$ compound (i.e., the R amount: the T amount: the B amount=2:14:1). When the B amount or the R amount belonging in the $R_2T_{14}B$ compound falls lower than the stoichiometric ratio, generally speaking, small pieces of magnetic substance such as an Fe phase or an $R_2T_{17}$ phase occurs in the grain boundary phase 14, whereby $H_{cJ}$ is drastically decreased. However, it has been found that a sintered R-T-B based magnet according to the present disclosure can attain high $B_r$ and high $H_{cJ}$ because of having a composition and texture as described below.

In a non-limiting and illustrative embodiment, a sintered R-T-B based magnet according to the present disclosure has the following composition.

R: not less than 28 mass % and not more than 36 mass % (where R is at least one rare-earth element which always includes at least one of Nd and Pr), B: not less than 0.73 mass % and not more than 0.96 mass %, Ga: not less than 0.1 mass % and not more than 1.0 mass %, Cu: not less than 0.1 mass % and not more than 1.0 mass %, T: not less than 60 mass % (where T is at least one selected from the group consisting of Fe, Co, Al, Mn and Si and always includes Fe, such that the Fe content accounts for 80 mass % or more in the entire T).

Herein, the molar ratio [T]/[B] is greater than 14.0. Preferably, the molar ratio [T]/[B] is greater than 14.0 but not greater than 16.4. This will allow higher $B_r$ and higher $H_{cJ}$ to be obtained. Moreover, an R amount in a magnet surface portion at a cross section perpendicular to the alignment direction is greater than an R amount in the magnet central portion, and a Ga amount in a magnet surface portion at a cross section perpendicular to the alignment direction is greater than a Ga amount in the magnet central portion. Furthermore, a molar ratio [T]/[B] in a magnet surface portion at a cross section perpendicular to the alignment direction is higher than a molar ratio [T]/[B] in the magnet central portion.

As used in the present disclosure, a molar ratio of T to B ([T]/[B]) is a ratio (a/b) between: a total (a) of the respective value of a result of dividing an analysis value (mass %) of each element (Fe, Co, Al, Mn and Si) composing T with the atomic weight of that element; and (b) a result of dividing an analysis value (mass %) of B with the atomic weight of B.

That a "molar ratio [T]/[B] is greater than 14.0" means that B is contained by a ratio which is lower than is defined by the stoichiometric ratio of the $R_2T_{14}B$ compound. Stated otherwise, in the sintered R-T-B based magnet, there is a relatively small B amount for the T amount that is consumed in the main phase ($R_2T_{14}B$ compound) formation.

That "an R amount in a magnet surface portion at a cross section perpendicular to the alignment direction is greater than an R amount in the magnet central portion" means that R has been diffused from the magnet surface into the magnet interior.

That "a Ga amount in a magnet surface portion at a cross section perpendicular to the alignment direction is greater than a Ga amount in the magnet central portion" means that Ga has been diffused from the magnet surface into the magnet interior.

Furthermore, as aforementioned, that "a molar ratio [T]/[B] in a magnet surface portion at a cross section perpendicular to the alignment direction is higher than a molar ratio [T]/[B] in the magnet central portion" means that Fe has been diffused from the magnet surface into the magnet interior.

Moreover, as will be indicated in a below-described first embodiment, in the case where R, Cu, Ga and Fe are introduced from the sintered compact surface into the interior by using an R2-Cu—Ga—Fe based alloy, a Cu amount in the magnet surface portion is greater than a Cu amount in the magnet central portion, similarly to R and Ga in a cross section perpendicular to the alignment direction.

Figure 6A:
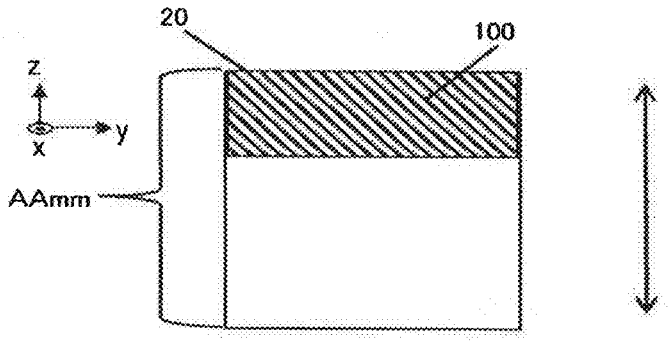
FIG. 6A An explanatory diagram showing a range in which to cut out a sample from a magnet surface portion.
Figure 6B:
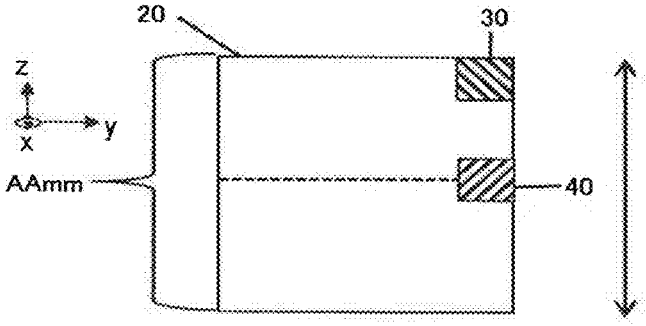
FIG. 6B An explanatory diagram showing positions at which to cut out samples from a magnet surface portion and the magnet central portion.

In the present disclosure, it is confirmed in the following manner as to whether or not "an R amount in a magnet surface portion at a cross section perpendicular to the alignment direction is greater than an R amount in the magnet central portion". Based on FIGS. 6A through 6F, positions at which to cut out samples for determining an R amount in the magnet surface portion and an R amount in the magnet central portion will be described. FIG. 6A is an explanatory diagram showing a range in which to cut out a sample from the magnet surface portion, and FIG. 6B is an explanatory diagram showing positions at which to cut out samples from the magnet surface portion and the magnet central portion. As shown in FIG. 6A, in an orthogonal coordinate system xyz in which the z axis direction corresponds to the vertical direction, such that the alignment direction (i.e., the direction indicated by a double arrow in the figure) is the z direction and a magnet dimension AA mm is defined along the alignment direction, a magnet surface portion sample can be cut out from a range 100 which includes a magnet surface 20 that is parallel to a plane perpendicular to the alignment direction and which spans a dimension corresponding to 10% to 40% of the AA mm dimension in the z axis direction from the magnet surface 20. So long as remaining in the range 100, a sample may be cut out from any place, in a manner of containing the magnet surface. For example, a region which is shown in FIG. 6B may be cut out as a magnet surface portion sample 30. In the case where a surface protection film such as plating, painting, or oxide coating is formed on the magnet surface 20, any such surface protection film is to be removed before the magnet surface portion sample 30 is cut out.

On the other hand, a magnet central portion sample 40 is cut out so that its expanse as projected onto the x-y plane coincides with the expanse of the magnet surface portion sample 30 as projected onto the x-y plane. Specifically, it is cut out from a position immediately under the magnet surface portion sample 30 along the z direction (alignment direction). Typically, the magnet central portion sample 40 is to be cut out so as to be similar in dimensions and shape to the magnet surface portion sample 30.

Figure 6C:
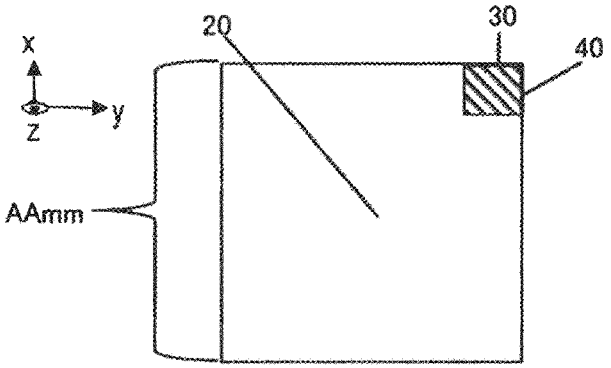
FIG. 6C An explanatory diagram in which a cross section of the magnet of FIG. 6B as taken perpendicular to the alignment direction is viewed.

FIG. 6C is a see-through view in which the magnet of FIG. 6B is viewed from a direction that is parallel to the alignment direction of the magnet. In the orthogonal coordinate system xyz shown in FIG. 6C (where the alignment direction is the z direction), when viewed from a direction that is perpendicular to the alignment direction, the magnet surface portion sample 30 and the magnet central portion sample 40 overlap. Moreover, as shown in FIG. 6B, the magnet central portion sample 40 is cut out so as to be identical with the magnet surface sample 30 with respect to its position on the x-y plane, dimensions and shape, and orientation, while being centered around a middle position (a dotted line in FIG. 6B) along the dimension along the alignment direction (the aforementioned dimension AA). The magnet surface portion sample 30 and the magnet central portion sample 40 which have been cut out are subjected to an analysis using Inductively Coupled Plasma Optical Emission Spectroscopy (ICP-OES), in order to confirm whether an R amount in the magnet surface portion is greater than an R amount in the magnet central portion or not. Although the magnet surface portion sample and the magnet central portion sample may have any arbitrary shapes, they are preferably squares whenever possible.

Figure 6D:
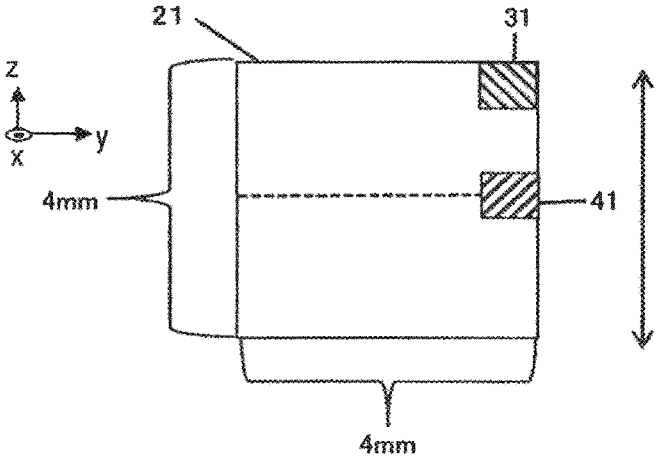
FIG. 6D An explanatory diagram illustrating exemplary positions at which to cut out samples, from a magnet surface portion and the magnet central portion, of a magnet measuring 4 mm per side.
Figure 6E:
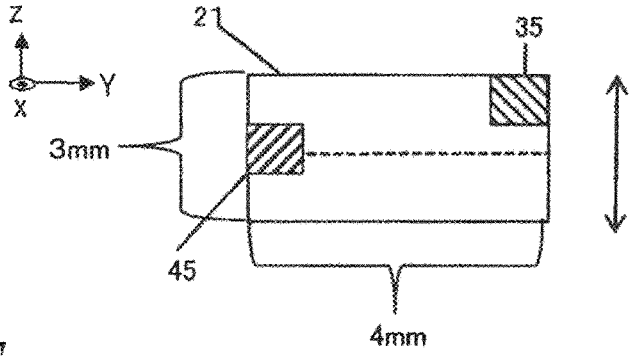
FIG. 6E An explanatory diagram illustrating exemplary positions at which to cut out samples, from a magnet surface portion and the magnet central portion, of a magnet measuring 3 mm per side.
Figure 6F:
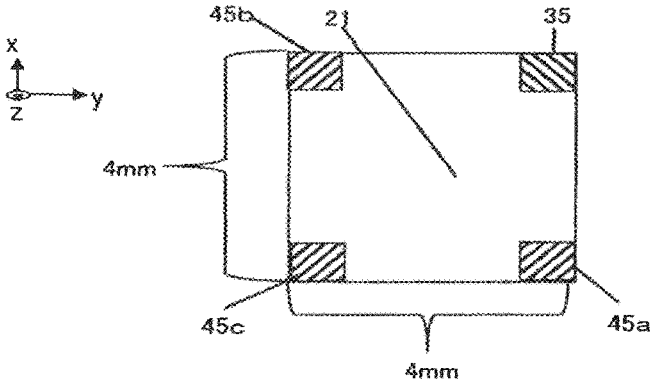
FIG. 6F An explanatory diagram in which a cross section of the magnet of FIG. 6E as taken perpendicular to the alignment direction is viewed.

FIG. 6D illustrates exemplary positions at which to cut out samples from the magnet surface portion and the magnet central portion of a magnet measuring 4 mm per side (4 mm×4 mm×4 mm). As shown in FIG. 6D, for example, a magnet surface portion sample 31 that contains the magnet surface 21 perpendicular to the alignment direction can be cut out so as to measure 1 mm per side (since its length along the alignment direction (aforementioned AA) is 4 mm, its dimension can be set within a range from 0.4 mm to 1.6 mm). A magnet central portion sample 41 can be cut out so as to measure 1 mm per side at the same position on the x-y plane as the magnet surface portion 31, while being centered around a middle position 2 mm (a dotted line in FIG. 6D) of the dimension along the alignment direction (4 mm). As FIG. 6E illustrates, if the alignment direction dimension AA is so thin, e.g., 3 mm (4 mm×4 mm×3 mm (alignment direction)), that the grinding margin during sample processing will not allow the magnet central portion to be cut out from the same position on the x-y plane as the magnet surface portion, then a sample may be taken from a position which enjoys the same diffusing condition as in the position where cutting should have taken place. In other words, a magnet central portion sample 45 may be cut out from a position on the x-y plane that is symmetric with the magnet surface portion sample 35 regarding the x or y direction, or a position that is point-symmetric with the magnet surface portion sample 35. Positions that are symmetric with the magnet surface portion sample 35 regarding the x and y directions and a position that is point-symmetric with the magnet surface portion sample 35 are depicted in FIG. 6F. FIG. 6F is an explanatory diagram in which a cross section of the magnet of FIG. 6E as taken perpendicular to the alignment direction is viewed. As shown in FIG. 6F, a magnet central portion sample 45 is to be cut out from among the three places: a position 45*a* which is symmetric with the magnet surface portion 35 regarding the x direction, a position 45*b* which is symmetric with the magnet surface portion 35 regarding the y direction, and a position 45*c* which is point-symmetric with the magnet surface portion 35. In this case, preferably, the magnet surface portion sample 35 and the magnet central portion sample 45 are cut out so as not to overlap each other along the alignment direction.

A Ga amount in the magnet surface portion and a Ga amount in the magnet central portion, a molar ratio [T]/[B] in the magnet surface portion and a molar ratio [T]/[B] in the magnet central portion, and a Cu amount in the magnet surface portion and a Cu amount in the magnet central portion are also similarly determined, in a cross section perpendicular to the alignment direction.

Note that the composition (R, B, Ga, Cu, T, and the molar ratio [T]/[B] being greater than 14.0) of a sintered R-T-B based magnet according to the present disclosure is to be measured by using Inductively Coupled Plasma Optical Emission Spectroscopy (ICP-OES) under an apparatus name: ICPV-1017 (manufactured by Shimadzu Corporation). Moreover, in a cross section perpendicular to the alignment direction, the R amount, the Ga amount, the Cu amount, and the molar ratio [T]/[B] in the magnet surface portion and in the magnet central portion according to the present disclosure are to be measured by using Inductively Coupled Plasma Optical Emission Spectroscopy (ICP-OES) under an apparatus name: ICPE-9000 (manufactured by Shimadzu Corporation).

In the present disclosure, rare-earth elements are collectively referred to as "R". When referring to any specific element or element group among the rare-earth elements R, it may be distinguished from other rare-earth elements by the use of a label such as "R1" or "R2". For example, a rare-earth element contained in an R-T-B based sintered compact may be referred to as "R1" and a rare-earth element contained in an R—Ga—Fe alloy may be referred to as "R2" for distinction. However, an element or element group indicated as "R1" may overlap or coincide with an element or element group indicated as "R2".

Similarly, an element or element group indicated as "T" may be distinguished by the use of a label such as "T1" or "T2". For example, a T (which is at least one selected from the group consisting of Fe, Co, Al, Mn and Si and always includes Fe) that is contained in an R-T-B based sintered compact before diffusion may be referred to as "T1", whereas a T (which is at least one selected from the group consisting of Fe, Co, Al, Mn and Si and always includes Fe) that is contained in a sintered R-T-B based magnet after diffusion may be referred to as "T2".

Note that, in addition to the aforementioned elements, a sintered R-T-B based magnet according to the present disclosure may contain Ag, In, Sn, Zr, Nb, Ti, Ni, Hf, Ta, W, Ge, Mo, V, Y, La, Ce, Sm, Ca, Mg, Cr, H, F, P, S, Cl, O, N, C, or the like.

<First Embodiment of a Method for Producing a Sintered R-T-B Based Magnet>

Figure 2:
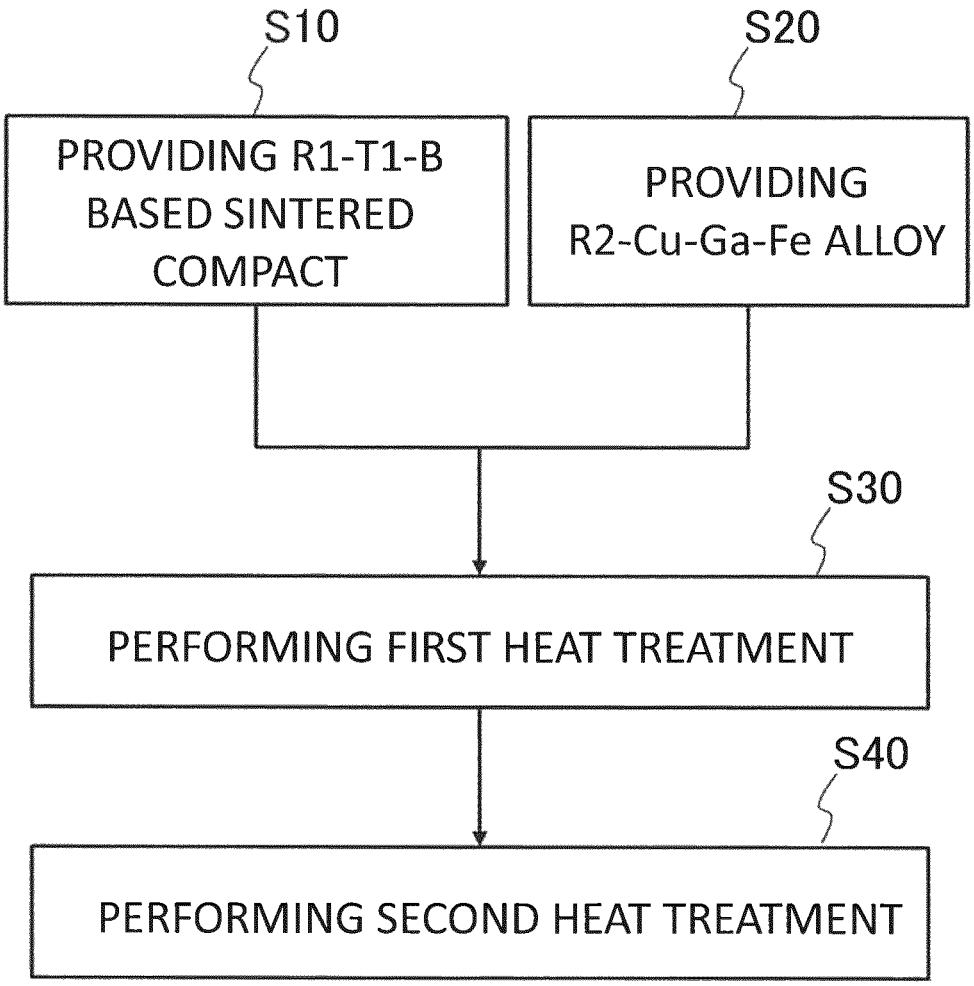
FIG. 2 A flowchart showing steps in a first embodiment of a method for producing a sintered R-T-B based magnet according to the present disclosure.

In a first embodiment, a method for producing a sintered R-T-B based magnet according to the present disclosure includes step S10 of providing an R1-T1-B based sintered compact and step S20 of providing an R2-Cu—Ga—Fe based alloy, as shown in FIG. 2. The order of step S10 of providing an R1-T1-B based sintered compact and step S20 of providing an R2-Cu—Ga—Fe based alloy may be arbitrary, and an R1-T1-B based sintered compact and an R2-Cu—Ga—Fe based alloy which have been produced in different places may be used.

In the present disclosure, any sintered R-T-B based magnet prior to a second heat treatment or during a second heat treatment will be referred to as an R1-T1-B based sintered compact, and any R1-T1-B based sintered compact after the second heat treatment will be simply referred to as a sintered R-T-B based magnet.

In the R1-T1-B based sintered compact, the following (1) to (3) are satisfied.

(1) R1 is at least one rare-earth element which always includes at least one of Nd and Pr, the R1 content accounting for not less than 27 mass % and not more than 35 mass % of the entire R1-T1-B based sintered compact.

(2) T1 is at least one selected from the group consisting of Fe, Co, Al, Mn and Si, where T1 always includes Fe, the Fe content in the entire T1 accounting for 80 mass % or more.

(3) the molar ratio [T1]/[B] is greater than 14.0 but not greater than 16.0.

As used in the present disclosure, a [T1]/[B] is a ratio (a/b) between: a total (a) of the respective value of a result of dividing an analysis value (mass %) of each element (at least one selected from the group consisting of Fe, Co, Al, Mn and Si) composing T1 with the atomic weight of that element; and (b) a result of dividing an analysis value (mass %) of B with the atomic weight of B.

That a molar ratio [T1]/[B] is greater than 14.0 means that B is contained by a ratio which is lower than is defined by the stoichiometric ratio of the $R_2T_{14}B$ compound. Stated otherwise, in the R1-T1-B based sintered compact, there is a relatively small B amount for the T1 amount that is consumed in the main phase ($R_2T_{14}B$ compound) formation.

In the R2-Cu—Ga—Fe based alloy, the following (4) to (7) are satisfied.

(4) R2 is at least one rare-earth element which always includes at least one of Nd and Pr, the R2 content accounting for not less than 35 mass % and not more than 85 mass % of the entire R2-Cu—Ga—Fe based alloy.

(5) the Cu content accounts for not less than 2.5 mass % and not more than 40 mass % of the entire R2-Cu—Ga—Fe based alloy.

(6) the Ga content accounts for not less than 2.5 mass % and not more than 40 mass % of the entire R2-Cu—Ga—Fe based alloy.

(7) the Fe content accounts for not less than 10 mass % and not more than 45 mass % of the entire R2-Cu—Ga—Fe based alloy.

A method for producing a sintered R-T-B based magnet according to the present disclosure involves performing: step S30 of, while keeping an R2-Cu—Ga—Fe based alloy in contact with at least a portion of the surface of an R1-T1-B based sintered compact having a relatively small B amount, in terms of the stoichiometric ratio, for the T amount that is consumed in the main phase ($R_2T_{14}B$ compound) formation, performing a first heat treatment at a temperature of not lower than 700° C. and not higher than 1100° C. in a vacuum or an inert gas ambient, as shown in FIG. 2; and step S40 of subjecting the R1-T1-B based sintered compact having undergone this first heat treatment to a second heat treatment at a temperature of not lower than 450° C. and not higher than 600° C. in a vacuum or an inert gas ambient. This makes it possible to obtain a sintered R-T-B based magnet having high $B_r$ and high $H_{cJ}$.

Any other step, e.g., a cooling step, may be performed between step S30 of performing the first heat treatment and step S40 of performing the second heat treatment.

In a method for producing a sintered R-T-B based magnet according to the present disclosure, an R2-Cu—Ga—Fe based alloy of a specific composition according to the present disclosure is used to introduce R2, Cu, Ga and Fe from the magnet surface into the interior, whereby high $B_r$ and high $H_{cJ}$ can be realized.

(Step of Providing R1-T1-B Based Sintered Compact)

First, regarding the step of providing an R1-T1-B based sintered compact (which may hereinafter be simply referred to as a "sintered compact"), the composition of the sintered compact will be discussed.

R1 is at least one rare-earth element which always includes at least one of Nd and Pr. In order to improve $H_{cJ}$ of the R1-T1-B based sintered compact, a heavy rare-earth element(s) such as Dy, Tb, Gd and Ho, which are of common use, may be contained in small amounts. However, with the production method according to the present disclosure, sufficiently high $H_{cJ}$ can be obtained without using large amounts of heavy rare-earth elements. Therefore, the content of the heavy rare-earth element(s) is preferably 1 mass % or less, and more preferably 0.5 mass % or less, of the R1-T1-B based sintered compact; still more preferably, no heavy rare-earth elements are contained (i.e., substantially 0 mass %).

The R1 content accounts for not less than 27 mass % and not more than 35 mass % of the entire R1-T1-B based sintered compact. If the R1 content is less than 27 mass %, a liquid phase will not sufficiently occur in the sintering process, and it will be difficult for the R1-T1-B based sintered compact to become adequately dense in texture. On the other hand, if the R1 content exceeds 35 mass %, effects of the present disclosure will be obtained, but the alloy powder during the production steps of the R1-T1-B based sintered compact will be very active. Since this may consequently cause considerable oxidization, ignition, etc., of the alloy powder, 35 mass % or less is preferable. More preferably, the R1 content is not less than 27.5 mass % and not more than 33 mass %. Still more preferably, it is not less than 28 mass % and not more than 32 mass %.

T1 is at least one selected from the group consisting of Fe, Co, Al, Mn and Si, where T1 always includes Fe. In other words, T1 may be Fe alone, or consist of at least one of Co, Al, Mn and Si, and Fe. However, the Fe content accounts for 80 mass % or more in the entire T1. If the Fe content is less than 80 mass %, $B_r$ and $H_{cJ}$ may lower. Herein, "the Fe content accounts for 80 mass % or more in the entire T1" means that, in the case where e.g. the T1 content accounts for 70 mass % in the R1-T1-B based sintered compact, 56 mass % or more of the R1-T1-B based sintered compact is Fe. Preferably, the Fe content accounts for 90 mass % or more in the entire T1, as this will provide higher $B_r$ and higher $H_{cJ}$. In the case where Co, Al, Mn and Si are contained, their preferable contents are: Co accounts for 5.0 mass % or less; Al accounts for 1.5 mass % or less; and Mn and Si each account for 0.2 mass % or less, in the entire R1-T1-B based sintered compact.

The molar ratio [T1]/[B] is greater than 14.0 but not greater than 16.0.

As used in the present disclosure, a [T1]/[B] is a ratio (a/b) between: a total (a) of the respective value of a result of dividing an analysis value (mass %) of each element (Fe; or at least one of Co, Al, Mn and Si and Fe) composing T1 with the atomic weight of that element; and (b) a result of dividing an analysis value (mass %) of B with the atomic weight of B.

The condition that the molar ratio [T1]/[B] is greater than 14.0 means that there is a relatively small B amount for the T1 amount that is consumed in the main phase ($R_2T_{14}B$ compound) formation. If the molar ratio [T1]/[B] is 14.0 or smaller, high $H_{cJ}$ may not be obtained. On the other hand, if the molar ratio [T1]/[B] exceeds 16.0, $B_r$ may lower. Preferably, the molar ratio [T1]/[B] is not smaller than 14.3 and not greater than 15.0, as this will provide even higher $B_r$ and higher $H_{cJ}$. Moreover, the B content preferably accounts for not less than 0.8 mass % but less than 1.0 mass % of the entire R1-T1-B based sintered compact.

In addition to the aforementioned elements, the R1-T1-B based sintered compact may contain Ga, Cu, Ag, Zn, In, Sn, Zr, Nb, Ti, Ni, Hf, Ta, W, Ge, Mo, V, Y, La, Ce, Sm, Ca, Mg, Cr, H, F, P, S, Cl, O, N, C, and the like. The preferable contents are: Ni, Ga, Cu, Ag, Zn, In, Sn, Zr, Nb and Ti each account for 0.5 mass % or less; Hf, Ta, W, Ge, Mo, V, Y, La, Ce, Sm, Ca, Mg and Cr each account for 0.2 mass % or less; H, F, P, S and Cl account for 500 ppm or less; 0 accounts for 6000 ppm or less; N accounts for 1000 ppm or less; and C accounts for 1500 ppm or less. A total content of these elements preferably accounts for 5 mass % or less of the entire R1-T1-B based sintered compact. If a total content of these elements exceeds 5 mass % of the entire R1-T1-B based sintered compact, high $B_r$ and high $H_{cJ}$ may not be obtained.

Next, the step of providing an R1-T1-B based sintered compact will be described. The step of providing an R1-T1-B based sintered compact can be achieved by using a generic production method, e.g., a sintered R-T-B based magnet. Preferably, after the raw material alloy is pulverized to a particle size D50 (a central value of volume as obtained through measurement by an airflow-dispersion laser diffraction method=D50) of not less than 3 μm and not more than 10 μm, the R1-T1-B based sintered compact is sintered while being aligned in a magnetic field. As one example, a raw material alloy which is produced by a strip casting method or the like may be pulverized to a particle size D50 of not less than 3 μm and not more than 10 μm by using a jet mill machine or the like, thereafter pressed in a magnetic field, and then sintered at a temperature of not lower than 900° C. and not higher than 1100° C. If the particle size D50 of the raw material alloy is less than 3 μm, it becomes very difficult to produce pulverized powder, thus resulting in a greatly reduced production efficiency, which is not preferable. On the other hand, if the particle size D50 exceeds 10 μm, the R1-T1-B based sintered compact as finally obtained will have too large a crystal grain size to achieve high $H_{cJ}$, which is not preferable. The particle size D50 is preferably not less than 3 μm and not more than 5 μm.

So long as the aforementioned conditions are satisfied, the R1-T1-B based sintered compact may be produced from one kind of raw material alloy (a single raw-material alloy), or through a method of using two or more kinds of raw material alloys and mixing them (two-alloy method). Moreover, the resultant R1-T1-B based sintered compact may be subjected to known machining such as severing or cutting as necessary before undergoing the first heat treatment and the second heat treatment described below.

(Step of Providing R2-Cu—Ga—Fe Based Alloy)

First, regarding the step of providing an R2-Cu—Ga—Fe based alloy, the composition of the R2-Cu—Ga—Fe based alloy will be discussed. Since R, Ga, Cu and Fe are all contained in specific ranges as described below, the R2, Cu, Ga and Fe in the R2-Cu—Ga—Fe based alloy can be introduced into the R1-T1-B based sintered compact in the below-described step of performing the first heat treatment.

R2 is at least one rare-earth element which always includes at least one of Nd and Pr. Preferably, 50 mass % or more of R2 is Pr, as this will provide higher $H_{cJ}$. Herein, that "50 mass % or more of R2 is Pr" means that, in the case where e.g. the R2 content in the R2-Cu—Ga—Fe alloy is 50 mass %, 25 mass % or more of the R2-Cu—Ga—Fe alloy is Pr. Still more preferably, 70 mass % or more of R2 is Pr, and most preferably, R2 is Pr alone (while it may contain inevitable impurities). As a result of this, even higher $H_{cJ}$ can be obtained. As the R2, a heavy rare-earth element(s) such as Dy, Tb, Gd and Ho may be contained in small amounts. However, with the production method according to the present disclosure, sufficiently high $H_{cJ}$ can be obtained without using large amounts of heavy rare-earth elements. Therefore, the content of the heavy rare-earth element(s) is preferably 10 mass % or less (i.e., the heavy rare-earth element(s) in the R2-Cu—Ga—Fe based alloy accounts for 10 mass % or less), and more preferably 5 mass % or less, of the entire R2-Cu—Ga—Fe based alloy; still more preferably, no heavy rare-earth elements are contained (i.e., substantially 0 mass %). In the case where the R2 in the R2-Cu—Ga—Fe based alloy contains a heavy rare-earth element(s), too, preferably 50% or more of R2 is Pr, and it is more preferable that the R2 excluding the heavy rare-earth element(s) is Pr alone (while it may contain inevitable impurities).

The R2 content accounts for not less than 35 mass % and not more than 85 mass % of the entire R2-Cu—Ga—Fe based alloy. If the R2 content is less than 35 mass %, diffusion may possibly not sufficiently progress in the below-described first heat treatment. On the other hand, if the R2 content exceeds 85 mass %, effects of the present disclosure will be obtained, but the alloy powder during the production steps of the R2-Cu—Ga—Fe based alloy will be very active. Since this may consequently cause considerable oxidization, ignition, etc., of the alloy powder, the R2 content is preferably 85 mass % or less of the entire R2-Cu—Ga—Fe based alloy. More preferably, the R2 content is not less than 50 mass % and not more than 85 mass %, and still more preferably it is not less than 60 mass % and not more than 85 mass %, as this will provide higher $H_{cJ}$.

Cu accounts for not less than 2.5 mass % and not more than 40 mass % of the entire R2-Cu—Ga—Fe based alloy. If Cu is less than 2.5 mass %, the Cu, Ga and Fe in the R2-Cu—Ga—Fe based alloy will be less likely to be introduced into the interior of the R1-T1-B based sintered compact in the below-described step of performing the first heat treatment, and high $H_{cJ}$ may not be obtained. On the other hand, if Cu is 40 mass % or more, the abundance ratio of Ga at the grain boundaries will lower, and the generated amount of R-T-Ga phase may be too little to obtain high $H_{cJ}$. More preferably, Cu accounts for not less than 4 mass % and not more than 30 mass %, and still more preferably not less than 4 mass % and not more than 20 mass %, as this will provide higher $B_r$ and higher $H_{cJ}$.

Ga accounts for not less than 2.5 mass % and not more than 40 mass % of the entire R2-Cu—Ga—Fe based alloy. If Ga is less than 2.5 mass %, the Fe in the R2-Cu—Ga—Fe based alloy will be less likely to be introduced into the interior of the R1-T1-B based sintered compact in the below-described step of performing the first heat treatment, and high $B_r$ will not be obtained. Furthermore, the generated amount of R-T-Ga phase will be too little to obtain high $H_{cJ}$. On the other hand, if Ga is 40 mass % or more, $B_r$ may greatly lower. More preferably, Ga accounts for not less than 4 mass % and not more than 30 mass %, and still more preferably not less than 4 mass % and not more than 20 mass %, as this will provide higher $B_r$ and higher $H_{cJ}$.

Fe accounts for not less than 10 mass % and not more than 45 mass % of the entire R2-Cu—Ga—Fe based alloy. Fe must be contained in an amount of 5.8 mass % or more, and preferably 10 mass % or more, of the entire R2-Cu—Ga—Fe alloy. If Fe is 5.8 mass % or less, the amount of Fe introduced will be too little to allow a molar ratio [T]/[B] in the magnet surface portion to be higher than a molar ratio [T]/[B] in the magnet central portion, so that $B_r$ of the finally-obtained sintered R-T-B based magnet cannot be sufficiently enhanced. On the other hand, if Fe is 45 mass % or more, the R amount may be so little that diffusion may not sufficiently progress in the below-described first heat treatment and thus high $B_r$ and high $H_{cJ}$ may not be obtained. Preferably, Fe accounts for not less than 10 mass % and not more than 45 mass %, and more preferably not less than 15 mass % and not more than 40 mass %, as this will provide higher $B_r$ and higher $H_{cJ}$.

In addition to the aforementioned elements, the R2-Cu—Ga—Fe based alloy may contain Co, Al, Ag, Zn, Si, In, Sn, Zr, Nb, Ti, Ni, Hf, Ta, W, Ge, Mo, V, Y, La, Ce, Sm, Ca, Mg, Mn, Cr, H, F, P, S, Cl, O, N, C, and the like.

For improved anticorrosiveness, Co is preferably contained in an amount of not less than 0.5 mass % and not more than 10 mass %. Preferable contents of the other elements are: Al accounts for 1.0 mass % or less; Ag, Zn, Si, In, Sn, Zr, Nb and Ti each account for 0.5 mass % or less; Ni, Hf, Ta, W, Ge, Mo, V, Y, La, Ce, Sm, Ca, Mg, Mn, Si and Cr each account for 0.2 mass % or less; H, F, P, S and Cl account for 500 ppm or less; 0 accounts for 0.2 mass % or less; N accounts for 1000 ppm or less; and C accounts for 1500 ppm or less. However, if a total content of these elements exceeds 20 mass %, the R2, Cu, Ga and Fe contents in the R2-Cu—Ga—Fe based alloy may be too little to obtain high $B_r$ and high $H_{cJ}$. Therefore, a total content of R2, Cu, Ga and Fe in the R2-Cu—Ga—Fe based alloy preferably accounts for 80 mass % or more, and still more preferably 90 mass % or more.

Next, the step of providing an R2-Cu—Ga—Fe based alloy will be described. R2-Cu—Ga—Fe based alloy can be provided by a method of producing a raw material alloy that is adopted in generic production methods for Nd—Fe—B based sintered magnets or the like, e.g., a mold casting method, a strip casting method, a single roll rapid quenching method (a melt spinning method), an atomizing method, or the like. Moreover, the R2-Cu—Ga—Fe based alloy may be what is obtained by pulverizing an alloy obtained as above with a known pulverization means such as a pin mill. Moreover, for improved pulverizability of the alloy as obtained above, before the pulverization, a heat treatment may be performed at 700° C. or below in a hydrogen ambient in order to allow hydrogen to be contained.

(Step of Performing First Heat Treatment)

While at least a portion of the R2-Cu—Ga—Fe based alloy is allowed to be in contact with at least a portion of the surface of the R1-T1-B based sintered compact that has been provided as above, a heat treatment is performed at a temperature of not lower than 700° C. and not higher than 1100° C. in a vacuum or an inert gas ambient. In the present disclosure, this heat treatment is referred to as the first heat treatment. This will allow a liquid phase containing Cu, Ga and Fe to occur from the R2-Cu—Ga—Fe based alloy, and this liquid phase will be introduced from the sintered compact surface into the interior through diffusion, via grain boundaries in the R1-T1-B based sintered compact. If the first heat treatment temperature is below 700° C., the amount of liquid phase containing Cu, Ga and Fe may be too little to obtain high $B_r$ and high $H_{cJ}$. On the other hand, if it is above 1100° C., abnormal grain growth of the main phase may occur to lower $H_{cJ}$. The first heat treatment temperature is preferably not lower than 800° C. and not higher than 1000° C., as this will provide higher $B_r$ and higher $H_{cJ}$. The heat treatment time may be set to an appropriate value depending on the compositions, dimensions, heat treatment temperatures, etc., of the R1-T1-B based sintered compact and the R2-Cu—Ga—Fe based alloy, but it is preferably not less than 5 minutes and not more than 20 hours, more preferably not less than 10 minutes and not more than 15 hours, and still more preferably not less than 30 minutes and not more than 10 hours. Moreover, the R2-Cu—Ga—Fe based alloy is preferably provided in an amount of not less than 2 mass % and not more than 30 mass % with respect to the weight of the R1-T1-B based sintered compact. If the R2-Cu—Ga—Fe based alloy is less than 2 mass % with respect to the weight of the R1-T1-B based sintered compact, $H_{cJ}$ may lower. On the other hand, if it exceeds 30 mass %, $B_r$ may lower.

The first heat treatment can be performed by placing an R2-Cu—Ga—Fe based alloy in any arbitrary shape on the surface of the R1-T1-B based sintered compact, and using a known heat treatment apparatus. For example, the surface of the R1-T1-B based sintered compact may be covered by a powder layer of the R2-Cu—Ga—Fe based alloy, and the first heat treatment may be performed. For example, after a slurry obtained by dispersing the R2-Cu—Ga—Fe based alloy in a dispersion medium is applied on the surface of the R1-T1-B based sintered compact, the dispersion medium may be evaporated, thus allowing the R2-Cu—Ga—Fe based alloy and the R1-T1-B based sintered compact to be in contact. As will be indicated in below-described Experimental Examples, the R2-Cu—Ga—Fe based alloy is preferably placed so as to be in contact with at least a surface of the R1-T1-B based sintered compact that is perpendicular to the alignment direction. Regardless of whether the R2-Cu—Ga—Fe alloy is in contact in the alignment direction of the R1-T1-B based sintered compact alone or the R2-Cu—Ga—Fe based alloy is in contact with the entire surface of the R1-T1-B based sintered compact, characteristic features of the present disclosure can be provided, and high $B_r$ and high $H_{cJ}$ can be attained. Examples of the dispersion medium may be alcohols (ethanol, etc.), NMP (N-methylpyrrolidone), aldehydes, and ketones. Moreover, the R1-T1-B based sintered compact having undergone the first heat treatment may be subjected to known machining such as severing or cutting.

(Step of Performing Second Heat Treatment)

The R1-T1-B based sintered compact having undergone the first heat treatment is subjected to a heat treatment at a temperature which is not lower than 450° C. and not higher than 600° C. in a vacuum or an inert gas ambient. In the present disclosure, this heat treatment is referred to as the second heat treatment. By performing the second heat treatment, high $B_r$ and high $H_{cJ}$ can be obtained. If the temperature of the second heat treatment is below 450° C. or above 600° C., the generated amount of R-T-Ga phase (which typically is an $R_6T_{13}Z$ phase (where Z is at least one of Cu and Ga)) may be too little to obtain high $B_r$ and high $H_{cJ}$. The second heat treatment temperature is preferably not lower than 480° C. and not higher than 560° C. This will provide higher $H_{cJ}$. The heat treatment time may be set to an appropriate value depending on the composition, dimensions, heat treatment temperature, etc., of the R1-T1-B based sintered compact, but it is preferably not less than 5 minutes and not more than 20 hours, more preferably, not less than 10 minutes and not more than 15 hours, and still more preferably not less than 30 minutes and not more than 10 hours.

In the aforementioned $R_6T_{13}Z$ phase ($R_6T_{13}Z$ compound), R is at least one rare-earth element which always includes at least one of Pr and Nd, and T is at least one transition metal element which always includes Fe. A representative $R_6T_{13}Z$ compound is an $Nd_6Fe_{13}Ga$ compound. Moreover, the $R_6T_{13}Z$ compound has an $La_6Co_{11}Ga_3$ type crystal structure. Depending on its state, the $R_6T_{13}Z$ compound may have taken the form of an $R_6T_{13-}\delta Z_{1+}\delta$ compound. If Cu, Al and Si are contained relatively profusely in the sintered R-T-B based magnet, it may have taken the form of $R_6T_{13-}\delta\ (Ga_{1-a-b-c}Cu_aAl_bSi_c)_{1+}\delta$.

A sintered R-T-B based magnet which is obtained through the step of performing the second heat treatment may be subjected to known surface treatments, e.g., known machining such as severing or cutting, or plating to confer anticorrosiveness.

<Second Embodiment of a Method for Producing a Sintered R-T-B Based Magnet>

In the first embodiment, in order to introduce R, Ga and Fe elements from the sintered compact surface into the interior, the first heat treatment is performed while an R1-T1-B based sintered compact having a low B amount and an R2-Cu—Ga—Fe based alloy are kept in contact. However, the method of producing a sintered R-T-B based magnet according to the present disclosure is not limited to that of the first embodiment.

First, instead of an R2-Cu—Ga—Fe based alloy, an R2-Ga—Fe based alloy that contains no Cu may be used. In the case of using an R2-Ga—Fe based alloy, however, the R1-T1-B based sintered compact before diffusion needs to contain Cu. An R1-T1-B based sintered compact that contains Cu before diffusion may be referred to as an "R1-T1-Cu—B based sintered compact".

Figure 3:
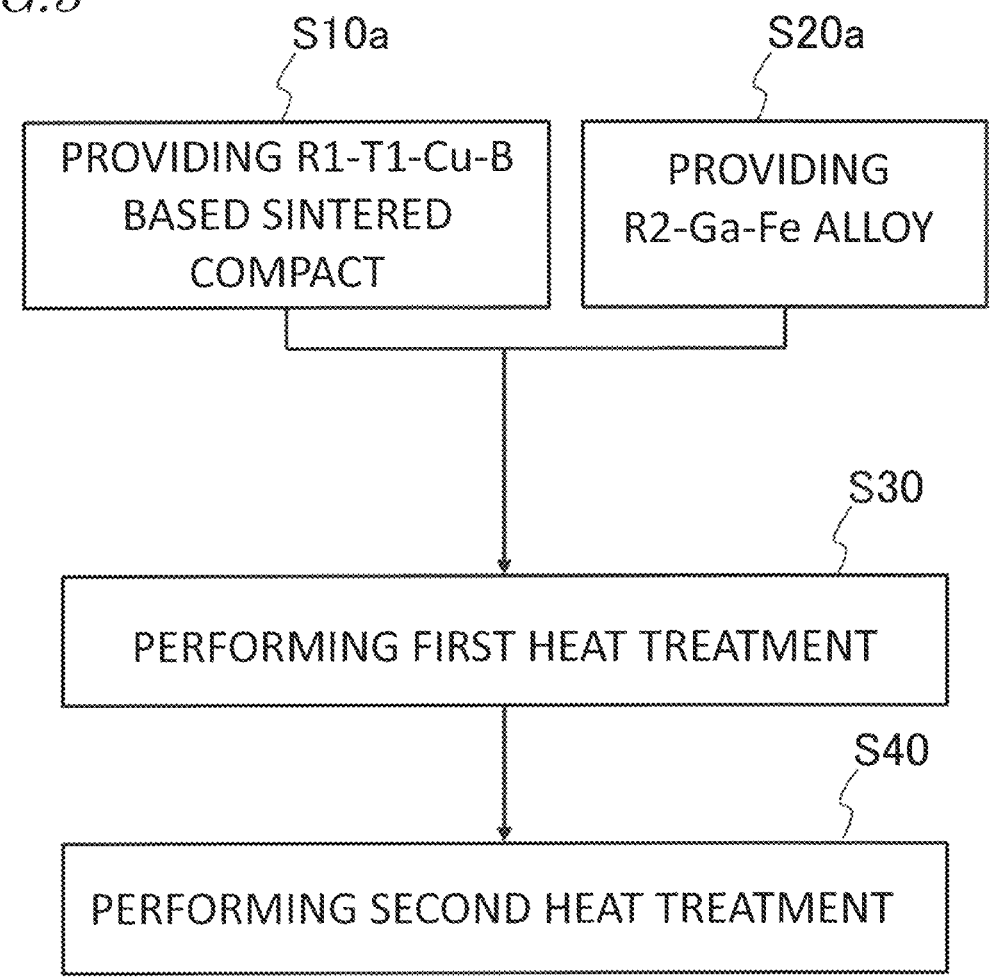
FIG. 3 A flowchart showing steps in a second embodiment of a method for producing a sintered R-T-B based magnet according to the present disclosure.

As shown in FIG. 3, a method for producing a sintered R-T-B based magnet according to the present embodiment includes step S10*a* of providing an R1-T1-Cu—B based sintered compact and step S20*a* of providing an R2-Ga—Fe based alloy. The order of step S10*a* of providing an R1-T1-Cu—B based sintered compact and step S20*a* of providing an R2-Ga—Fe based alloy may be arbitrary, and an R1-T1-Cu—B based sintered compact and an R2-Ga—Fe based alloy which have been produced in different places may be used. This production method involves performing: step S30 of, while keeping an R2-Ga—Fe based alloy in contact with at least a portion of the surface of an R1-T1-Cu—B based sintered compact having a relatively small B amount, in terms of the stoichiometric ratio, for the T amount that is consumed in the main phase ($R_2T_{14}B$ compound) formation, and performing a first heat treatment at a temperature of not lower than 700° C. and not higher than 1100° C. in a vacuum or an inert gas ambient, as shown in FIG. 3; and step S40 of subjecting the R1-T1-Cu—B based sintered compact having undergone this first heat treatment to a second heat treatment at a temperature of not lower than 450° C. and not higher than 600° C. in a vacuum or an inert gas ambient. This makes it possible to obtain a sintered R-T-B based magnet having high $B_r$ and high $H_{cJ}$. Similarly to the first embodiment, any other step, e.g., a cooling step, may be performed between step S30 of performing the first heat treatment and step S40 of performing the second heat treatment.

Except for containing Cu, the R1-T1-Cu—B based sintered compact in step S10*a* of FIG. 3 is identical to the R1-T1-B based sintered compact in step S10 of FIG. 2. The Cu content in the R1-T1-Cu—B based sintered compact accounts for not less than 0.1 mass % and not more than 1.0 mass % of the entire R1-T1-Cu—B based sintered compact. If Cu is less than 0.1 mass %, diffusion will not sufficiently progress in the first heat treatment, and high $H_{cJ}$ may not be obtained. On the other hand, if Cu exceeds 1.0 mass %, $B_r$ may lower. Except for not containing any Cu, the R2-Ga—Fe based alloy in step S20*a* of FIG. 3 is identical to the R2-Cu—Ga—Fe based alloy in step S20 of FIG. 2.

Preferably, Fe being contained in the R2-Ga—Fe based alloy accounts for not less than 10 mass % and not more than 45 mass % of the entire R2-Ga—Fe based alloy. More preferably, Fe accounts for not less than 15 mass % and not more than 40 mass %, as this will provide higher $B_r$ and higher $H_{cJ}$. Note that the R2-Ga—Fe based alloy is preferably prescribed so that a total of R2, Ga and Fe accounts for 100 mass %.

EXAMPLES

The present disclosure will be described in more detail by way of Examples; however, the present disclosure is not limited thereto.

Experimental Example 1

[Step of Providing R1-T1-B Based Sintered Compact]

Respective elements were weighed so that the R1-T1-B based sintered compact would approximately result in a composition indicated in Table 1, and through casting by a strip casting method, a raw material alloy in flake form having a thickness of 0.2 to 0.4 mm was obtained. After the resultant raw material alloy in flake form was hydrogen-pulverized, it was subjected to a dehydrogenation treatment of heating to 550° C. in a vacuum and then cooling, whereby a coarse-pulverized powder was obtained. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. Note that the particle size $D_{50}$ is a central value of volume (volume median particle diameter) as obtained by a laser diffraction method by airflow dispersion technique.

To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction.

In a vacuum, the resultant compact was sintered for 4 hours at not lower than 1000° C. and not higher than 1050° C. (for each sample, a temperature was selected at which a sufficiently dense texture would result through sintering) and thereafter rapidly cooled, whereby an R1-T1-B based sintered compact was obtained. The resultant sintered compact had a density of 7.5 $Mg/m^3$ or more. A component analysis of the resultant sintered compact is shown in Table 1. The respective components in Table 1 were measured by using Inductively Coupled Plasma Optical Emission Spectroscopy (ICP-OES) (apparatus name: ICPV-1017 (manufactured by Shimadzu Corporation)). The oxygen amount in the sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %. Note that the composition, the oxygen amount, and the carbon amount in Table 1 do not total to 100 mass %. This is because the method of analysis differs for each component. The same also applies to any other tables.

TABLE 1

| | composition of R1-T1-B based sintered compact (mass %) | | | | | | |
|---|---|---|---|---|---|---|---|
| | R1 | | T1 | | | | |
| Label | Nd | Pr | Fe | Al | Si | Mn | B |
| 1-A | 28.3 | 0.1 | 69.6 | 0.05 | 0.05 | 0.03 | 0.93 |

[Step of Providing R2-Cu—Ga—Fe Based Alloy]

Respective elements were weighed so that the R2-Cu—Ga—Fe based alloy would approximately result in the compositions indicated in Table 2, and these raw materials were melted; thus, by a single roll rapid quenching method (melt spinning method), alloys in ribbon or flake form were obtained. Using a mortar, the resultant alloy was pulverized in an argon ambient, and thereafter was passed through a sieve with an opening of 425 μm, thereby providing an R2-Cu—Ga—Fe based alloy. The composition of the resultant R2-Cu—Ga—Fe based alloy is shown in Table 2. As Comparative Example, an R2-Cu—Ga based alloy (1-a) not containing Fe was also provided. The compositions of the resultant R2-Cu—Ga based alloys are shown in Table 2. The respective components in Table 2 were measured by using Inductively Coupled Plasma Optical Emission Spectroscopy (ICP-OES) (apparatus name: ICPE-9000 (manufactured by Shimadzu Corporation)).

TABLE 2

| | composition of R2-Cu—Ga—Fe based alloy (mass %) | | | |
|---|---|---|---|---|
| Label | Pr | Ga | Cu | Fe |
| 1-a | 86.0 | 8.2 | 5.1 | 0.0 |
| 1-b | 74.9 | 8.6 | 4.4 | 10.1 |
| 1-c | 65.4 | 6.4 | 3.9 | 22.3 |
| 1-d | 58.8 | 5.9 | 3.4 | 30.9 |
| 1-e | 51.3 | 5.0 | 3.0 | 40.1 |

[Step of Performing First Heat Treatment]

Figure 4:
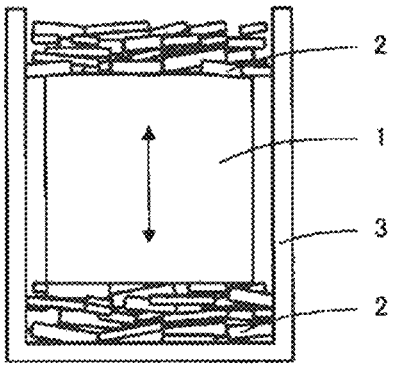
FIG. 4 An explanatory diagram schematically showing how an R1-T1-B based sintered alloy compact and an R2-Cu—Ga—Fe based alloy may be placed during a heat treatment step.

The R1-T1-B based sintered compact of Table 1 was severed and cut into a 4.4 mm×10.0 mm×11.0 mm rectangular solid (where a 10.0 mm×11.0 mm face defined a cross section perpendicular to the alignment direction). Next, as shown in FIG. 4, in a processing container 3 made of niobium foils, each R2-Cu—Ga—Fe based alloy or R2-Cu—Ga based alloy shown in Table 2 was placed above and below the R1-T1-B based sintered compact of Table 1 in an amount of 10 mass % each, thus totaling 20 mass %, with respect to the weight of the R1-T1-B based sintered compact, in such a manner that mainly its surface perpendicular to the alignment direction of the R1-T1-B based sintered compact 1 (i.e., the direction indicated by arrows in the figure) was in contact with the R2-Cu—Ga—Fe based alloy 2. Next, in argon which was controlled to a reduced pressure of 200 Pa, by using a tubular flow furnace, the first heat treatment was effected by heating the R2-Cu—Ga—Fe based alloy and R1-T1-B based sintered compact or the R2-Cu—Ga based alloy and R1-T1-B based sintered compact based on the temperature and time indicated for the first heat treatment in Table 3, followed by cooling.

[Step of Performing Second Heat Treatment]

In argon which was controlled to a reduced pressure of 200 Pa, by using a tubular flow furnace, the R1-T1-B based sintered compact having undergone the first heat treatment was subjected to the second heat treatment based on the temperature and time indicated for the second heat treatment in Table 3, followed by cooling. In order to remove any thickened portion in the R2-Cu—Ga—Fe based alloy or the R2-Cu—Ga based alloy existing in the surface vicinity of each sample after the heat treatment, a surface grinder was used to cut on the entire surface of each sample, whereby samples respectively in the form of a 4.0 mm×4.0 mm×4.0 mm cube (sintered R-T-B based magnet) were obtained. Note that the heating temperature for the R2-Cu—Ga—Fe alloy or R2-Cu—Ga based alloy and the R1-T1-B based sintered compact in the step of performing the first heat treatment and the heating temperature for the R1-T1-B based sintered compact in the step of performing the second heat treatment were each measured by attaching a thermocouple.

[Sample Evaluations]

Figure 5:
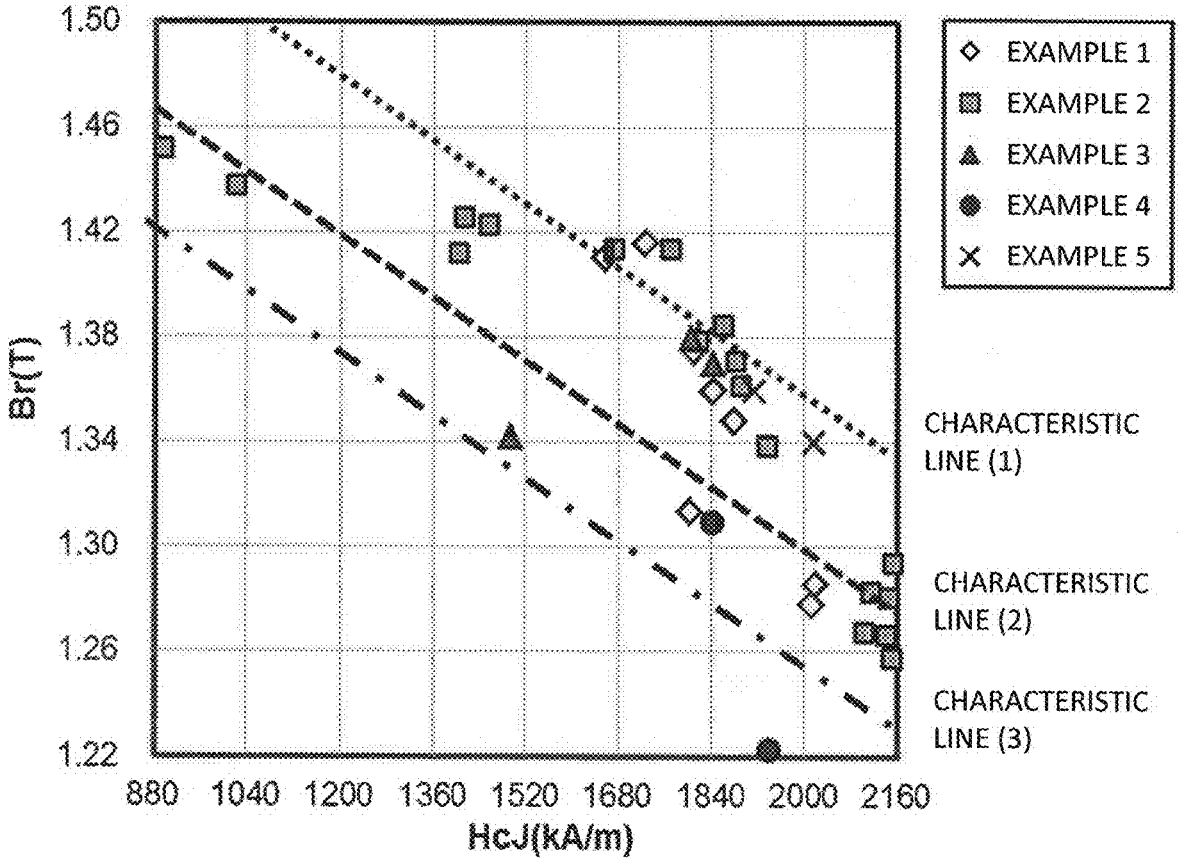
FIG. 5 A magnetic characteristics map in which $B_r$ is taken on the vertical axis and $H_{cJ}$ is taken on the horizontal axis.

With respect to the resultant samples, $B_r$ and $H_{cJ}$ of each sample were measured by using a B—H tracer. Results of measurement are shown in Table 3. In FIG. 5, results of plotting a magnetic characteristics map, with $B_r$ taken on the vertical axis and $H_{cJ}$ taken on the horizontal axis, are shown (lozenge plotted points in FIG. 5). Note that it is most commonplace for a sintered R-T-B based magnet to be used with its characteristics altered by e.g. adding Dy to the raw material alloy in order to improve its $H_{cJ}$ while lowering its $B_r$; therefore, the common practice is to define any magnets that are on the same line, i.e., the gradient (about −0.00015 (T)/(kA/m)) of a characteristic change occurring with addition of Dy, as being on a comparable grade, and evaluate any magnet that is of higher $B_r$ or higher $H_{cJ}$ than that as being on a higher grade. When this line is expressed as a linear function, its segment is mainly determined by whether or not a decrease in $B_r$ is being suppressed by diffusing a heavy rare-earth element, and by the R amount adjustments associated with whether the oxygen amount in the magnet is low (i.e., about 0.1 to 0.3 mass %) or high (i.e., about 0.4 to 0.7 mass %). Therefore, as the gradient of a characteristic change occurring with addition of Dy, the following are indicated in FIG. 5: characteristic line (1) of a magnet with a low oxygen amount (i.e., about 0.1 to 0.3 mass %), having a heavy rare-earth (mainly Dy) diffused thereto ($B_r$=−0.00015$H_{cJ}$+1.66); characteristic line (2) of a magnet with a low oxygen amount (i.e., about 0.1 to 0.3 mass %) (i.e., a magnet having no heavy rare-earth diffused thereto) ($B_r$=−0.00015$H_{cJ}$+1.60); and characteristic line (3) a magnet with a high oxygen amount (i.e., about 0.4 to 0.7 mass %) (i.e., a magnet having no heavy rare-earth element diffused thereto) ($B_r$=−0.00015$H_{cJ}$+1.56). Then, magnetic characteristics were evaluated from relative positioning with respect to these lines. Results of evaluation (◎: on or above characteristic line (1); ○: on or above characteristic line (2) but below characteristic line (1); x: below characteristic line (2)) are shown in Table 3.

In the following, magnetic characteristics were evaluated by a similar method. As shown in Table 3 and in FIG. 5, sintered R-T-B based magnets which were produced by using an R2-Cu—Ga based alloy (sample Nos. 1-1 to 1-3) all attained magnetic characteristics that were below characteristic line (2) (i.e., lozenge plotted points in FIG. 5 located below characteristic line (2) in FIG. 5). On the other hand, sintered R-T-B based magnets which were produced by using an R2-Cu—Ga—Fe alloy (sample Nos. 1-4 to 1-9) attained characteristics that were on or above characteristic line (2), with some samples even exhibiting characteristics that were on or above characteristic line (1) (i.e., lozenge plotted points in FIG. 5 that are located above characteristic line (2)).

Moreover, results of analyzing the components of each entire sample in a 4.0 mm×4.0 mm×4.0 mm cube form by Inductively Coupled Plasma Optical Emission Spectroscopy (ICP-OES) (apparatus name: ICPV-1017 (manufactured by Shimadzu Corporation)) are shown in Table 4. Furthermore, results of cutting out samples in a 1.0 mm×1.0 mm×1.0 mm cube form, from a magnet surface portion at a cross section perpendicular to the alignment direction and from the magnet central portion of the sample in a 4.0 mm×4.0 mm×4.0 mm cube form, and analyzing their components by Inductively Coupled Plasma Optical Emission Spectroscopy (ICP-OES) (apparatus name: ICPE-9000 (manufactured by Shimadzu Corporation)) are shown in Table 4. The positions of cutting were the positions shown in FIG. 6D (i.e., a magnet surface portion sample 31 and a magnet central portion sample 41). Note that, with respect to any given sample in Table 4, samples in the 1.0 mm×1.0 mm×1.0 mm cube form which were cut out from the surface portion and from the central portion have relatively high values for the R amount, the Ga amount, the Cu amount, etc., and a relatively low value for the B amount, as compared to the components of the entire sample in the 4.0 mm×4.0 mm×4.0 mm cube form; this is due to the fact that different models (ICPV-1017 or ICPE-9000) of Inductively Coupled Plasma Optical Emission Spectroscopy (ICP-OES) were used in view of measuring constraints such as differing compositions and weights of the samples, and due to the different detection methods employed by these detectors. The same is also true of any measurement results below. As shown in Table 4, in sintered R-T-B based magnets which were produced by using an R2-Cu—Ga based alloy (sample Nos. 1-1 to 1-3), a molar ratio [T]/[B] in the magnet surface portion and a molar ratio [T]/[B] in the magnet central portion were comparable. On the other hand, in sintered R-T-B based magnets which were produced by using an R2-Cu—Ga—Fe alloy (sample Nos. 1-4 to 1-9), an R amount in the magnet surface portion was greater than an R amount in the magnet central portion, and a Ga amount in the magnet surface portion was greater than a Ga amount in the magnet central portion. Moreover, a molar ratio [T]/[B] in the magnet surface portion was higher than a molar ratio [T]/[B] in the magnet central portion. Moreover, a Cu amount in the magnet surface portion was also greater than a Cu amount in the magnet central portion.

TABLE 3

| | producing conditions | | | | | | | |
|---|---|---|---|---|---|---|---|---|
| sample No. | R1-T1-B based sintered compact Label | R2-Cu—Ga—Fe based alloy Label | first heat treatment | second heat treatment | Br (T) | HcJ (kA/m) | characteristic line determination | Notes |
| 1-1 | 1-A | 1-a | 800° C. × 8 h | 520° C. × 0.5 h | 1.31 | 1802 | X | Comp. |
| 1-2 | 1-A | 1-a | 800° C. × 8 h | 520° C. × 2 h | 1.29 | 2019 | X | Comp. |
| 1-3 | 1-A | 1-a | 800° C. × 8 h | 520° C. × 4 h | 1.28 | 2011 | X | Comp. |
| 1-4 | 1-A | 1-b | 800° C. × 8 h | 520° C. × 2 h | 1.35 | 1879 | ○ | Inv. |
| 1-5 | 1-A | 1-c | 800° C. × 8 h | 520° C. × 0.5 h | 1.42 | 1725 | ◎ | Inv. |
| 1-6 | 1-A | 1-c | 800° C. × 8 h | 520° C. × 2 h | 1.38 | 1817 | ○ | Inv. |
| 1-7 | 1-A | 1-c | 800° C. × 8 h | 520° C. × 4 h | 1.36 | 1843 | ○ | Inv. |
| 1-8 | 1-A | 1-d | 800° C. × 8 h | 520° C. × 2 h | 1.38 | 1809 | ○ | Inv. |
| 1-9 | 1-A | 1-e | 800° C. × 8 h | 520° C. × 2 h | 1.41 | 1657 | ○ | Inv. |

TABLE 4

| sample No. | | composition of sintered R-T-B based magnet (mass %) R Nd | Pr | T Fe | Al | Si | Mn | Ga | Cu | B | [T]/[B] | Notes |
|---|---|---|---|---|---|---|---|---|---|---|---|---|
| 1-1 | entire sample | 25.0 | 8.3 | 62.9 | 0.03 | 0.04 | 0.03 | 0.88 | 0.61 | 0.84 | 14.5 | Comp. |
| | magnet surface portion 1 mm per side | 25.2 | 9.7 | 61.9 | 0.03 | 0.04 | 0.03 | 1.10 | 0.73 | 0.81 | 14.9 | |
| | magnet central portion 1 mm per side | 25.4 | 8.4 | 62.6 | 0.03 | 0.04 | 0.03 | 0.93 | 0.64 | 0.82 | 14.9 | |
| 1-2 | entire sample | 25.7 | 8.1 | 62.8 | 0.03 | 0.02 | 0.03 | 0.76 | 0.59 | 0.85 | 14.4 | Comp. |
| | magnet surface portion 1 mm per side | 25.7 | 10.1 | 59.3 | 0.02 | 0.05 | 0.03 | 0.99 | 0.69 | 0.77 | 14.9 | |
| | magnet central portion 1 mm per side | 26.7 | 8.2 | 61.3 | 0.01 | 0.05 | 0.03 | 0.81 | 0.62 | 0.80 | 14.9 | |
| 1-3 | entire sample | 24.7 | 10.5 | 60.8 | 0.02 | 0.04 | 0.03 | 0.90 | 0.72 | 0.81 | 14.6 | Comp. |
| | magnet surface portion 1 mm per side | 24.3 | 12.5 | 59.6 | 0.02 | 0.05 | 0.03 | 1.13 | 0.81 | 0.77 | 15.0 | |
| | magnet central portion 1 mm per side | 25.5 | 10.5 | 60.4 | 0.03 | 0.04 | 0.03 | 0.92 | 0.72 | 0.78 | 15.0 | |
| 1-4 | entire sample | 26.5 | 5.3 | 65.2 | 0.03 | 0.03 | 0.03 | 0.54 | 0.45 | 0.88 | 14.3 | Inv. |
| | magnet surface portion 1 mm per side | 25.2 | 7.8 | 63.8 | 0.02 | 0.04 | 0.03 | 0.72 | 0.59 | 0.84 | 14.7 | |
| | magnet central portion 1 mm per side | 26.4 | 6.3 | 63.7 | 0.02 | 0.05 | 0.03 | 0.61 | 0.58 | 0.85 | 14.5 | |
| 1-5 | entire sample | 27.1 | 2.9 | 67.3 | 0.04 | 0.04 | 0.03 | 0.28 | 0.27 | 0.90 | 14.5 | Inv. |
| | magnet surface portion 1 mm per side | 27.5 | 3.7 | 66.0 | 0.03 | 0.04 | 0.03 | 0.38 | 0.35 | 0.86 | 14.9 | |
| | magnet central portion 1 mm per side | 28.6 | 2.4 | 66.7 | 0.03 | 0.05 | 0.03 | 0.24 | 0.24 | 0.88 | 14.7 | |
| 1-6 | entire sample | 26.4 | 4.9 | 65.7 | 0.04 | 0.03 | 0.03 | 0.46 | 0.47 | 0.88 | 14.5 | Inv. |
| | magnet surface portion 1 mm per side | 26.6 | 5.6 | 64.6 | 0.03 | 0.05 | 0.03 | 0.57 | 0.53 | 0.84 | 14.9 | |
| | magnet central portion 1 mm per side | 27.9 | 4.1 | 65.5 | 0.02 | 0.05 | 0.03 | 0.43 | 0.45 | 0.87 | 14.6 | |
| 1-7 | entire sample | 25.1 | 7.6 | 64.2 | 0.03 | 0.04 | 0.03 | 0.71 | 0.59 | 0.83 | 15.0 | Inv. |
| | magnet surface portion 1 mm per side | 25.6 | 8.7 | 62.5 | 0.03 | 0.04 | 0.03 | 0.76 | 0.60 | 0.78 | 15.6 | |
| | magnet central portion 1 mm per side | 25.9 | 7.1 | 64.5 | 0.03 | 0.04 | 0.03 | 0.65 | 0.57 | 0.82 | 15.3 | |
| 1-8 | entire sample | 26.8 | 3.8 | 66.6 | 0.04 | 0.03 | 0.03 | 0.37 | 0.38 | 0.90 | 14.4 | Inv. |
| | magnet surface portion 1 mm per side | 26.8 | 4.5 | 65.5 | 0.02 | 0.04 | 0.03 | 0.48 | 0.44 | 0.85 | 15.0 | |
| | magnet central portion 1 mm per side | 27.8 | 3.1 | 66.0 | 0.02 | 0.05 | 0.03 | 0.39 | 0.38 | 0.88 | 14.6 | |
| 1-9 | entire sample | 26.8 | 3.2 | 67.1 | 0.04 | 0.03 | 0.03 | 0.32 | 0.37 | 0.90 | 14.5 | Inv. |
| | magnet surface portion 1 mm per side | 27.1 | 4.2 | 66.3 | 0.03 | 0.05 | 0.03 | 0.44 | 0.48 | 0.86 | 15.0 | |
| | magnet central portion 1 mm per side | 27.6 | 3.4 | 66.5 | 0.02 | 0.05 | 0.03 | 0.35 | 0.42 | 0.89 | 14.6 | |

Experimental Example 2

[Step of Providing R1-T1-B Based Sintered Compact]

Sintered compacts were produced by the same method as in Experimental Example 1, except for weighing respective elements so that the sintered compacts would approximately result in the compositions in Table 5. Each resultant sintered compact had a density of 7.5 $Mg/m^3$ or more. A component analysis of each resultant sintered compact is shown in Table 5. The respective components in Table 5 were measured by using Inductively Coupled Plasma Optical Emission Spectroscopy (ICP-OES) (apparatus name: ICPV-1017 (manufactured by Shimadzu Corporation)). The oxygen amount in each sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 5

| Label | composition of R1-T1-B based sintered compact (mass %) R1 Nd | Pr | T1 Fe | Al | Si | Mn | B |
|---|---|---|---|---|---|---|---|
| 2-A | 27.4 | 0.1 | 70.6 | 0.03 | 0.04 | 0.03 | 0.92 |
| 2-B | 27.4 | 0.1 | 70.5 | 0.03 | 0.04 | 0.03 | 0.95 |
| 2-C | 27.3 | 0.1 | 70.5 | 0.04 | 0.04 | 0.03 | 1.01 |
| 2-D | 28.3 | 0.1 | 69.6 | 0.05 | 0.05 | 0.03 | 0.93 |
| 2-E | 29.1 | 0.1 | 68.7 | 0.05 | 0.04 | 0.03 | 0.93 |
| 2-F | 30.6 | 0.1 | 67.5 | 0.03 | 0.04 | 0.03 | 0.79 |
| 2-G | 30.7 | 0.1 | 67.3 | 0.03 | 0.04 | 0.04 | 0.81 |
| 2-H | 30.7 | 0.1 | 67.6 | 0.03 | 0.05 | 0.04 | 0.91 |
| 2-I | 32.1 | 0.2 | 65.4 | 0.03 | 0.05 | 0.04 | 0.88 |

[Step of Providing R2-Cu—Ga—Fe Based Alloy]

R2-Cu—Ga—Fe based alloys were provided by the same method as in Experimental Example 1, except for weighing respective elements so that the R2-Cu—Ga—Fe based alloys would approximately result in the compositions indicated in Table 6. The compositions of the R2-Cu—Ga—Fe based alloys, as measured by using Inductively Coupled Plasma Optical Emission Spectroscopy (ICP-OES) (apparatus name: ICPE-9000 (manufactured by Shimadzu Corporation)), are shown in Table 6.

TABLE 6

| Label | composition of R2-Cu—Ga—Fe based alloy (mass %) | | | |
|---|---|---|---|---|
| | Pr | Ga | Cu | Fe |
| 2-a | 82.0 | 7.8 | 4.8 | 4.6 |
| 2-b | 80.5 | 7.4 | 4.5 | 5.8 |
| 2-c | 77.5 | 6.3 | 5.9 | 10.0 |
| 2-d | 65.4 | 6.4 | 3.9 | 22.3 |
| 2-e | 51.3 | 5.0 | 3.0 | 40.1 |
| 2-f | 51.1 | 4.2 | 3.8 | 40.4 |

[Step of Performing First Heat Treatment]

Except for heating the R2-Cu—Ga—Fe alloy and the R1-T1-B based sintered compact based on the temperatures and time indicated for the first heat treatment in Table 7, the first heat treatment was performed by the same method as in Experimental Example 1.

[Step of Performing Second Heat Treatment]

Except for heating the R2-Cu—Ga—Fe alloy and the R1-T1-B based sintered compact based on the temperatures and times indicated for the second heat treatment in Table 7, the second heat treatment was performed by the same method as in Experimental Example 1. Each sample after the heat treatment was processed by the same method as in Experimental Example 1, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 7. In FIG. 5, results of plotting a magnetic characteristics map, with $B_r$ taken on the vertical axis and $H_{cJ}$ taken on the horizontal axis, are shown (square plotted points in FIG. 5).

Moreover, results of analyzing the components of each entire sample in a 4.0 mm×4.0 mm×4.0 mm cube form by Inductively Coupled Plasma Optical Emission Spectroscopy (ICP-OES) (apparatus name: ICPV-1017 (manufactured by Shimadzu Corporation)) are shown in Table 8. Furthermore, using a method similar to that of Example 1, results of cutting out samples in a 1.0 mm×1.0 mm×1.0 mm cube form, from a magnet surface portion at a cross section perpendicular to the alignment direction and from the magnet central portion of the sample in a 4.0 mm×4.0 mm×4.0 mm cube form, and analyzing their components by Inductively Coupled Plasma Optical Emission Spectroscopy (ICP-OES) (apparatus name: ICPE-9000 (manufactured by Shimadzu Corporation)) are shown in Table 8.

As shown in Table 7, Table 8, and FIG. 5, characteristics that were on or above characteristic line (2) were attained by samples (sample Nos. 2-1, 2-3, 2-4, 2-6, 2-8 to 2-14, 2-16, 2-17) in which the R amount was not less than 28 mass % and not more than 36 mass %, the B amount was not less than 0.73 mass % and not more than 0.96 mass %, the Ga amount was not less than 0.1 mass % and not more than 1.0 mass %, the Cu amount was not less than 0.1 mass % and not more than 1.0 mass %, the T amount was not less than 60 mass %, and the molar ratio [T]/[B] was greater than 14.0, with some samples even exhibiting characteristics that were on or above characteristic line (1). On the other hand, characteristics below characteristic line (2) were exhibited by samples in which the R amount was not in the range from 28 mass % to 36 mass % (sample No. 2-2, 2-5, 2-18), samples in which the B amount was not in the range from 0.73 mass % to 0.96 mass % (sample No. 2-7, 2-15), samples in which the Ga amount was not in the range from 0.1 mass % to 1.0 mass % (sample No. 2-2, 2-5), samples in which the Cu amount was not in the range from 0.1 mass % to 1.0 mass % (sample No. 2-2, 2-5), a sample in which the T amount was less than 60 mass % (sample No. 2-5), and a sample in which the molar ratio [T]/[B] was 14.0 or smaller (sample No. 2-7). Moreover, as Table 8 indicates, in sintered R-T-B based magnets according to the present disclosure (sample Nos. 2-1, 2-3, 2-4, 2-6, 2-8 to 2-14, 2-16, 2-17), an R amount in the magnet surface portion was greater than an R amount in the magnet central portion, and a Ga amount in the magnet surface portion was greater than a Ga amount in the magnet central portion. Moreover, a molar ratio [T]/[B] in the magnet surface portion was higher than a molar ratio [T]/[B] in the magnet central portion. Moreover, as is clear from sample Nos. 2-15 to 2-18, when an R—Cu—Ga—Fe alloy in which the Fe content was 4.6 mass % (about 10 mol %) was used (Label 2-a), a molar ratio [T]/[B] in the magnet surface portion and a molar ratio [T]/[B] in the magnet central portion in the resultant sintered R-T-B based magnet were equal (sample Nos. 2-15 and 2-18), such that high $B_r$ and high $H_{cJ}$ were not obtained. On the other hand, when an R—Cu—Ga—Fe alloy in which the Fe content was 5.8 mass % (about 12 mol %) was used (Label 2-b), a molar ratio [T]/[B] in the magnet surface portion was higher than a molar ratio [T]/[B] in the magnet central portion in the resultant sintered R-T-B based magnets (sample Nos. 2-16 and 2-17), and thus high $B_r$ and high $H_{cJ}$ were obtained. Therefore, the Fe amount in the R—Ga—Cu—Fe alloy needs to be 5.8 mass % or more.

TABLE 7

| sample No. | producing conditions | | | | Br (T) | HcJ (kA/m) | characteristic line determination | Notes |
|---|---|---|---|---|---|---|---|---|
| | R1-T1-B based sintered compact Label | R2-Cu—Ga—Fe based alloy Label | first heat treatment | second heat treatment | | | | |
| 2-1 | 2-A | 2-f | 800° C. × 8 h | 520° C. × 2 h | 1.41 | 1403 | ○ | Inv. |
| 2-2 | 2-A | 2-e | 800° C. × 8 h | 480° C. × 2 h | 1.44 | 1021 | X | Comp. |
| 2-3 | 2-A | 2-e | 800° C. × 8 h | 520° C. × 2 h | 1.42 | 1456 | ○ | Inv. |
| 2-4 | 2-B | 2-c | 800° C. × 8 h | 520° C. × 4 h | 1.28 | 2144 | ○ | Inv. |
| 2-5 | 2-B | 2-c | 800° C. × 8 h | 520° C. × 8 h | 1.27 | 2101 | X | Comp. |
| 2-6 | 2-C | 2-e | 1000° C. × 8 h | 520° C. × 2 h | 1.43 | 1412 | ○ | Inv. |
| 2-7 | 2-C | 2-e | 1000° C. × 8 h | 500° C. × 2 h | 1.45 | 895 | X | Comp. |
| 2-8 | 2-D | 2-d | 800° C. × 8 h | 520° C. × 2 h | 1.38 | 1817 | ○ | Inv. |
| 2-9 | 2-E | 2-b | 800° C. × 8 h | 520° C. × 1 h | 1.34 | 1934 | ○ | Inv. |
| 2-10 | 2-E | 2-c | 800° C. × 8 h | 520° C. × 0.5 h | 1.41 | 1768 | ◎ | Inv. |

TABLE 7-continued

| sample No. | producing conditions: R1-T1-B based sintered compact Label | R2-Cu—Ga—Fe based alloy Label | first heat treatment | second heat treatment | Br (T) | HcJ (kA/m) | characteristic line determination | Notes |
|---|---|---|---|---|---|---|---|---|
| 2-11 | 2-E | 2-c | 800° C. × 8 h | 520° C. × 0.75 h | 1.39 | 1860 | ◎ | Inv. |
| 2-12 | 2-E | 2-c | 800° C. × 8 h | 520° C. × 1 h | 1.36 | 1890 | ○ | Inv. |
| 2-13 | 2-E | 2-d | 800° C. × 8 h | 520° C. × 1 h | 1.37 | 1881 | ○ | Inv. |
| 2-14 | 2-E | 2-e | 800° C. × 8 h | 520° C. × 1 h | 1.41 | 1670 | ◎ | Inv. |
| 2-15 | 2-F | 2-a | 800° C. × 8 h | 480° C. × 2 h | 1.27 | 2140 | X | Comp. |
| 2-16 | 2-G | 2-b | 800° C. × 8 h | 480° C. × 2 h | 1.28 | 2113 | ○ | Inv. |
| 2-17 | 2-H | 2-b | 800° C. × 8 h | 460° C. × 1 h | 1.29 | 2151 | ○ | Inv. |
| 2-18 | 2-I | 2-a | 800° C. × 8 h | 460° C. × 1 h | 1.26 | 2148 | X | Comp. |

TABLE 8

| sample No. | | composition of sintered R-T-B based magnet (mass %): R: Nd | R: Pr | T: Fe | T: Al | T: Si | T: Mn | T: Ga | T: Cu | T: B | [T]/[B] | Notes |
|---|---|---|---|---|---|---|---|---|---|---|---|---|
| 2-1 | entire sample | 26.3 | 1.7 | 69.6 | 0.04 | 0.04 | 0.03 | 0.10 | 0.15 | 0.90 | 15.0 | Inv. |
| | magnet surface portion 1 mm per side | 26.4 | 2.3 | 69.3 | 0.04 | 0.04 | 0.03 | 0.13 | 0.18 | 0.88 | 15.3 | |
| | magnet central portion 1 mm per side | 26.7 | 1.8 | 69.5 | 0.04 | 0.04 | 0.03 | 0.10 | 0.17 | 0.90 | 15.0 | |
| 2-2 | entire sample | 26.8 | 0.8 | 70.3 | 0.04 | 0.04 | 0.03 | 0.08 | 0.04 | 0.89 | 15.3 | Comp. |
| | magnet surface portion 1 mm per side | 26.9 | 1.2 | 69.9 | 0.04 | 0.04 | 0.03 | 0.13 | 0.07 | 0.88 | 15.4 | |
| | magnet central portion 1 mm per side | 27.1 | 0.7 | 70.1 | 0.04 | 0.05 | 0.03 | 0.07 | 0.04 | 0.89 | 15.3 | |
| 2-3 | entire sample | 26.2 | 2.0 | 69.4 | 0.04 | 0.05 | 0.03 | 0.21 | 0.15 | 0.88 | 15.3 | Inv. |
| | magnet surface portion 1 mm per side | 26.4 | 2.5 | 69.2 | 0.03 | 0.05 | 0.03 | 0.27 | 0.18 | 0.86 | 15.6 | |
| | magnet central portion 1 mm per side | 26.2 | 2.0 | 69.6 | 0.03 | 0.04 | 0.03 | 0.21 | 0.16 | 0.88 | 15.4 | |
| 2-4 | entire sample | 23.0 | 12.4 | 60.8 | 0.04 | 0.04 | 0.03 | 0.97 | 1.00 | 0.80 | 14.8 | Inv. |
| | magnet surface portion 1 mm per side | 21.8 | 15.1 | 59.3 | 0.04 | 0.04 | 0.03 | 1.17 | 1.14 | 0.76 | 15.2 | |
| | magnet central portion 1 mm per side | 23.8 | 11.4 | 61.4 | 0.04 | 0.04 | 0.03 | 0.94 | 0.99 | 0.80 | 14.9 | |
| 2-5 | entire sample | 22.5 | 14.0 | 59.5 | 0.04 | 0.04 | 0.03 | 1.06 | 1.10 | 0.77 | 15.0 | Comp. |
| | magnet surface portion 1 mm per side | 21.5 | 16.8 | 57.3 | 0.04 | 0.04 | 0.03 | 1.56 | 1.58 | 0.72 | 15.5 | |
| | magnet central portion 1 mm per side | 23.0 | 12.5 | 60.3 | 0.04 | 0.04 | 0.03 | 1.13 | 1.21 | 0.78 | 15.1 | |
| 2-6 | entire sample | 26.2 | 2.5 | 69.5 | 0.04 | 0.04 | 0.03 | 0.20 | 0.18 | 0.96 | 14.1 | Inv. |
| | magnet surface portion 1 mm per side | 25.6 | 3.5 | 68.5 | 0.03 | 0.04 | 0.03 | 0.29 | 0.23 | 0.93 | 14.3 | |
| | magnet central portion 1 mm per side | 26.3 | 2.4 | 69.4 | 0.04 | 0.04 | 0.03 | 0.20 | 0.19 | 0.96 | 14.1 | |
| 2-7 | entire sample | 26.2 | 2.2 | 69.6 | 0.04 | 0.04 | 0.03 | 0.15 | 0.15 | 0.97 | 13.9 | Comp. |
| | magnet surface portion 1 mm per side | 25.8 | 2.8 | 69.3 | 0.04 | 0.04 | 0.03 | 0.19 | 0.19 | 0.95 | 14.2 | |
| | magnet central portion 1 mm per side | 26.1 | 2.4 | 69.1 | 0.04 | 0.04 | 0.03 | 0.17 | 0.18 | 0.96 | 14.0 | |
| 2-8 | entire sample | 26.4 | 4.9 | 65.7 | 0.04 | 0.03 | 0.03 | 0.46 | 0.47 | 0.88 | 14.5 | Inv. |
| | magnet surface portion 1 mm per side | 26.6 | 5.6 | 64.6 | 0.03 | 0.05 | 0.03 | 0.57 | 0.53 | 0.84 | 14.9 | |
| | magnet central portion 1 mm per side | 27.9 | 4.1 | 65.5 | 0.02 | 0.05 | 0.03 | 0.43 | 0.45 | 0.87 | 14.6 | |
| 2-9 | entire sample | 26.5 | 6.5 | 63.8 | 0.03 | 0.02 | 0.03 | 0.61 | 0.48 | 0.86 | 14.3 | Inv. |
| | magnet surface portion 1 mm per side | 25.6 | 8.3 | 62.3 | 0.02 | 0.03 | 0.03 | 0.81 | 0.62 | 0.84 | 14.5 | |
| | magnet central portion 1 mm per side | 26.4 | 6.8 | 62.6 | 0.03 | 0.03 | 0.03 | 0.63 | 0.51 | 0.85 | 14.4 | |
| 2-10 | entire sample | 27.2 | 3.8 | 66.5 | 0.05 | 0.04 | 0.03 | 0.32 | 0.36 | 0.89 | 14.6 | Inv. |
| | magnet surface portion 1 mm per side | 26.9 | 4.9 | 65.7 | 0.04 | 0.04 | 0.03 | 0.41 | 0.40 | 0.86 | 14.8 | |
| | magnet central portion 1 mm per side | 28.0 | 3.5 | 66.3 | 0.04 | 0.05 | 0.03 | 0.34 | 0.37 | 0.89 | 14.5 | |

TABLE 8-continued

| sample No. | | composition of sintered R-T-B based magnet (mass %) R Nd | Pr | T Fe | Al | Si | Mn | Ga | Cu | B | [T]/[B] | Notes |
|---|---|---|---|---|---|---|---|---|---|---|---|---|
| 2-11 | entire sample | 26.9 | 4.9 | 65.5 | 0.04 | 0.04 | 0.03 | 0.41 | 0.48 | 0.87 | 14.6 | Inv. |
| | magnet surface portion 1 mm per side | 26.8 | 6.2 | 64.6 | 0.04 | 0.04 | 0.03 | 0.46 | 0.53 | 0.85 | 14.8 | |
| | magnet central portion 1 mm per side | 27.5 | 4.4 | 65.4 | 0.03 | 0.04 | 0.03 | 0.38 | 0.45 | 0.87 | 14.6 | |
| 2-12 | entire sample | 26.6 | 5.6 | 65.0 | 0.04 | 0.03 | 0.03 | 0.46 | 0.54 | 0.86 | 14.6 | Inv. |
| | magnet surface portion 1 mm per side | 26.4 | 6.7 | 64.2 | 0.04 | 0.04 | 0.03 | 0.55 | 0.62 | 0.83 | 15.0 | |
| | magnet central portion 1 mm per side | 27.5 | 5.1 | 64.7 | 0.04 | 0.05 | 0.03 | 0.40 | 0.53 | 0.87 | 14.4 | |
| 2-13 | entire sample | 27.4 | 4.0 | 65.6 | 0.04 | 0.03 | 0.03 | 0.40 | 0.36 | 0.90 | 14.2 | Inv. |
| | magnet surface portion 1 mm per side | 27.4 | 4.9 | 65.7 | 0.03 | 0.04 | 0.03 | 0.44 | 0.39 | 0.88 | 14.5 | |
| | magnet central portion 1 mm per side | 27.8 | 3.8 | 66.0 | 0.03 | 0.04 | 0.03 | 0.38 | 0.34 | 0.89 | 14.3 | |
| 2-14 | entire sample | 27.8 | 2.4 | 67.2 | 0.04 | 0.03 | 0.03 | 0.25 | 0.25 | 0.91 | 14.3 | Inv. |
| | magnet surface portion 1 mm per side | 27.7 | 2.9 | 66.3 | 0.04 | 0.04 | 0.03 | 0.31 | 0.29 | 0.88 | 14.6 | |
| | magnet central portion 1 mm per side | 28.2 | 2.3 | 66.7 | 0.03 | 0.04 | 0.03 | 0.27 | 0.24 | 0.90 | 14.4 | |
| 2-15 | entire sample | 27.6 | 8.5 | 61.0 | 0.04 | 0.05 | 0.03 | 0.85 | 0.60 | 0.72 | 16.5 | Comp. |
| | magnet surface portion 1 mm per side | 26.6 | 10.4 | 60.1 | 0.03 | 0.04 | 0.03 | 0.91 | 0.62 | 0.69 | 16.9 | |
| | magnet central portion 1 mm per side | 28.5 | 7.9 | 60.8 | 0.04 | 0.04 | 0.03 | 0.77 | 0.56 | 0.70 | 16.9 | |
| 2-16 | entire sample | 27.8 | 7.8 | 61.1 | 0.04 | 0.04 | 0.03 | 0.80 | 0.55 | 0.73 | 16.3 | Inv. |
| | magnet surface portion 1 mm per side | 26.7 | 9.7 | 60.7 | 0.04 | 0.04 | 0.03 | 0.88 | 0.59 | 0.71 | 16.6 | |
| | magnet central portion 1 mm per side | 28.6 | 7.2 | 61.5 | 0.04 | 0.04 | 0.03 | 0.69 | 0.48 | 0.73 | 16.4 | |
| 2-17 | entire sample | 27.7 | 8.1 | 61.0 | 0.04 | 0.03 | 0.03 | 0.77 | 0.61 | 0.80 | 14.8 | Inv. |
| | magnet surface portion 1 mm per side | 27.5 | 9.6 | 59.5 | 0.04 | 0.03 | 0.03 | 0.89 | 0.68 | 0.77 | 15.0 | |
| | magnet central portion 1 mm per side | 29.1 | 7.3 | 61.0 | 0.04 | 0.04 | 0.03 | 0.71 | 0.60 | 0.80 | 14.9 | |
| 2-18 | entire sample | 29.3 | 7.2 | 60.4 | 0.04 | 0.03 | 0.03 | 0.68 | 0.43 | 0.78 | 15.0 | Comp. |
| | magnet surface portion 1 mm per side | 29.1 | 8.9 | 59.5 | 0.04 | 0.04 | 0.03 | 0.73 | 0.45 | 0.76 | 15.2 | |
| | magnet central portion 1 mm per side | 30.1 | 6.7 | 60.4 | 0.04 | 0.04 | 0.03 | 0.65 | 0.43 | 0.77 | 15.2 | |

Experimental Example 3

[Step of Providing R1-T1-B Based Sintered Compact]

Sintered compacts were produced by the same method as in Experimental Example 1, except for weighing respective elements so that the sintered compacts would approximately result in the compositions in Table 9. Each resultant sintered compact had a density of 7.5 Mg/m$^3$ or more. A component analysis of each resultant sintered compact is shown in Table 9. The respective components in Table 9 were measured by using Inductively Coupled Plasma Optical Emission Spectroscopy (ICP-OES) (apparatus name: ICPV-1017 (manufactured by Shimadzu Corporation)). The oxygen amount in each sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 9

| Label | composition of R1-T1-B based sintered compact (mass %) R1 Nd | Pr | T1 Fe | Al | Si | Mn | Ga | B |
|---|---|---|---|---|---|---|---|---|
| 3-A | 29.1 | 0.1 | 68.7 | 0.05 | 0.04 | 0.03 | 0.00 | 0.93 |
| 3-B | 29.0 | 0.1 | 68.8 | 0.04 | 0.04 | 0.03 | 0.12 | 0.93 |

[Step of Providing R2-Cu—Ga—Fe Based Alloy]

R2-Cu—Ga—Fe based alloys were provided by the same method as in Experimental Example 1, except for weighing respective elements so that the R2-Cu—Ga—Fe based alloys would approximately result in the compositions indicated in Table 10. The compositions of the R2-Cu—Ga—Fe based alloys, as measured by using Inductively Coupled Plasma Optical Emission Spectroscopy (ICP-OES) (apparatus name: ICPE-9000 (manufactured by Shimadzu Corporation)), are shown in Table 10. As Comparative Example, an R2-Cu—Fe based alloy (3-c) not containing Ga was also provided. The compositions of the resultant R2-Cu—Fe based alloys are shown in Table 10.

TABLE 10

| Label | composition of R2-Cu—Ga—Fe based alloy (mass %) Nd | Pr | Ga | Cu | Fe |
|---|---|---|---|---|---|
| 3-a | 14.0 | 52.8 | 5.3 | 4.8 | 21.1 |
| 3-b | 66.3 | 0.0 | 5.2 | 4.8 | 22.0 |
| 3-c | 0.0 | 66.1 | 0.0 | 9.7 | 22.6 |

[Step of Performing First Heat Treatment]

Except for heating the R2-Cu—Ga—Fe alloy and R1-T1-B based sintered compact or the R2-Cu—Fe based alloy and R1-T1-B based sintered compact based on the temperature and time indicated for the first heat treatment in Table 11, the first heat treatment was performed by the same method as in Experimental Example 1.

[Step of Performing Second Heat Treatment]

Except for heating the R2-Cu—Ga—Fe alloy and R1-T1-B based sintered compact or the R2-Cu—Fe based alloy and R1-T1-B based sintered compact based on the temperatures and times indicated for the second heat treatment in Table 11, the second heat treatment was performed by the same method as in Experimental Example 1. Each sample after the heat treatment was processed by the same method as in Experimental Example 1, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 11. In FIG. 5, results of plotting a magnetic characteristics map, with $B_r$ taken on the vertical axis and $H_{cJ}$ taken on the horizontal axis, are shown (triangle plotted points in FIG. 5).

Moreover, results of analyzing the components of each entire sample in a 4.0 mm×4.0 mm×4.0 mm cube form by Inductively Coupled Plasma Optical Emission Spectroscopy (ICP-OES) (apparatus name: ICPV-1017 (manufactured by Shimadzu Corporation)) are shown in Table 12. Furthermore, using a method similar to that of Example 1, results of cutting out samples in a 1.0 mm×1.0 mm×1.0 mm cube form, from a magnet surface portion at a cross section perpendicular to the alignment direction and from the magnet central portion of the sample in a 4.0 mm×4.0 mm×4.0 mm cube form, and analyzing their components by Inductively Coupled Plasma Optical Emission Spectroscopy (ICP-OES) (apparatus name: ICPE-9000 (manufactured by Shimadzu Corporation)) are shown in Table 12.

As shown in Table 11, Table 12, and in FIG. 5, characteristics that were on or above characteristic line (2) were attained by a sintered R-T-B based magnet which was produced by using Nd and Pr in the R2-Cu—Ga—Fe based alloy (sample No. 3-1) and a sintered R-T-B based magnet which was produced by using Nd (sample No. 3-2). On the other hand, characteristics below characteristic line (2) were exhibited by a sintered R-T-B based magnet which was provided by using an R1-T1-B based sintered compact containing Ga and an R2-Cu—Fe based alloy (sample No. 3-3). Moreover, as Table 12 indicates, in the sintered R-T-B based magnet which was produced by using Nd and Pr in the R2-Cu—Ga—Fe based alloy (sample No. 3-1) and the sintered R-T-B based magnet which was produced by using Nd in the R2-Cu—Ga—Fe based alloy (sample No. 3-2), an R amount in the magnet surface portion was greater than an R amount in the magnet central portion, and a Ga amount in the magnet surface portion was greater than a Ga amount in the magnet central portion. Moreover, a molar ratio [T]/[B] in the magnet surface portion was higher than a molar ratio [T]/[B] in the magnet central portion. On the other hand, in the sintered R-T-B based magnet which was provided by using an R1-T1-B based sintered compact containing Ga and an R2-Cu—Fe based alloy (sample No. 3-3), only R2, Cu and Fe had been diffused and no Ga had been diffused, and thus an R amount in the magnet surface portion was greater than an R amount in the magnet central portion, and a Ga amount in the magnet surface portion was small relative to a Ga amount in the magnet central portion.

TABLE 11

| sample No. | producing conditions R1-T1-B based sintered compact Label | R2-Cu—Ga—Fe based alloy Label | first heat treatment | second heat treatment | Br (T) | HcJ (kA/m) | characteristic line determination | Notes |
|---|---|---|---|---|---|---|---|---|
| 3-1 | 3-A | 3-a | 800° C. × 8 h | 520° C. × 1 h | 1.37 | 1843 | ○ | Inv. |
| 3-2 | 3-A | 3-b | 800° C. × 8 h | 480° C. × 3 h | 1.38 | 1805 | ○ | Inv. |
| 3-3 | 3-B | 3-c | 800° C. × 8 h | 520° C. × 1 h | 1.34 | 1493 | X | Comp. |

TABLE 12

| sample No. | | composition of sintered R-T-B based magnet (mass %) R Nd | Pr | T Fe | Al | Si | Mn | Ga | Cu | B | [T]/[B] | Notes |
|---|---|---|---|---|---|---|---|---|---|---|---|---|
| 3-1 | entire sample | 27.5 | 3.8 | 65.6 | 0.03 | 0.03 | 0.03 | 0.40 | 0.36 | 0.90 | 14.2 | Inv. |
| | magnet surface portion 1 mm per side | 27.3 | 4.7 | 65.5 | 0.03 | 0.04 | 0.03 | 0.51 | 0.41 | 0.88 | 14.4 | |
| | magnet central portion 1 mm per side | 27.8 | 3.6 | 66.2 | 0.03 | 0.03 | 0.03 | 0.39 | 0.36 | 0.90 | 14.3 | |
| 3-2 | entire sample | 27.6 | 3.7 | 65.6 | 0.03 | 0.03 | 0.03 | 0.40 | 0.36 | 0.90 | 14.2 | Inv. |
| | magnet surface portion 1 mm per side | 27.5 | 4.5 | 65.3 | 0.02 | 0.03 | 0.03 | 0.48 | 0.39 | 0.87 | 14.6 | |

TABLE 12-continued

| sample No. | | composition of sintered R-T-B based magnet (mass %) R Nd | Pr | T Fe | Al | Si | Mn | Ga | Cu | B | [T]/[B] | Notes |
|---|---|---|---|---|---|---|---|---|---|---|---|---|
| | magnet central portion 1 mm per side | 28.1 | 3.3 | 66.3 | 0.03 | 0.03 | 0.03 | 0.36 | 0.33 | 0.90 | 14.3 | |
| 3-3 | entire sample | 26.4 | 6.6 | 64.2 | 0.04 | 0.03 | 0.03 | 0.12 | 0.99 | 0.84 | 14.8 | Comp. |
| | magnet surface portion 1 mm per side | 25.7 | 8.7 | 62.3 | 0.05 | 0.03 | 0.03 | 0.11 | 1.25 | 0.80 | 15.1 | |
| | magnet central portion 1 mm per side | 26.5 | 6.1 | 64.6 | 0.04 | 0.03 | 0.03 | 0.12 | 0.94 | 0.85 | 14.7 | |

Experimental Example 4

[Step of Providing R1-T1-B Based Sintered Compact]

A sintered compact was produced by the same method as in Experimental Example 1, except for weighing respective elements so that the sintered compact would approximately result in the composition in Table 13, and except for the oxygen amount being adjusted to 0.4 to 0.7 mass %. The resultant sintered compact had a density of 7.5 $Mg/m^3$ or more. A component analysis of the resultant sintered compact is shown in Table 13. The respective components in Table 13 were measured by using Inductively Coupled Plasma Optical Emission Spectroscopy (ICP-OES) (apparatus name: ICPV-1017 (manufactured by Shimadzu Corporation)). The oxygen amount in the sintered compact was measured by a gas fusion infrared absorption method, which all indicated a value around 0.5 mass %. The C (carbon amount) was measured with a gas analyzer based on a combustion-infrared absorption method, which indicated a value around 0.1 mass %.

TABLE 13

| Label | composition of R1-T1-B based sintered compact (mass %) R1 Nd | Pr | T1 Fe | Al | Si | Mn | B |
|---|---|---|---|---|---|---|---|
| 4-A | 30.4 | 0.2 | 67.3 | 0.03 | 0.05 | 0.04 | 0.93 |

[Step of Providing R2-Cu—Ga—Fe Based Alloy]

An R2-Cu—Ga—Fe based alloy was provided by the same method as in Experimental Example 1, except for weighing respective elements so that the R2-Cu—Ga—Fe based alloy would approximately result in the composition indicated in Table 14. The composition of the R2-Cu—Ga—Fe based alloy, as measured by using Inductively Coupled Plasma Optical Emission Spectroscopy (ICP-OES) (apparatus name: ICPE-9000 (manufactured by Shimadzu Corporation)), is shown in Table 14.

TABLE 14

| Label | composition of R2-Cu—Ga—Fe based alloy (mass %) Pr | Ga | Cu | Fe |
|---|---|---|---|---|
| 4-a | 77.5 | 6.3 | 5.9 | 10.0 |

[Step of Performing First Heat Treatment]

Except for heating the R2-Cu—Ga—Fe alloy and the R1-T1-B based sintered compact based on the temperatures and time indicated for the first heat treatment in Table 15, the first heat treatment was performed by the same method as in Experimental Example 1.

[Step of Performing Second Heat Treatment]

Except for heating the R2-Cu—Ga—Fe alloy and the R1-T1-B based sintered compact based on the temperature and time indicated for the second heat treatment in Table 15, the second heat treatment was performed by the same method as in Experimental Example 1. Each sample after the heat treatment was processed by the same method as in Experimental Example 1, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 15. In FIG. 5, results of plotting a magnetic characteristics map, with $B_r$ taken on the vertical axis and $H_{cJ}$ taken on the horizontal axis, are shown (circle plotted points in FIG. 5). Since, the R1-T1-B based sintered compact used in this Experimental Example had an oxygen amount of 0.4 to 0.7 mass %, a characteristic line determination was made in terms of exhibiting or not exhibiting higher $B_r$, or higher $H_{cJ}$, than characteristic line (3). Results are shown in Table 15.

Moreover, results of analyzing the components of each entire sample in a 4.0 mm×4.0 mm×4.0 mm cube form by Inductively Coupled Plasma Optical Emission Spectroscopy (ICP-OES) (apparatus name: ICPV-1017 (manufactured by Shimadzu Corporation)) are shown in Table 16. Furthermore, using a method similar to that of Example 1, results of cutting out samples in a 1.0 mm×1.0 mm×1.0 mm cube form, from a magnet surface portion at a cross section perpendicular to the alignment direction and from the magnet central portion of the sample in a 4.0 mm×4.0 mm×4.0 mm cube form, and analyzing their components by Inductively Coupled Plasma Optical Emission Spectroscopy (ICP-OES) (apparatus name: ICPE-9000 (manufactured by Shimadzu Corporation)) are shown in Table 16.

As shown in Table 15, Table 16, and in FIG. 5, characteristics on or above characteristic line (3) were obtained by a sintered R-T-B based magnet which was produced by using an R1-T1-B based sintered compact having an oxygen amount of 0.4 to 0.7 mass % (sample No. 4-1) and in which the ranges defined according to the present disclosure were satisfied. On the other hand, with a composition outside the ranges according to the present disclosure (i.e., the R amount was not in the range from 28 mass % to 36 mass %), even a sintered R-T-B based magnet which was produced by using an R1-T1-B based sintered compact having an oxygen amount of 0.4 to 0.7 mass % (sample No. 4-2) exhibited characteristics below characteristic line (3).

TABLE 15

| sample No. | producing conditions: R1-T1-B based sintered compact Label | R2-Cu—Ga—Fe based alloy Label | first heat treatment | second heat treatment | Br (T) | HcJ (kA/m) | characteristic line determination | Notes |
|---|---|---|---|---|---|---|---|---|
| 4-1 | 4-A | 4-a | 800° C. × 8 h | 520° C. × 2 h | 1.31 | 1839 | ○ | Inv. |
| 4-2 | 4-A | 4-a | 1000° C. × 8 h | 520° C. × 2 h | 1.22 | 1938 | X | Comp. |

TABLE 16

| sample No. | | composition of sintered R-T-B based magnet (mass %): R: Nd | Pr | T: Fe | Al | Si | Mn | Ga | Cu | B | [T]/[B] | Notes |
|---|---|---|---|---|---|---|---|---|---|---|---|---|
| 4-1 | entire sample | 27.6 | 6.4 | 63.3 | 0.03 | 0.03 | 0.04 | 0.53 | 0.48 | 0.87 | 14.2 | Inv. |
| | magnet surface portion 1 mm per side | 27.2 | 7.9 | 62.1 | 0.03 | 0.03 | 0.03 | 0.62 | 0.52 | 0.83 | 14.5 | |
| | magnet central portion 1 mm per side | 27.7 | 6.1 | 63.4 | 0.03 | 0.03 | 0.03 | 0.47 | 0.44 | 0.86 | 14.3 | |
| 4-2 | entire sample | 25.8 | 11.3 | 59.6 | 0.04 | 0.03 | 0.03 | 0.93 | 0.85 | 0.80 | 14.5 | Comp. |
| | magnet surface portion 1 mm per side | 24.6 | 14.4 | 57.6 | 0.03 | 0.02 | 0.03 | 1.08 | 0.92 | 0.75 | 14.9 | |
| | magnet central portion 1 mm per side | 26.0 | 10.9 | 60.2 | 0.03 | 0.03 | 0.03 | 0.83 | 0.77 | 0.80 | 14.6 | |

Experimental Example 5

[Step of Providing R1-T1-B Based Sintered Compact]

Sintered compacts were produced by the same method as in Experimental Example 1, except for weighing respective elements so that the sintered compacts would approximately result in the compositions in Table 17. Each resultant sintered compact had a density of 7.5 $Mg/m^3$ or more. A component analysis of each resultant sintered compact is shown in Table 17. The respective components in Table 17 were measured by using Inductively Coupled Plasma Optical Emission Spectroscopy (ICP-OES) (apparatus name: ICPV-1017 (manufactured by Shimadzu Corporation)). The oxygen amount in each sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 17

| Label | composition of R1-T1-B based sintered compact (mass %): R1: Nd | Pr | Dy | T1: Fe | Co | Al | Si | Mn | Ga | Cu | B |
|---|---|---|---|---|---|---|---|---|---|---|---|
| 5-A | 29.1 | 0.2 | 1.0 | 66.3 | 0.90 | 0.03 | 0.05 | 0.04 | 0.10 | 0.15 | 0.91 |
| 5-B | 23.4 | 5.8 | 0.0 | 67.5 | 0.90 | 0.02 | 0.04 | 0.04 | 0.00 | 0.00 | 0.92 |

[Step of Providing R2-Cu—Ga—Fe Based Alloy]

An R2-Cu—Ga—Fe based alloy was provided by the same method as in Experimental Example 1, except for weighing respective elements so that the R2-Cu—Ga—Fe based alloy would approximately result in the composition indicated in Table 18. The composition of the R2-Cu—Ga—Fe based alloy, as measured by using Inductively Coupled Plasma Optical Emission Spectroscopy (ICP-OES) (apparatus name: ICPE-9000 (manufactured by Shimadzu Corporation)), is shown in Table 18.

TABLE 18

| Label | composition of R2-Cu—Ga—Fe based alloy (mass %): Pr | Ga | Cu | Fe |
|---|---|---|---|---|
| 5-a | 65.4 | 6.4 | 3.9 | 22.3 |

[Step of Performing First Heat Treatment]

Except for heating the R2-Cu—Ga—Fe alloy and the R1-T1-B based sintered compact based on the temperatures and time indicated for the first heat treatment in Table 19, the first heat treatment was performed by the same method as in Experimental Example 1.

[Step of Performing Second Heat Treatment]

Except for heating the R2-Cu—Ga—Fe alloy and the R1-T1-B based sintered compact based on the temperature and time indicated for the second heat treatment in Table 19, the second heat treatment was performed by the same method as in Experimental Example 1. Each sample after the heat treatment was processed by the same method as in Experimental Example 1, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 19. In FIG. 5, results of plotting a magnetic characteristics map, with $B_r$ taken on the vertical axis and $H_{cJ}$ taken on the horizontal axis, are shown (× plotted points in FIG. 5).

Moreover, results of analyzing the components of each entire sample in a 4.0 mm×4.0 mm×4.0 mm cube form by Inductively Coupled Plasma Optical Emission Spectroscopy (ICP-OES) (apparatus name: ICPV-1017 (manufactured by Shimadzu Corporation)) are shown in Table 20. Furthermore, using a method similar to that of Example 1, results of cutting out samples in a 1.0 mm×1.0 mm×1.0 mm cube form, from a magnet surface portion at a cross section perpendicular to the alignment direction and from the magnet central portion of the sample in a 4.0 mm×4.0 mm×4.0 mm cube form, and analyzing their components by Inductively Coupled Plasma Optical Emission Spectroscopy (ICP-OES) (apparatus name: ICPE-9000 (manufactured by Shimadzu Corporation)) are shown in Table 20.

As shown in Table 19, Table 20, and in FIG. 5, sintered R-T-B based magnets which were produced by using an R1-T1-B based sintered compact containing Dy, Co, Ga and Cu (sample Nos. 5-1) and a sintered R-T-B based magnet which was produced by using an R1-T1-B based sintered compact containing Co and Zr (sample No. 5-2) attained characteristics that were on or above characteristic line (2). Moreover, as Table 20 indicates, the sintered R-T-B based magnets which were produced by using an R1-T1-B based sintered compact containing Dy, Co, Ga and Cu (sample No. 5-1) and the sintered R-T-B based magnet which was produced by using an R1-T1-B based sintered compact containing Co and Zr (sample No. 5-2) possessed compositions and characteristic features according to the ranges defined according to the present disclosure.

Experimental Example 6

[Step of Providing R1-T1-B Based Sintered Compact]

Respective elements were weighed so that the R1-T1-B based sintered compact would approximately result in compositions indicated as Labels 6-A through 6-I in Table 21, and through casting by a strip casting method, raw material alloys in flake form having a thickness of 0.2 to 0.4 mm were obtained. After each resultant raw material alloy in flake form was hydrogen-pulverized, it was subjected to a dehydrogenation treatment of heating to 550° C. in a vacuum and then cooling, whereby a coarse-pulverized powder was obtained. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. Note that the particle size $D_{50}$ is a central value of volume (volume median particle diameter) as obtained by a laser diffraction method by airflow dispersion technique.

To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction.

In a vacuum, the resultant compact was sintered for 4 hours at not lower than 1000° C. and not higher than 1050° C. (for each sample, a temperature was selected at which a sufficiently dense texture would result through sintering) and thereafter rapidly cooled, whereby an R1-T1-B based sin-

TABLE 19

| | producing conditions | | | | | | | |
|---|---|---|---|---|---|---|---|---|
| sample No. | R1-T1-B based sintered compact Label | R2-Cu—Ga—Fe based alloy Label | first heat treatment | second heat treatment | Br (T) | HcJ (kA/m) | characteristic line determination | Notes |
| 5-1 | 5-A | 5-a | 1000° C. × 8 h | 520° C. × 1 h | 1.34 | 2016 | ○ | Inv. |
| 5-2 | 5-B | 5-a | 800° C. × 8 h | 520° C. × 1 h | 1.36 | 1913 | ○ | Inv. |

TABLE 20

| sample | | composition of sintered R-T-B based magnet (mass %) | | | | | | | | | | | | |
|---|---|---|---|---|---|---|---|---|---|---|---|---|---|---|
| | | R | | | T | | | | | | | | | |
| No. | | Nd | Pr | Dy | Fe | Co | Al | Si | Mn | Ga | Cu | B | [T]/[B] | Notes |
| 5-1 | entire sample | 26.7 | 5.7 | 0.9 | 63.1 | 0.83 | 0.04 | 0.04 | 0.03 | 0.62 | 0.51 | 0.84 | 14.6 | Inv. |
| | magnet surface portion 1 mm per side | 26.4 | 6.9 | 0.9 | 61.9 | 0.82 | 0.04 | 0.04 | 0.03 | 0.73 | 0.58 | 0.81 | 14.8 | |
| | magnet central portion 1 mm per side | 26.9 | 5.3 | 0.9 | 63.0 | 0.84 | 0.04 | 0.04 | 0.03 | 0.59 | 0.49 | 0.84 | 14.6 | |
| 5-2 | entire sample | 26.7 | 5.8 | 0.0 | 64.1 | 0.83 | 0.04 | 0.04 | 0.03 | 0.46 | 0.52 | 0.84 | 14.8 | Inv. |
| | magnet surface portion 1 mm per side | 25.7 | 7.8 | 0.0 | 62.7 | 0.81 | 0.04 | 0.03 | 0.03 | 0.57 | 0.63 | 0.80 | 15.2 | |
| | magnet central portion 1 mm per side | 26.5 | 6.0 | 0.0 | 64.3 | 0.83 | 0.03 | 0.03 | 0.03 | 0.41 | 0.52 | 0.84 | 14.9 | |

tered compact was obtained. Each resultant sintered compact had a density of 7.5 $Mg/m^3$ or more. A component analysis of each resultant sintered compact is shown in Table 21. The respective components in Table 21 were measured by using Inductively Coupled Plasma Optical Emission Spectroscopy (ICP-OES). The oxygen amount in each sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %. In Table 21, "[T1]/[B]" is a ratio (a/b) between: a total (a) of the respective value of a result of dividing an analysis value (mass %) of each element (which herein are Fe, Al, Si and Mn) composing T1 with the atomic weight of that element; and (b) a result of dividing an analysis value (mass %) of B with the atomic weight of B. The same also applies to all tables below. Note that each composition, oxygen amount, and carbon amount in Table 1 do not total to 100 mass %. This is because the method of analysis differs for each component, as aforementioned. The same also applies to any other tables.

TABLE 21

| | composition of R1-T1-B based sintered compact (mass %) | | | | | | | |
|---|---|---|---|---|---|---|---|---|
| | R1 | | T1 | | | | | |
| Label | Nd | Pr | Fe | Al | Si | Mn | B | [T1]/[B] |
| 6-A | 28.2 | 0.1 | 69.6 | 0.05 | 0.05 | 0.03 | 0.89 | 15.2 |
| 6-B | 28.1 | 0.1 | 69.7 | 0.05 | 0.05 | 0.03 | 0.91 | 14.9 |
| 6-C | 28.3 | 0.1 | 69.6 | 0.05 | 0.05 | 0.03 | 0.93 | 14.5 |
| 6-D | 28.2 | 0.1 | 69.7 | 0.05 | 0.05 | 0.03 | 0.95 | 14.3 |
| 6-E | 28.1 | 0.1 | 69.3 | 0.05 | 0.05 | 0.03 | 0.96 | 14.0 |
| 6-F | 28.2 | 0.1 | 69.4 | 0.05 | 0.05 | 0.03 | 0.98 | 13.8 |
| 6-G | 29.1 | 0.1 | 68.7 | 0.05 | 0.04 | 0.03 | 0.93 | 14.4 |
| 6-H | 29.5 | 0.1 | 68.4 | 0.03 | 0.06 | 0.04 | 0.91 | 14.7 |
| 6-I | 30.7 | 0.1 | 67.6 | 0.03 | 0.05 | 0.04 | 0.91 | 14.5 |

[Step of Providing R2-Cu—Ga—Fe Based Alloy]

Respective elements were weighed so that the R2-Cu—Ga—Fe based alloy would approximately result in the composition indicated as Label 6-a in Table 22, and these raw materials were melted; thus, by a single roll rapid quenching method (melt spinning method), an alloy in ribbon or flake form was obtained. Using a mortar, the resultant alloy was pulverized in an argon ambient, and thereafter was passed through a sieve with an opening of 425 μm, thereby providing an R2-Cu—Ga—Fe based alloy. The composition of the resultant R2-Cu—Ga—Fe based alloy is shown in Table 22. The respective components in Table 22 were measured by using Inductively Coupled Plasma Optical Emission Spectroscopy (ICP-OES).

TABLE 22

| | composition of R2-Cu—Ga—Fe based alloy (mass %) | | | |
|---|---|---|---|---|
| Label | Pr | Ga | Cu | Fe |
| 6-a | 74.9 | 8.6 | 4.4 | 10.1 |

[Step of Performing First Heat Treatment]

The R1-T1-B based sintered compacts of Labels 6-A through 6-I in Table 21 were severed and cut into a 4.4 mm×10.0 mm×11.0 mm rectangular solid (where a 10.0 mm×11.0 mm face defined a face perpendicular to the alignment direction). Next, as shown in FIG. 4, in a processing container 3 made of niobium foils, the R2-Cu—Ga—Fe based alloy indicated as Label 6-a in Table 22 was placed above and below the R1-T1-B based sintered compacts of Labels 6-A through 1-F in an amount of 10 mass % each, thus totaling 20 mass %, with respect to the weight of the R1-T1-B based sintered compact, in such a manner that mainly its face perpendicular to the alignment direction of the R1-T1-B based sintered compact 1 (i.e., the direction indicated by arrows in the figure) was in contact with the R2-Cu—Ga—Fe based alloy 2. Next, in argon which was controlled to a reduced pressure of 200 Pa, by using a tubular flow furnace, the first heat treatment was effected by heating the R2-Cu—Ga—Fe based alloy and the R1-T1-B based sintered compact based on the temperatures and time indicated for the first heat treatment in Table 23, followed by cooling.

[Step of Performing Second Heat Treatment]

In argon which was controlled to a reduced pressure of 200 Pa, by using a tubular flow furnace, the R1-T1-B based sintered compact having undergone the first heat treatment was subjected to the second heat treatment based on the temperature and times indicated for the second heat treatment in Table 23, followed by cooling. In order to remove any thickened portion in the R2-Cu—Ga—Fe based alloy existing in the surface vicinity of each sample after the heat treatment, a surface grinder was used to cut on the entire surface of each sample, whereby samples respectively in the form of a 4.0 mm×4.0 mm×4.0 mm cube (sintered R-T-B based magnet) were obtained. Note that the heating temperature for the R2-Cu—Ga—Fe alloy and R1-T1-B based sintered compact in the step of performing the first heat treatment and the heating temperature for the R1-T1-B based sintered compact in the step of performing the second heat treatment were each measured by attaching a thermocouple.

[Sample Evaluations]

With respect to the resultant samples, $B_r$ and $H_{cJ}$ of each sample were measured by using a B—H tracer. Results of measurement are shown in Table 23. As shown in Table 23, examples of the present invention in which the R1-T1-B based sintered compact had a molar ratio [T1]/[B] greater than 14.0 but not greater than 15.0 all attained high $B_r$ and high $H_{cJ}$. On the other hand, in sample Nos. 6-5 and 6-6 in which the molar ratio [T1]/[B] was 14.0 or smaller, $H_{cJ}$ had greatly reduced. Moreover, in sample No. 6-1 in which the molar ratio [T1]/[B] exceeded 15.0, $B_r$ had greatly reduced.

TABLE 23

| sample | producing conditions | | | | | | | |
|---|---|---|---|---|---|---|---|---|
| | R1-T1-B based sintered compact | | R2-Cu—Ga—Fe based alloy | first heat | second heat | $B_r$ | $H_{cJ}$ | |
| No. | Label | [T1]/[B] | Label | treatment | treatment | (T) | (kA/m) | Notes |
| 6-1 | 6-A | 15.1 | 6-a | 800° C. × 8 h | 520° C. × 2 h | 1.27 | 2082 | Comp. |
| 6-2 | 6-B | 14.9 | 6-a | 800° C. × 8 h | 520° C. × 2 h | 1.31 | 1931 | Inv. |
| 6-3 | 6-C | 14.5 | 6-a | 800° C. × 8 h | 520° C. × 2 h | 1.35 | 1879 | Inv. |
| 6-4 | 6-D | 14.3 | 6-a | 1000° C. × 8 h | 520° C. × 8 h | 1.42 | 1552 | Inv. |
| 6-5 | 6-E | 14.0 | 6-a | 1000° C. × 8 h | 520° C. × 8 h | 1.41 | 891 | Comp. |
| 6-6 | 6-F | 13.8 | 6-a | 1000° C. × 8 h | 520° C. × 8 h | 1.45 | 768 | Comp. |
| 6-7 | 6-G | 14.4 | 6-a | 800° C. × 8 h | 520° C. × 1 h | 1.37 | 1881 | Inv. |
| 6-8 | 6-H | 14.7 | 6-a | 800° C. × 8 h | 520° C. × 1 h | 1.33 | 1898 | Inv. |
| 6-9 | 6-I | 14.5 | 6-a | 800° C. × 8 h | 520° C. × 1 h | 1.31 | 1911 | Inv. |

Experimental Example 7

[Step of Providing R1-T1-B Based Sintered Compact]

A sintered compact was produced by the same method as in Experimental Example 6, except for weighing respective elements so that the R1-T1-B based sintered compact would approximately result in the composition indicated as Label 7-A in Table 24. The resultant sintered compact had a density of 7.5 $Mg/m^3$ or more. A component analysis of the resultant sintered compact is shown in Table 24. Respective components in Table 24 were measured by the same method as in Experimental Example 6. The oxygen amount in the sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 24

| | composition of R1-T1-B based sintered compact (mass %) | | | | | | | |
|---|---|---|---|---|---|---|---|---|
| | R1 | | T1 | | | | | |
| Label | Nd | Pr | Fe | Al | Si | Mn | B | [T1]/[B] |
| 7-A | 28.3 | 0.1 | 69.6 | 0.05 | 0.05 | 0.03 | 0.93 | 14.5 |

[Step of Providing R2-Cu—Ga—Fe Based Alloy]

R2-Cu—Ga—Fe based alloys were provided by the same method as in Experimental Example 6, except for weighing respective elements so that the R2-Cu—Ga—Fe based alloys would approximately result in the compositions indicated as Labels 7-a through 7-i in Table 25. The compositions of the R2-Cu—Ga—Fe based alloys are shown in Table 25. Respective components in Table 25 were measured by the same method as in Experimental Example 6.

TABLE 25

| | composition of R2-Cu—Ga—Fe based alloy (mass %) | | | |
|---|---|---|---|---|
| Label | Pr | Ga | Cu | Fe |
| 7-a | 86.0 | 8.2 | 5.1 | 0.0 |
| 7-b | 82.0 | 7.8 | 4.8 | 4.6 |
| 7-c | 74.9 | 8.6 | 4.4 | 10.1 |
| 7-d | 71.1 | 6.8 | 4.2 | 15.7 |

TABLE 25-continued

| | composition of R2-Cu—Ga—Fe based alloy (mass %) | | | |
|---|---|---|---|---|
| Label | Pr | Ga | Cu | Fe |
| 7-e | 65.4 | 6.4 | 3.9 | 22.3 |
| 7-f | 58.8 | 5.9 | 3.4 | 30.9 |
| 7-g | 51.3 | 5.0 | 3.0 | 40.1 |
| 7-h | 46.2 | 4.5 | 2.8 | 44.9 |
| 7-i | 41.1 | 3.9 | 2.5 | 51.4 |

[Step of Performing First Heat Treatment]

Except for heating the R2-Cu—Ga—Fe alloy and the R1-T1-B based sintered compact based on the temperature and time indicated for the first heat treatment in Table 26, the first heat treatment was performed by the same method as in Experimental Example 6.

[Step of Performing Second Heat Treatment]

Except for heating the R2-Cu—Ga—Fe alloy and the R1-T1-B based sintered compact based on the temperature and time indicated for the second heat treatment in Table 26, the second heat treatment was performed by the same method as in Experimental Example 6. Each sample after the heat treatment was processed by the same method as in Experimental Example 6, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 26. As shown in Table 26, examples of the present invention in which the R—Cu—Ga—Fe based alloy had an Fe amount of not less than 10 mass % and not more than 45 mass % attained high $B_r$ and high $H_{cJ}$. Moreover, when the Fe amount in the R—Cu—Ga—Fe based alloy accounted for not less than 15 mass % and not more than 40 mass % of (sample Nos. 7-4 to 7-7), even higher $B_r$ and higher $H_{cJ}$ were obtained. On the other hand, in sample Nos. 7-1 and 7-2, in which the R—Cu—Ga—Fe based alloy had an Fe amount of 10 mass % or less (5 mass % or less), $B_r$ had greatly reduced. In sample No. 7-9, in which the R—Cu—Ga—Fe based alloy had an Fe amount exceeding 45 mass %, $H_{cJ}$ had greatly reduced.

TABLE 26

| sample No. | producing conditions: R1-T1-B based sintered compact Label | R2-Cu—Ga—Fe based alloy Label | R2-Cu—Ga—Fe based alloy Fe (mass %) | first heat treatment | second heat treatment | $B_r$ (T) | $H_{cJ}$ (kA/m) | Notes |
|---|---|---|---|---|---|---|---|---|
| 7-1 | 7-A | 7-a | 0.0 | 800° C. × 8 h | 520° C. × 2 h | 1.28 | 2010 | Comp. |
| 7-2 | 7-A | 7-b | 4.6 | 800° C. × 8 h | 520° C. × 2 h | 1.29 | 1996 | Comp. |
| 7-3 | 7-A | 7-c | 10.1 | 800° C. × 8 h | 520° C. × 2 h | 1.35 | 1879 | Inv. |
| 7-4 | 7-A | 7-d | 15.7 | 800° C. × 8 h | 520° C. × 2 h | 1.35 | 1914 | Inv. |
| 7-5 | 7-A | 7-e | 22.3 | 800° C. × 8 h | 520° C. × 2 h | 1.37 | 1831 | Inv. |
| 7-6 | 7-A | 7-f | 30.9 | 800° C. × 8 h | 520° C. × 2 h | 1.38 | 1809 | Inv. |
| 7-7 | 7-A | 7-g | 40.1 | 800° C. × 8 h | 520° C. × 2 h | 1.41 | 1657 | Inv. |
| 7-8 | 7-A | 7-h | 45.0 | 800° C. × 8 h | 520° C. × 2 h | 1.43 | 1478 | Inv. |
| 7-9 | 7-A | 7-i | 51.4 | 800° C. × 8 h | 520° C. × 2 h | 1.46 | 1096 | Comp. |

Experimental Example 8

[Step of Providing R1-T1-B Based Sintered Compact]

Sintered compacts were produced by the same method as in Experimental Example 6, except for weighing respective elements so that the R1-T1-B based sintered compacts would approximately result in the compositions indicated as Labels 8-A and 8-B in Table 27. Each resultant sintered compact had a density of 7.5 Mg/m$^3$ or more. A component analysis of each resultant sintered compact is shown in Table 27. Respective components in Table 27 were measured by the same method as in Experimental Example 6. The oxygen amount in each sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 27

| Label | composition of R1-T1-B based sintered compact (mass %): R1 Nd | R1 Pr | T1 Fe | T1 Co | T1 Al | T1 Si | T1 Mn | T1 Ga | T1 Cu | B | [T1]/[B] |
|---|---|---|---|---|---|---|---|---|---|---|---|
| 8-A | 28.3 | 0.1 | 69.6 | 0.00 | 0.05 | 0.05 | 0.03 | 0.00 | 0.00 | 0.93 | 14.5 |
| 8-B | 22.4 | 7.4 | 66.3 | 0.49 | 0.33 | 0.02 | 0.03 | 0.53 | 0.15 | 0.92 | 14.2 |

[Step of Providing R2-Cu—Ga—Fe Based Alloy]

R2-Cu—Ga—Fe based alloys were provided by the same method as in Experimental Example 6, except for weighing respective elements so that the R2-Cu—Ga—Fe based alloys would approximately result in the compositions indicated as Labels 8-a through 8-p in Table 28. The compositions of the R2-Cu—Ga—Fe based alloys are shown in Table 28. Respective components in Table 28 were measured by the same method as in Experimental Example 6.

TABLE 28

| Label | composition of R2-Cu—Ga—Fe based alloy (mass %): Nd | Pr | Ga | Cu | Fe |
|---|---|---|---|---|---|
| 8-a | 0.0 | 33.1 | 28.1 | 27.3 | 9.9 |
| 8-b | 0.0 | 35.1 | 26.9 | 26.3 | 20.4 |
| 8-c | 0.0 | 65.4 | 6.4 | 3.9 | 22.3 |
| 8-d | 0.0 | 86.1 | 2.5 | 2.5 | 7.8 |

TABLE 28-continued

| Label | composition of R2-Cu—Ga—Fe based alloy (mass %): Nd | Pr | Ga | Cu | Fe |
|---|---|---|---|---|---|
| 8-e | 0.0 | 36.1 | 40.4 | 3.2 | 20.0 |
| 8-f | 0.0 | 37.0 | 39.3 | 12.1 | 10.2 |
| 8-g | 0.0 | 51.0 | 14.2 | 13.2 | 20.2 |
| 8-h | 0.0 | 79.8 | 4.1 | 4.3 | 10.0 |
| 8-i | 0.0 | 71.2 | 2.0 | 5.0 | 20.2 |
| 8-j | 0.0 | 35.1 | 2.5 | 41.0 | 20.1 |
| 8-k | 0.0 | 35.0 | 3.3 | 39.8 | 20.1 |
| 8-l | 0.0 | 58.2 | 10.2 | 10.0 | 20.3 |
| 8-m | 66.1 | 0.0 | 6.2 | 4.0 | 22.2 |
| 8-n | 0.0 | 66.2 | 9.9 | 2.1 | 20.1 |
| 8-o | 73.3 | 0.0 | 0.0 | 4.9 | 20.5 |
| 8-p | 78.8 | 0.0 | 0.0 | 0.0 | 20.2 |

[Step of Performing First Heat Treatment]

Except for heating the R2-Cu—Ga—Fe alloy and the R1-T1-B based sintered compact based on the temperature and time indicated for the first heat treatment in Table 29, the first heat treatment was performed by the same method as in Experimental Example 6.

[Step of Performing Second Heat Treatment]

Except for heating the R2-Cu—Ga—Fe alloy and the R1-T1-B based sintered compact based on the temperature and time indicated for the second heat treatment in Table 29, the second heat treatment was performed by the same method as in Experimental Example 6. Each sample after the heat treatment was processed by the same method as in Experimental Example 6, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 29. As shown in Table 29, high $B_r$ and high $H_{cJ}$ were attained by examples of the present invention in which the R2 amount in the R2-Cu—

Ga—Fe based alloy was not less than 35 mass % and not more than 85 mass %, the Ga amount was not less than 2.5 mass % and not more than 40 mass %, and the Cu amount was not less than 2.5 mass % and not more than 40 mass % On the other hand, if any of R, Cu and Ga in the R2-Cu—Ga—Fe based alloy was outside the ranges according to the present disclosure (i.e., Labels 8-a and 8-d had their R2 outside the range; Labels 8-e, 8-i, and 8-o had their Ga outside the range; Labels 8-j and 8-n had their Cu outside the range; and Label 8-p had its Cu and Ga outside the range), high $H_{cJ}$ could not be obtained. Thus, high $B_r$ and high $H_{cJ}$ are being obtained because of the R, Cu and Ga (and Fe, as indicated in Experimental Example 7) contents falling within the ranges according to the present disclosure.

TABLE 29

| | producing conditions | | | | | | | | | |
|---|---|---|---|---|---|---|---|---|---|---|
| | R1-T1-B based sintered | R2-Cu—Ga—Fe based alloy | | | | | second | | | |
| sample No. | compact Label | Label | R2 (mass %) | Ga (mass %) | Cu (mass %) | first heat treatment | heat treatment | $B_r$ (T) | $H_{cJ}$ (kA/m) | Notes |
| 8-1 | 8-A | 8-a | 33.1 | 28.1 | 27.3 | 800° C. × 8 h | 520° C. × 2 h | 1.45 | 965 | Comp. |
| 8-2 | 8-A | 8-b | 35.1 | 26.9 | 26.3 | 800° C. × 8 h | 520° C. × 2 h | 1.41 | 1433 | Inv. |
| 8-3 | 8-A | 8-c | 65.4 | 6.4 | 3.9 | 800° C. × 8 h | 520° C. × 2 h | 1.37 | 1831 | Inv. |
| 8-4 | 8-A | 8-d | 86.1 | 2.5 | 2.5 | 800° C. × 8 h | 520° C. × 2 h | 1.38 | 1375 | Comp. |
| 8-5 | 8-A | 8-e | 36.1 | 40.4 | 3.2 | 800° C. × 8 h | 520° C. × 2 h | 1.45 | 886 | Comp. |
| 8-6 | 8-A | 8-f | 37.0 | 39.3 | 12.1 | 800° C. × 8 h | 520° C. × 2 h | 1.40 | 1467 | Inv. |
| 8-7 | 8-A | 8-g | 51.0 | 14.2 | 13.2 | 800° C. × 8 h | 520° C. × 2 h | 1.37 | 1652 | Inv. |
| 8-8 | 8-A | 8-h | 79.8 | 4.1 | 4.3 | 800° C. × 8 h | 520° C. × 2 h | 1.36 | 1750 | Inv. |
| 8-9 | 8-A | 8-i | 71.2 | 2.0 | 5.0 | 800° C. × 8 h | 520° C. × 2 h | 1.40 | 1317 | Comp. |
| 8-10 | 8-A | 8-j | 35.1 | 2.5 | 41.0 | 800° C. × 8 h | 520° C. × 2 h | 1.42 | 1198 | Comp. |
| 8-11 | 8-A | 8-k | 35.0 | 3.3 | 39.8 | 800° C. × 8 h | 520° C. × 2 h | 1.40 | 1404 | Inv. |
| 8-12 | 8-A | 8-l | 58.2 | 10.2 | 10.0 | 800° C. × 8 h | 520° C. × 2 h | 1.35 | 1912 | Inv. |
| 8-13 | 8-A | 8-m | 66.1 | 6.2 | 4.0 | 800° C. × 8 h | 520° C. × 2 h | 1.38 | 1725 | Inv. |
| 8-14 | 8-A | 8-n | 66.2 | 9.9 | 2.1 | 800° C. × 8 h | 520° C. × 2 h | 1.42 | 1258 | Comp. |
| 8-15 | 8-B | 8-o | 73.3 | 0.0 | 4.9 | 800° C. × 8 h | 520° C. × 2 h | 1.44 | 1120 | Comp. |
| 8-16 | 8-B | 8-p | 78.8 | 0.0 | 0.0 | 800° C. × 8 h | 520° C. × 2 h | 1.39 | 1378 | Comp. |

Experimental Example 9

[Step of Providing R1-T1-B Based Sintered Compact]

A sintered compact was produced by the same method as in Experimental Example 6, except for weighing respective elements so that the R1-T1-B based sintered compact would approximately result in the composition indicated as Label 9-A in Table 30. The resultant sintered compact had a density of 7.5 Mg/m$^3$ or more. A component analysis of the resultant sintered compact is shown in Table 30. Respective components in Table 30 were measured by the same method as in Experimental Example 6. The oxygen amount in the sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 30

| | composition of R1-T1-B based sintered compact (mass %) | | | | | | | |
|---|---|---|---|---|---|---|---|---|
| | R1 | | T1 | | | | | |
| Label | Nd | Pr | Fe | Al | Si | Mn | B | [T1]/[B] |
| 9-A | 28.3 | 0.1 | 69.6 | 0.05 | 0.05 | 0.03 | 0.93 | 14.5 |

[Step of Providing R2-Cu—Ga—Fe Based Alloy]

An R2-Cu—Ga—Fe based alloy was provided by the same method as in Experimental Example 6, except for weighing respective elements so that the R2-Cu—Ga—Fe based alloy would approximately result in the composition indicated as Label 9—in Table 31. The composition of the R2-Cu—Ga—Fe based alloy is shown in Table 31. Respective components in Table 31 were measured by the same method as in Experimental Example 6.

TABLE 31

| | composition of R2-Cu—Ga—Fe based alloy (mass %) | | | |
|---|---|---|---|---|
| Label | Pr | Ga | Cu | Fe |
| 9-a | 65.4 | 6.4 | 3.9 | 22.3 |

[Step of Performing First Heat Treatment]

Except for heating the R2-Cu—Ga—Fe alloy and the R1-T1-B based sintered compact based on the temperatures and time indicated for the first heat treatment in Table 32, the first heat treatment was performed by the same method as in Experimental Example 6.

[Step of Performing Second Heat Treatment]

Except for heating the R2-Cu—Ga—Fe alloy and the R1-T1-B based sintered compact based on the temperatures and time indicated for the second heat treatment in Table 32, the second heat treatment was performed by the same method as in Experimental Example 6. Each sample after the heat treatment was processed by the same method as in Experimental Example 6, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 32. As shown in Table 32, examples of the present invention satisfying the first heat treatment temperature (not lower than 700° C. and not higher than 1100° C.) and second heat treatment temperature (not lower than 450° C. and not higher than 600° C.) according to the present disclosure attained high $B_r$ and high $H_{cJ}$. Moreover, as shown in Table 32, when the temperature of the first heat treatment was not lower than 800° C. and not higher than 1000° C. and the temperature of the second heat treatment was not lower than 480° C. and not higher than 560° C., even higher $H_{cJ}$ was obtained. On the other hand, when either the first heat treatment temperature or the second heat treatment temperature was outside the range according to the present disclosure (sample No. 9-1 was outside the range with respect to its first heat treatment; and sample Nos. 9-5 and 9-11 were outside the range with respect to their second heat treatment), high $H_{cJ}$ could not be obtained.

TABLE 32

| | producing conditions | | | | | | |
|---|---|---|---|---|---|---|---|
| sample No. | R1-T1-B based sintered compact Label | R2-Cu—Ga—Fe based alloy Label | first heat treatment | second heat treatment | $B_r$ (T) | $H_{cJ}$ (kA/m) | Notes |
| 9-1 | 9-A | 9-a | 600° C. × 8 h | 520° C. × 2 h | 1.46 | 801 | Comp. |
| 9-2 | 9-A | 9-a | 700° C. × 8 h | 520° C. × 2 h | 1.41 | 1511 | Inv. |
| 9-3 | 9-A | 9-a | 900° C. × 8 h | 520° C. × 2 h | 1.33 | 1958 | Inv. |
| 9-4 | 9-A | 9-a | 1000° C. × 8 h | 520° C. × 2 h | 1.30 | 2034 | Inv. |
| 9-5 | 9-A | 9-a | 800° C. × 8 h | 440° C. × 2 h | 1.46 | 1031 | Comp. |
| 9-6 | 9-A | 9-a | 800° C. × 8 h | 450° C. × 2 h | 1.42 | 1424 | Inv. |
| 9-7 | 9-A | 9-a | 800° C. × 8 h | 480° C. × 2 h | 1.38 | 1801 | Inv. |
| 9-8 | 9-A | 9-a | 800° C. × 8 h | 520° C. × 2 h | 1.37 | 1831 | Inv. |
| 9-9 | 9-A | 9-a | 800° C. × 8 h | 560° C. × 2 h | 1.38 | 1767 | Inv. |
| 9-10 | 9-A | 9-a | 800° C. × 8 h | 600° C. × 2 h | 1.41 | 1512 | Inv. |
| 9-11 | 9-A | 9-a | 800° C. × 8 h | 620° C. × 2 h | 1.47 | 999 | Comp. |

Experimental Example 10

[Step of Providing R1-T1-B Based Sintered Compact]

Sintered compacts were produced by the same method as in Experimental Example 6, except for weighing respective elements so that the R1-T1-B based sintered compacts would approximately result in the compositions indicated as Labels 10-A and 5-B in Table 33. Each resultant sintered compact had a density of 7.5 $Mg/m^3$ or more. A component analysis of each resultant sintered compact is shown in Table 33. Respective components in Table 33 were measured by the same method as in Experimental Example 6. The oxygen amount in each sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %. In Table 33, "[T1]/[B]" is a ratio (a/b) between: a total (a) of the respective value of a result of dividing an analysis value (mass %) of each element (which herein are Fe, Co, Al, Si and Mn) composing T1 with the atomic weight of that element; and (b) a result of dividing an analysis value (mass %) of B with the atomic weight of B.

TABLE 33

| | composition of R1-T1-B based sintered compact (mass %) | | | | | | | | | | | | |
|---|---|---|---|---|---|---|---|---|---|---|---|---|---|
| | R1 | | | T1 | | | | | | | | | |
| Label | Nd | Pr | Dy | Fe | Co | Al | Si | Mn | Zr | Ga | Cu | B | [T1]/[B] |
| 10-A | 29.1 | 0.2 | 1.0 | 66.3 | 0.90 | 0.03 | 0.05 | 0.04 | 0.00 | 0.10 | 0.15 | 0.91 | 14.3 |
| 10-B | 23.4 | 5.8 | 0.0 | 67.5 | 0.90 | 0.02 | 0.04 | 0.04 | 0.10 | 0.00 | 0.00 | 0.92 | 14.4 |

[Step of Providing R2-Cu—Ga—Fe Based Alloy]

An R2-Cu—Ga—Fe based alloy was provided by the same method as in Experimental Example 6, except for weighing respective elements so that the R2-Cu—Ga—Fe based alloy would approximately result in the composition indicated as Label 10-a in Table 34. The composition of the R2-Cu—Ga—Fe based alloy is shown in Table 34. Respective components in Table 34 were measured by the same method as in Experimental Example 1.

TABLE 34

| Label | composition of R2-Cu—Ga—Fe based alloy (mass %) Pr | Ga | Cu | Fe |
|---|---|---|---|---|
| 10-a | 65.4 | 6.4 | 3.9 | 22.3 |

[Step of Performing First Heat Treatment]

Except for heating the R2-Cu—Ga—Fe alloy and the R1-T1-B based sintered compact based on the temperatures and time indicated for the first heat treatment in Table 35, the first heat treatment was performed by the same method as in Experimental Example 6.

[Step of Performing Second Heat Treatment]

Except for heating the R2-Cu—Ga—Fe alloy and the R1-T1-B based sintered compact based on the temperature and times indicated for the second heat treatment in Table 35, the second heat treatment was performed by the same method as in Experimental Example 6. Each sample after the heat treatment was processed by the same method as in Experimental Example 6, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 35. Results of measuring the components of each sample by using Inductively Coupled Plasma Optical Emission Spectroscopy (ICP-OES) are shown in Table 35. As shown in Table 35, high $B_r$ and high $H_{cJ}$ were obtained even when the R1-T1-B based sintered compact contained Dy, Co, Ga, Cu or Zr.

TABLE 35

| sample No. | producing conditions R1-T1-B based sintered compact Label | R2-Cu—Ga—Fe based alloy Label | first heat treatment | second heat treatment | $B_r$ (T) | $H_{cJ}$ (kA/m) | Notes |
|---|---|---|---|---|---|---|---|
| 10-1 | 10-A | 10-a | 1000° C. × 8 h | 520° C. × 2 h | 1.34 | 2016 | Inv. |
| 10-2 | 10-B | 10-a | 800° C. × 8 h | 520° C. × 1 h | 1.36 | 1913 | Inv. |
| 10-3 | 10-B | 10-a | 1100° C. × 8 h | 520° C. × 2 h | 1.30 | 2133 | Inv. |

Experimental Example 11

[Step of Providing R1-T1-B Based Sintered Compact]

A sintered compact was produced by the same method as in Experimental Example 6, except for weighing respective elements so that the R1-T1-B based sintered compact would approximately result in the composition indicated as Label 11-A in Table 36. The resultant sintered compact had a density of 7.5 Mg/m$^3$ or more. A component analysis of the resultant sintered compact is shown in Table 36. Respective components in Table 36 were measured by the same method as in Experimental Example 6. The oxygen amount in the sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 36

| Label | composition of R1-T1-B based sintered compact (mass %) R1 Nd | R1 Pr | T1 Fe | T1 Al | T1 Si | T1 Mn | T1 B | [T1]/[B] |
|---|---|---|---|---|---|---|---|---|
| 11-A | 28.3 | 0.1 | 69.6 | 0.05 | 0.05 | 0.03 | 0.93 | 14.5 |

[Step of Providing R2-Cu—Ga—Fe Based Alloy]

R2-Cu—Ga—Fe based alloys were provided by the same method as in Experimental Example 6, except for weighing respective elements so that the R2-Cu—Ga—Fe based alloys would approximately result in the compositions indicated as Labels 11-a and 11-b in Table 37. The compositions of the R2-Cu—Ga—Fe based alloys are shown in Table 37. Respective components in Table 37 were measured by the same method as in Experimental Example 6.

TABLE 37

| Label | composition of R2-Cu—Ga—Fe based alloy (mass %) Pr | Ga | Cu | Fe | Co | Zn |
|---|---|---|---|---|---|---|
| 11-a | 65.3 | 6.3 | 4.0 | 17.8 | 5.0 | 0.0 |
| 11-b | 65.3 | 6.2 | 3.9 | 22.2 | 0.0 | 0.5 |

[Step of Performing First Heat Treatment]

Except for heating the R2-Cu—Ga—Fe alloy and the R1-T1-B based sintered compact based on the temperature and time indicated for the first heat treatment in Table 38, the first heat treatment was performed by the same method as in Experimental Example 6.

[Step of Performing Second Heat Treatment]

Except for heating the R2-Cu—Ga—Fe alloy and the R1-T1-B based sintered compact based on the temperature and time indicated for the second heat treatment in Table 38, the second heat treatment was performed by the same method as in Experimental Example 6. Each sample after the heat treatment was processed by the same method as in Experimental Example 6, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 38. As shown in Table 38, high $B_r$ and high $H_{cJ}$ were obtained even when the R2-Cu—Ga—Fe based alloy contained Co or Zn.

TABLE 38

| sample No. | producing conditions: R1-T1-B based sintered compact Label | R2-Cu—Ga—Fe based alloy Label | first heat treatment | second heat treatment | $B_r$ (T) | $H_{cJ}$ (kA/m) | Notes |
|---|---|---|---|---|---|---|---|
| 11-1 | 11-A | 11-a | 800° C. × 8 h | 520° C. × 2 h | 1.38 | 1789 | Inv. |
| 11-2 | 11-A | 11-b | 800° C. × 8 h | 520° C. × 2 h | 1.37 | 1876 | Inv. |

Experimental Example 12

[Step of Providing R1-T1-Cu—B Based Sintered Compact]

Respective elements were weighed so that the R1-T1-Cu—B based sintered compact would approximately result in the compositions indicated as Labels 12-A through 12-L in Table 39, and through casting by a strip casting method, raw material alloys in flake form having a thickness of 0.2 to 0.4 mm were obtained. After each resultant raw material alloy in flake form was hydrogen-pulverized, it was subjected to a dehydrogenation treatment of heating to 550° C. in a vacuum and then cooling, whereby a coarse-pulverized powder was obtained. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. Note that the particle size $D_{50}$ is a central value of volume (volume median particle diameter) as obtained by a laser diffraction method by airflow dispersion technique.

To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction.

In a vacuum, the resultant compact was sintered for 4 hours at not lower than 1000° C. and not higher than 1050° C. (for each sample, a temperature was selected at which a sufficiently dense texture would result through sintering) and thereafter rapidly cooled, whereby an R1-T1-Cu—B based sintered compact was obtained. Each resultant sintered compact had a density of 7.5 $Mg/m^3$ or more. A component analysis of each resultant sintered compact is shown in Table 39. The respective components in Table 39 were measured by using Inductively Coupled Plasma Optical Emission Spectroscopy (ICP-OES). The oxygen amount in each sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %. In Table 39, "[T1]/[B]" is a ratio (a/b) between: a total (a) of the respective value of a result of dividing an analysis value (mass %) of each element (which herein are Fe, Al, Si and Mn) composing T1 with the atomic weight of that element; and (b) a result of dividing an analysis value (mass %) of B with the atomic weight of B. The same also applies to all tables below. Note that each composition, oxygen amount, and carbon amount in Table 39 do not total to 100 mass %. This is because the method of analysis differs for each component, as aforementioned. The same also applies to any other tables.

TABLE 39

| Label | composition of R1-T1-Cu—B based sintered compact (mass %): R1 Nd | R1 Pr | T1 Fe | T1 Al | T1 Si | T1 Mn | Cu | B | [T1]/[B] |
|---|---|---|---|---|---|---|---|---|---|
| 12-A | 28.1 | 0.1 | 69.1 | 0.05 | 0.05 | 0.04 | 0.48 | 0.89 | 15.1 |
| 12-B | 28.0 | 0.1 | 69.2 | 0.05 | 0.04 | 0.04 | 0.49 | 0.91 | 14.8 |
| 12-C | 28.1 | 0.1 | 69.0 | 0.05 | 0.05 | 0.04 | 0.49 | 0.93 | 14.4 |
| 12-D | 28.2 | 0.1 | 69.1 | 0.05 | 0.05 | 0.03 | 0.48 | 0.95 | 14.1 |
| 12-E | 28.1 | 0.1 | 69.3 | 0.05 | 0.04 | 0.03 | 0.49 | 0.98 | 13.7 |
| 12-F | 28.2 | 0.1 | 69.4 | 0.05 | 0.05 | 0.04 | 0.05 | 0.93 | 14.5 |
| 12-G | 28.3 | 0.1 | 69.2 | 0.05 | 0.05 | 0.03 | 0.11 | 0.94 | 14.3 |
| 12-H | 28.1 | 0.1 | 68.8 | 0.03 | 0.05 | 0.04 | 0.68 | 0.93 | 14.4 |
| 12-I | 28.3 | 0.1 | 68.0 | 0.03 | 0.06 | 0.03 | 1.48 | 0.92 | 14.4 |
| 12-J | 28.2 | 0.1 | 67.8 | 0.03 | 0.05 | 0.03 | 1.95 | 0.91 | 14.5 |
| 12-K | 29.1 | 0.1 | 67.7 | 0.03 | 0.04 | 0.04 | 0.50 | 0.92 | 14.4 |
| 12-L | 30.6 | 0.1 | 66.4 | 0.04 | 0.05 | 0.04 | 0.49 | 0.89 | 14.5 |

[Step of Providing R2-Ga—Fe Based Alloy]

Respective elements were weighed so that the R2-Ga—Fe based alloy would approximately result in the composition indicated as Label 12-a in Table 40, and these raw materials were melted; thus, by a single roll rapid quenching method (melt spinning method), an alloy in ribbon or flake form was obtained. Using a mortar, the resultant alloy was pulverized in an argon ambient, and thereafter was passed through a sieve with an opening of 425 μm, thereby providing an R2-Ga—Fe based alloy. The composition of the resultant R2-Ga—Fe based alloy is shown in Table 40. The respective components in Table 40 were measured by using Inductively Coupled Plasma Optical Emission Spectroscopy (ICP-OES).

TABLE 40

| Label | composition of R2-Ga—Fe based alloy (mass %): Pr | Ga | Fe |
|---|---|---|---|
| 12-a | 80.3 | 7.9 | 10.5 |

[Step of Performing First Heat Treatment]

The R1-T1-Cu—B based sintered compact of Labels 12-A through 12-L in Table 39 were severed and cut into a 4.4 mm×10.0 mm×11.0 mm rectangular solid (where a 10.0 mm×11.0 mm face defined a face perpendicular to the alignment direction). Next, as shown in FIG. 4, in a processing container 3 made of niobium foils, the R2-Ga—Fe based alloy of indicated as Label 12-a in Table 40 was placed above and below the R1-T1-Cu—B based sintered compacts of Labels 12-A through 1-L in an amount of 10 mass % each, thus totaling 20 mass %, with respect to the weight of the R1-T1-Cu—B based sintered compact, in such a manner that mainly its face perpendicular to the alignment direction of the R1-T1-Cu—B based sintered compact 1 (i.e., the direction indicated by arrows in the figure) was in contact with the R2-Ga—Fe based alloy 2. Next, in argon which was controlled to a reduced pressure of 200 Pa, by using a tubular flow furnace, the first heat treatment was effected by heating the R2-Ga—Fe based alloy and the R1-T1-Cu—B based sintered compact based on the temperatures and time indicated for the first heat treatment in Table 41, followed by cooling.

[Step of Performing Second Heat Treatment]

In argon which was controlled to a reduced pressure of 200 Pa, by using a tubular flow furnace, the R1-T1-Cu—B based sintered compact having undergone the first heat treatment was subjected to the second heat treatment based on the temperature and times indicated for the second heat treatment in Table 41, followed by cooling. In order to remove any thickened portion in the R2-Ga—Fe based alloy existing in the surface vicinity of each sample after the heat treatment, a surface grinder was used to cut on the entire surface of each sample, whereby samples respectively in the form of a 4.0 mm×4.0 mm×4.0 mm cube (sintered R-T-B based magnet) were obtained. Note that the heating temperature for the R2-Ga—Fe alloy and R1-T1-Cu—B based sintered compact in the step of performing the first heat treatment and the heating temperature for the R1-T1-Cu—B based sintered compact in the step of performing the second heat treatment were each measured by attaching a thermocouple.

[Sample Evaluations]

With respect to the resultant samples, $B_r$ and $H_{cJ}$ of each sample were measured by using a B—H tracer. Results of measurement are shown in Table 41. As shown in Table 41, examples of the present invention in which the R1-T1-Cu—B based sintered compact had a molar ratio [T1]/[B] greater than 14.0 but not greater than 15.0 and a Cu content of not less than 0.1 mass % and not more than 1.5 mass % all attained high $B_r$ and high $H_{cJ}$. On the other hand, in sample No. 12-5, in which the molar ratio [T1]/[B] was 14.0 or smaller, $H_{cJ}$ had greatly reduced; and in sample No. 12-1, in which the molar ratio [T1]/[B] exceeded 15.0, $B_r$ had greatly reduced. Moreover, in sample No. 12-6 in which the Cu content was less than 0.1 mass %, $H_{cJ}$ had greatly reduced; and in sample No. 12-10, in which the Cu content exceeded 1.5 mass %, $B_r$ and $H_{cJ}$ had greatly reduced.

TABLE 41

| | producing conditions | | | | | | | | |
|---|---|---|---|---|---|---|---|---|---|
| | R1-T1-Cu—B based sintered compact | | | R2-Ga—Fe based | | | | | |
| sample No. | Label | Cu (mass %) | [T1]/[B] | alloy Label | first heat treatment | second heat treatment | Br (T) | HcJ (kA/m) | Notes |
| 12-1 | 12-A | 0.48 | 15.1 | 12-a | 800° C. × 8 h | 520° C. × 2 h | 1.25 | 2101 | Comp. |
| 12-2 | 12-B | 0.49 | 14.8 | 12-a | 800° C. × 8 h | 520° C. × 2 h | 1.30 | 1914 | Inv. |
| 12-3 | 12-C | 0.49 | 14.4 | 12-a | 800° C. × 8 h | 520° C. × 2 h | 1.33 | 1860 | Inv. |
| 12-4 | 12-D | 0.48 | 14.1 | 12-a | 1000° C. × 8 h | 520° C. × 8 h | 1.39 | 1499 | Inv. |
| 12-5 | 12-E | 0.49 | 13.7 | 12-a | 1000° C. × 8 h | 520° C. × 8 h | 1.42 | 1004 | Comp. |
| 12-6 | 12-F | 0.05 | 14.5 | 12-a | 800° C. × 8 h | 520° C. × 2 h | 1.39 | 1312 | Comp. |
| 12-7 | 12-G | 0.11 | 14.3 | 12-a | 800° C. × 8 h | 520° C. × 2 h | 1.38 | 1433 | Inv. |
| 12-8 | 12-H | 0.68 | 14.4 | 12-a | 800° C. × 8 h | 520° C. × 2 h | 1.33 | 1756 | Inv. |
| 12-9 | 12-I | 1.48 | 14.4 | 12-a | 800° C. × 8 h | 520° C. × 2 h | 1.30 | 1411 | Inv. |
| 12-10 | 12-J | 1.95 | 14.5 | 12-a | 800° C. × 8 h | 520° C. × 2 h | 1.27 | 765 | Comp. |
| 12-11 | 12-K | 0.50 | 14.4 | 12-a | 800° C. × 8 h | 520° C. × 2 h | 1.32 | 1789 | Inv. |
| 12-12 | 12-L | 0.49 | 14.5 | 12-a | 800° C. × 8 h | 520° C. × 2 h | 1.30 | 1904 | Inv. |

Experimental Example 13

[Step of Providing R1-T1-Cu—B Based Sintered Compact]

A sintered compact was produced by the same method as in Experimental Example 12, except for weighing respective elements so that the R1-T1-Cu—B sintered compact would approximately result in the composition indicated as Label 13-A in Table 42. The resultant sintered compact had a density of 7.5 $Mg/m^3$ or more. A component analysis of the resultant sintered compact is shown in Table 42. Respective components in Table 42 were measured by the same method as in Experimental Example 12. The oxygen amount in the sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 42

| | composition of R1-T1-Cu—B based sintered compact (mass %) | | | | | | | | |
|---|---|---|---|---|---|---|---|---|---|
| | R1 | | T1 | | | | | | |
| Label | Nd | Pr | Fe | Al | Si | Mn | Cu | B | [T1]/[B] |
| 13-A | 28.1 | 0.1 | 69.0 | 0.05 | 0.05 | 0.04 | 0.49 | 0.93 | 14.4 |

[Step of Providing R2-Ga—Fe Based Alloy]

R2-Ga—Fe based alloys were provided by the same method as in Experimental Example 12, except for weighing respective elements so that the R2-Ga—Fe based alloys would approximately result in the compositions indicated as Labels 13-a through 13-h in Table 43. The compositions of the R2-Ga—Fe based alloys composition are shown in Table 43. Respective components in Table 43 were measured by the same method as in Experimental Example 12.

TABLE 43

| Label | composition of R2-Ga—Fe based alloy (mass %) Pr | Ga | Fe |
|---|---|---|---|
| 13-a | 89.7 | 8.8 | 0.0 |
| 13-b | 86.1 | 8.5 | 4.2 |
| 13-c | 80.3 | 7.9 | 10.5 |
| 13-d | 76.1 | 7.2 | 15.2 |
| 13-e | 71.4 | 6.6 | 20.9 |
| 13-f | 54.5 | 5.1 | 39.5 |
| 13-g | 48.8 | 5.3 | 44.2 |
| 13-h | 43.1 | 4.7 | 50.8 |

[Step of Performing First Heat Treatment]

Except for heating the R2-Ga—Fe alloy and the R1-T1-Cu—B based sintered compact based on the temperature and time indicated for the first heat treatment in Table 44, the first heat treatment was performed by the same method as in Experimental Example 12.

[Step of Performing Second Heat Treatment]

Except for heating the R2-Ga—Fe alloy and the R1-T1-Cu—B based sintered compact based on the temperature and time indicated for the second heat treatment in Table 44, the second heat treatment was performed by the same method as in Experimental Example 12. Each sample after the heat treatment was processed by the same method as in Experimental Example 12, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 44. As shown in Table 44, examples of the present invention in which the R2-Ga—Fe based alloy had an Fe amount of not less than 10 mass % and not more than 45 mass % attained high $B_r$ and high $H_{cJ}$. Moreover, when the Fe amount in the R—Ga—Fe based alloy accounted for not less than 15 mass % and not more than 40 mass % of (sample Nos. 13-4 and 13-6), even higher $B_r$ and higher $H_{cJ}$ were obtained. On the other hand, in sample Nos. 13-1 and 13-2, in which the R—Ga—Fe based alloy had an Fe amount of 10 mass % or less (5 mass % or less), $B_r$ had greatly reduced. In sample No. 13-8, in which the Ru—Ga—Fe based alloy had an Fe amount exceeding 45 mass %, $H_{cJ}$ had greatly reduced.

TABLE 44

| sample No. | producing conditions: R1-T1-Cu—B based sintered compact Label | R2-Ga—Fe based alloy Label | Fe (mass %) | first heat treatment | second heat treatment | Br (T) | HcJ (kA/m) | Notes |
|---|---|---|---|---|---|---|---|---|
| 13-1 | 13-A | 13-a | 0.0 | 800° C. × 8 h | 520° C. × 2 h | 1.26 | 2071 | Comp. |
| 13-2 | 13-A | 13-b | 4.2 | 800° C. × 8 h | 520° C. × 2 h | 1.28 | 1926 | Comp. |
| 13-3 | 13-A | 13-c | 10.5 | 800° C. × 8 h | 520° C. × 2 h | 1.33 | 1860 | Inv. |
| 13-4 | 13-A | 13-d | 15.2 | 800° C. × 8 h | 520° C. × 2 h | 1.34 | 1819 | Inv. |
| 13-5 | 13-A | 13-e | 20.9 | 800° C. × 8 h | 520° C. × 2 h | 1.36 | 1807 | Inv. |
| 13-6 | 13-A | 13-f | 39.5 | 800° C. × 8 h | 520° C. × 2 h | 1.39 | 1710 | Inv. |
| 13-7 | 13-A | 13-g | 44.2 | 800° C. × 8 h | 520° C. × 2 h | 1.42 | 1539 | Inv. |
| 13-8 | 13-A | 13-h | 50.8 | 800° C. × 8 h | 520° C. × 2 h | 1.44 | 1130 | Comp. |

Experimental Example 14

[Step of Providing R1-T1-Cu—B Based Sintered Compact]

A sintered compact was produced by the same method as in Experimental Example 12, except for weighing respective elements so that the R1-T1-Cu—B sintered compact would approximately result in the composition indicated as Label 14-A in Table 45. The resultant sintered compact had a density of 7.5 $Mg/m^3$ or more. A component analysis of the resultant sintered compact is shown in Table 45. Respective components in Table 45 were measured by the same method as in Experimental Example 12. The oxygen amount in the sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 45

| Label | composition of R1-T1-Cu—B based sintered compact (mass %): R1 Nd | R1 Pr | T1 Fe | T1 Al | T1 Si | T1 Mn | T1 Cu | B | [T1]/[B] |
|---|---|---|---|---|---|---|---|---|---|
| 14-A | 28.1 | 0.1 | 69.0 | 0.05 | 0.05 | 0.04 | 0.49 | 0.93 | 14.4 |

[Step of Providing R2-Ga—Fe Based Alloy]

R2-Ga—Fe based alloys were provided by the same method as in Experimental Example 12, except for weighing respective elements so that the R2-Ga—Fe based alloys would approximately result in the compositions indicated as Labels 14-a through 14-i in Table 46. The compositions of the R2-Ga—Fe based alloys are shown in Table 46. Respective components in Table 46 were measured by the same method as in Experimental Example 12.

TABLE 46

| Label | composition of R2-Ga—Fe based alloy (mass %) Nd | Pr | Ga | Fe |
|---|---|---|---|---|
| 14-a | 0.0 | 34.0 | 35.3 | 29.5 |
| 14-b | 0.0 | 35.5 | 35.0 | 28.0 |

TABLE 46-continued

| Label | composition of R2-Ga—Fe based alloy (mass %) Nd | Pr | Ga | Fe |
|---|---|---|---|---|
| 14-c | 0.0 | 71.4 | 6.6 | 20.9 |
| 14-d | 0.0 | 45.0 | 44.5 | 9.8 |
| 14-e | 0.0 | 62.6 | 25.4 | 10.6 |
| 14-f | 0.0 | 80.3 | 7.9 | 10.5 |
| 14-g | 0.0 | 79.8 | 4.1 | 10.0 |
| 14-h | 0.0 | 86.5 | 2.1 | 9.8 |
| 14-i | 71.5 | 0.0 | 6.9 | 19.9 |

[Sample Evaluations]

With respect to the resultant samples, $B_r$ and $H_{cJ}$ of each sample were measured by using a B—H tracer. Results of measurement are shown in Table 47. As shown in Table 47, high $B_r$ and high $H_{cJ}$ were attained by examples of the present invention in which the R amount in the R2-Ga—Fe based alloy was not less than 35 mass % and not more than 85 mass %, and the Ga amount was not less than 2.5 mass % and not more than 40 mass %. On the other hand, if either R or Ga in the R2-Ga—Fe based alloy was outside the range according to the present disclosure (Label 14-a had its R2 outside the range; Label sample No. 14-d had its Ga outside the range; and Label 14-h had its R2 and Ga outside the ranges), high $H_{cJ}$ could not be obtained. Thus, high $B_r$ and high $H_{cJ}$ are being obtained because of the R and Ga (and Fe, as indicated in Experimental Example 13) contents falling within the ranges according to the present disclosure.

TABLE 47

| sample No. | producing conditions: R1-T1-Cu—B based sintered compact Label | R2-Ga—Fe based alloy: Label | R2 (mass %) | Ga (mass %) | Fe (mass %) | first heat treatment | second heat treatment | Br (T) | HcJ (kA/m) | Notes |
|---|---|---|---|---|---|---|---|---|---|---|
| 14-1 | 14-A | 14-a | 34.0 | 35.3 | 29.5 | 800° C. × 8 h | 520° C. × 2 h | 1.45 | 876 | Comp. |
| 14-2 | 14-A | 14-b | 35.5 | 35.0 | 28.0 | 800° C. × 8 h | 520° C. × 2 h | 1.40 | 1412 | Inv. |
| 14-3 | 14-A | 14-c | 71.4 | 6.6 | 20.9 | 800° C. × 8 h | 520° C. × 2 h | 1.36 | 1807 | Inv. |
| 14-4 | 14-A | 14-d | 45.0 | 44.5 | 9.8 | 800° C. × 8 h | 520° C. × 2 h | 1.44 | 1268 | Comp. |
| 14-5 | 14-A | 14-e | 62.6 | 25.4 | 10.6 | 800° C. × 8 h | 520° C. × 2 h | 1.38 | 1558 | Inv. |
| 14-6 | 14-A | 14-f | 80.3 | 7.9 | 10.5 | 800° C. × 8 h | 520° C. × 2 h | 1.31 | 1988 | Inv. |
| 14-7 | 14-A | 14-g | 79.8 | 4.1 | 10.0 | 800° C. × 8 h | 520° C. × 2 h | 1.36 | 1776 | Inv. |
| 14-8 | 14-A | 14-h | 86.5 | 2.1 | 9.8 | 800° C. × 8 h | 520° C. × 2 h | 1.40 | 1304 | Comp. |
| 14-9 | 14-A | 14-i | 71.5 | 6.9 | 19.9 | 800° C. × 8 h | 520° C. × 2 h | 1.36 | 1741 | Inv. |

[Step of Performing First Heat Treatment]

Except for heating the R2-Ga—Fe alloy and the R1-T1-Cu—B based sintered compact based on the temperature and time indicated for the first heat treatment in Table 47, the first heat treatment was performed by the same method as in Experimental Example 12.

[Step of Performing Second Heat Treatment]

Except for heating the R2-Ga—Fe alloy and the R1-T1-Cu—B based sintered compact based on the temperature and time indicated for the second heat treatment in Table 47, the second heat treatment was performed by the same method as in Experimental Example 12. Each sample after the heat treatment was processed by the same method as in Experimental Example 12, thereby providing a sintered R-T-B based magnet.

Experimental Example 15

[Step of Providing R1-T1-Cu—B Based Sintered Compact]

A sintered compact was produced by the same method as in Experimental Example 12, except for weighing respective elements so that the R1-T1-Cu—B sintered compact would approximately result in the composition indicated as Label 15-A in Table 48. The resultant sintered compact had a density of 7.5 $Mg/m^3$ or more. A component analysis of the resultant sintered compact is shown in Table 48. Respective components in Table 48 were measured by the same method as in Experimental Example 12. The oxygen amount in the sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %.

TABLE 48

| | composition of R1-T1-Cu—B based sintered compact (mass %) | | | | | | | | |
|---|---|---|---|---|---|---|---|---|---|
| | R1 | | T1 | | | | | | |
| Label | Nd | Pr | Fe | Al | Si | Mn | Cu | B | [T1]/[B] |
| 15-A | 28.1 | 0.1 | 69.0 | 0.05 | 0.05 | 0.04 | 0.49 | 0.93 | 14.4 |

[Step of Providing R2-Ga—Fe Based Alloy]

An R2-Ga—Fe based alloy was provided by the same method as in Experimental Example 12, except for weighing respective elements so that the R2-Ga—Fe based alloy would approximately result in the composition indicated as Label 15-a in Table 49. The composition of the R2-Ga—Fe based alloy is shown in Table 49. Respective components in Table 49 were measured by the same method as in Experimental Example 12.

TABLE 49

| | composition of R2-Ga—Fe based alloy (mass %) | | |
|---|---|---|---|
| Label | Pr | Ga | Fe |
| 15-a | 71.4 | 6.6 | 20.9 |

[Step of Performing First Heat Treatment]

Except for heating the R2-Ga—Fe alloy and the R1-T1-Cu—B based sintered compact based on the temperatures and time indicated for the first heat treatment in Table 50, the first heat treatment was performed by the same method as in Experimental Example 12.

[Step of Performing Second Heat Treatment]

Except for heating the R2-Ga—Fe alloy and the R1-T1-Cu—B based sintered compact based on the temperatures and time indicated for the second heat treatment in Table 50, the second heat treatment was performed by the same method as in Experimental Example 12. Each sample after the heat treatment was processed by the same method as in Experimental Example 12, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 50. As shown in Table 53, examples of the present invention satisfying the first heat treatment temperature (not lower than 700° C. and not higher than 1100° C.) and second heat treatment temperature (not lower than 450° C. and not higher than 600° C.) according to the present disclosure attained high $B_r$ and high $H_{cJ}$. Moreover, as shown in Table 50, when the temperature of the first heat treatment was not lower than 800° C. and not higher than 1000° C. and the temperature of the second heat treatment was not lower than 480° C. and not higher than 560° C., even higher $H_{cJ}$ was obtained. On the other hand, when either the first heat treatment temperature or the second heat treatment temperature was outside the range according to the present disclosure (sample No. 15-1 was outside the range with respect to its first heat treatment; and sample Nos. 15-5 and 15-11 were outside the range with respect to their second heat treatment), high $H_{cJ}$ could not be obtained.

TABLE 50

| | producing conditions | | | | | | |
|---|---|---|---|---|---|---|---|
| sample No. | R1-T1-Cu—B based sintered compact Label | R2-Ga—Fe based alloy Label | first heat treatment | second heat treatment | Br (T) | HcJ (kA/m) | Notes |
| 15-1 | 15-A | 15-a | 600° C. × 8 h | 520° C. × 2 h | 1.44 | 763 | Comp. |
| 15-2 | 15-A | 15-a | 700° C. × 8 h | 520° C. × 2 h | 1.39 | 1640 | Inv. |
| 15-3 | 15-A | 15-a | 900° C. × 8 h | 520° C. × 2 h | 1.32 | 1916 | Inv. |
| 15-4 | 15-A | 15-a | 1000° C. × 8 h | 520° C. × 2 h | 1.30 | 1978 | Inv. |
| 15-5 | 15-A | 15-a | 800° C. × 8 h | 440° C. × 2 h | 1.44 | 1148 | Comp. |
| 15-6 | 15-A | 15-a | 800° C. × 8 h | 450° C. × 2 h | 1.40 | 1403 | Inv. |
| 15-7 | 15-A | 15-a | 800° C. × 8 h | 480° C. × 2 h | 1.37 | 1754 | Inv. |
| 15-8 | 15-A | 15-a | 800° C. × 8 h | 520° C. × 2 h | 1.36 | 1807 | Inv. |
| 15-9 | 15-A | 15-a | 800° C. × 8 h | 560° C. × 2 h | 1.37 | 1710 | Inv. |
| 15-10 | 15-A | 15-a | 800° C. × 8 h | 600° C. × 2 h | 1.40 | 1479 | Inv. |
| 15-11 | 15-A | 15-a | 800° C. × 8 h | 620° C. × 2 h | 1.45 | 812 | Comp. |

Experimental Example 16

[Step of Providing R1-T1-Cu—B Based Sintered Compact]

Sintered compacts were produced by the same method as in Experimental Example 12, except for weighing respective elements so that the R1-T1-Cu—B based sintered compacts would approximately result in the compositions indicated as Labels 16-A and 16-B in Table 51. Each resultant sintered compact had a density of 7.5 $Mg/m^3$ or more. A component analysis of each resultant sintered compact is shown in Table 51. Respective components in Table 51 were measured by the same method as in Experimental Example 12. The oxygen amount in each sintered compact was measured by a gas fusion infrared absorption method, which all indicated a value around 0.2 mass %. The C (carbon amount) was measured with a gas analyzer based on a combustion-infrared absorption method, which indicated a value around 0.1 mass %. In Table 51, "[T1]/[B]" is a ratio (a/b) between: a total (a) of the respective value of a result of dividing an analysis value (mass %) of each element (which herein are Fe, Co, Al, Si and Mn) composing T1 with the atomic weight of that element; and (b) a result of dividing an analysis value (mass %) of B with the atomic weight of B.

TABLE 51

| | composition of R1-T1-Cu—B based sintered compact (mass %) | | | | | | | | | | | | |
|---|---|---|---|---|---|---|---|---|---|---|---|---|---|
| | R1 | | | T1 | | | | | | | | | |
| Label | Nd | Pr | Dy | Fe | Co | Al | Si | Mn | Zr | Ga | Cu | B | [T1]/[B] |
| 16-A | 29.1 | 0.2 | 1.0 | 66.3 | 0.90 | 0.03 | 0.05 | 0.04 | 0.00 | 0.10 | 0.15 | 0.91 | 14.3 |
| 16-B | 23.3 | 5.8 | 0.0 | 66.9 | 0.90 | 0.03 | 0.05 | 0.04 | 0.10 | 0.00 | 0.50 | 0.91 | 14.5 |

[Step of Providing R2-Ga—Fe Based Alloy]

An R2-Ga—Fe based alloy was provided by the same method as in Experimental Example 12, except for weighing respective elements so that the R2-Ga—Fe based alloy would approximately result in the composition indicated as Label 16-a in Table 52. The composition of the R2-Ga—Fe based alloy is shown in Table 52. Respective components in Table 52 were measured by the same method as in Experimental Example 12.

TABLE 52

| | composition of R2-Ga—Fe based alloy (mass %) | | |
|---|---|---|---|
| Label | Pr | Ga | Fe |
| 16-a | 71.4 | 6.6 | 20.9 |

[Step of Performing First Heat Treatment]

Except for heating the R2-Ga—Fe alloy and the R1-T1-Cu—B based sintered compact based on the temperatures and time indicated for the first heat treatment in Table 53, the first heat treatment was performed by the same method as in Experimental Example 12.

[Step of Performing Second Heat Treatment]

Except for heating the R2-Ga—Fe alloy and the R1-T1-Cu—B based sintered compact based on the temperature and times indicated for the second heat treatment in Table 53, the second heat treatment was performed by the same method as in Experimental Example 12. Each sample after the heat treatment was processed by the same method as in Experimental Example 12, thereby providing a sintered R-T-B based magnet.

[Sample Evaluations]

With respect to the resultant samples, $B_r$ and $H_{cJ}$ of each sample were measured by using a B—H tracer. Results of measurement are shown in Table 53. Results of measuring the components of each sample by using Inductively Coupled Plasma Optical Emission Spectroscopy (ICP-OES) are shown in Table 53. As shown in Table 53, high $B_r$ and high $H_{cJ}$ were obtained even when the R1-T1-Cu—B based sintered compact contained Dy, Co, Ga, Cu or Zr.

TABLE 53

| | producing conditions | | | | | | |
|---|---|---|---|---|---|---|---|
| sample No. | R1-T1-Cu—B based sintered compact Label | R2-Ga—Fe based alloy Label | first heat treatment | second heat treatment | Br (T) | HcJ (kA/m) | Notes |
| 16-1 | 16-A | 16-a | 1000° C. × 8 h | 520° C. × 2 h | 1.33 | 2130 | Inv. |
| 16-2 | 16-B | 16-a | 800° C. × 8 h | 520° C. × 1 h | 1.35 | 1899 | Inv. |
| 16-3 | 16-B | 16-a | 1100° C. × 8 h | 520° C. × 2 h | 1.30 | 2150 | Inv. |

INDUSTRIAL APPLICABILITY

A sintered R-T-B based magnet obtained according to the present invention can be suitably used in voice coil motors (VCM) of hard disk drives, various types of motors such as motors for electric vehicles (EV, HV, PHV, etc.) and motors for industrial equipment, home appliance products, and the like.

REFERENCE SIGNS LIST

1 R1-T1-B based sintered compact (R1-T1-Cu—B based sintered compact)
2 R2-Cu—Ga—Fe based alloy (R2-Ga—Fe based alloy)
3 process chamber

The invention claimed is:

1. A sintered R-T-B based magnet comprising:

R: not less than 28 mass % and not more than 36 mass % (where R is at least one rare-earth element which always includes at least one of Nd and Pr), B: not less than 0.73 mass % and not more than 0.96 mass %, Ga: not less than 0.1 mass % and not more than 1.0 mass %, Cu: not less than 0.1 mass % and not more than 1.0 mass %, and T: not less than 60 mass % (where T is at least one selected from the group consisting of Fe, Co, Al, Mn and Si and always includes Fe, such that the Fe content accounts for 80 mass % or more in the entire T), wherein the sintered R-T-B based magnet is composed of a main phase which essentially consists of an $R_2T_{14}B$ compound and of a grain boundary phase which is at grain boundaries of the main phase, the grain boundary phase including Fe, and a thickness of the grain boundary phase in a magnet surface portion being greater than a thickness of the grain boundary phase in a magnet central portion;

a molar ratio of T to B ([T]/[B]) is greater than 14.0;

an R amount in the magnet surface portion at a cross section perpendicular to an alignment direction is greater than an R amount in the magnet central portion;

a Ga amount in the magnet surface portion at the cross section perpendicular to the alignment direction is greater than a Ga amount in the magnet central portion;

a molar ratio of T to B ([T]/[B]) in the magnet surface portion at the cross section perpendicular to the alignment direction is higher than a molar ratio of T to B ([T]/[B]) in the magnet central portion; and the sintered R-T-B based magnet satisfies one of the following conditions:

an oxygen amount of the sintered R-T-B based magnet is about 0.1 mass % to 0.3 mass % and $B_r$ is on or above a first characteristic line that is defined by an equation $B_r=-0.00015H_{cJ}+1.66$; and the oxygen amount of the sintered R-T-B based magnet is about 0.4 mass % to 0.7 mass % and $B_r$ is on or above a second characteristic line that is defined by an equation $B_r=-0.00015H_{cJ}+1.56$, where $B_r$ is remanence (unit is Tesla [T]) and $H_{cJ}$ is coercivity (unit is kiloampere/meter [kA/m]).

2. The sintered R-T-B based magnet of claim 1, wherein a Cu amount in the magnet surface portion at the cross section perpendicular to the alignment direction is greater than a Cu amount in the magnet central portion.

3. The sintered R-T-B based magnet of claim 1, wherein the molar ratio of T to B ([T]/[B]) of the sintered R-T-B based magnet is greater than 14.0 but not greater than 16.4.

* * * * *